US009328494B2

(12) United States Patent
Yoshioka et al.

(10) Patent No.: US 9,328,494 B2
(45) Date of Patent: May 3, 2016

(54) FLUSH WATER TANK APPARATUS AND DISCHARGE APPARATUS

(75) Inventors: Takashi Yoshioka, Yukuhashi (JP); Shu Kashirajima, Kitakyushu (JP); Mitsuhiro Suenaga, Kitaykyushu (JP); Takashi Kanzaki, Nakatsu (JP); Yoshikazu Anami, Fukuoka (JP)

(73) Assignee: TOTO LTD., Fukuoka (JP)

( * ) Notice: Subject to any disclaimer, the term of this patent is extended or adjusted under 35 U.S.C. 154(b) by 466 days.

(21) Appl. No.: 13/697,746

(22) PCT Filed: May 11, 2011

(86) PCT No.: PCT/JP2011/060834

§ 371 (c)(1),
(2), (4) Date: Nov. 13, 2012

(87) PCT Pub. No.: WO2011/142379

PCT Pub. Date: Nov. 17, 2011

(65) Prior Publication Data

US 2013/0055496 A1 Mar. 7, 2013

(30) Foreign Application Priority Data

May 14, 2010 (JP) ..... 2010-112511
May 14, 2010 (JP) ..... 2010-112513
May 14, 2010 (JP) ..... 2010-112514

(51) Int. Cl.
*E03D 1/14* (2006.01)
*E03D 1/00* (2006.01)
(Continued)

(52) U.S. Cl.
CPC ..... *E03D 1/003* (2013.01); *E03D 1/144* (2013.01); *E03D 1/33* (2013.01); *E03D 1/34* (2013.01); *E03D 5/006* (2013.01); *E03D 5/10* (2013.01)

(58) Field of Classification Search
CPC ..... E03D 1/14; E03D 1/142; E03D 1/144
USPC ..... 4/324–327, 415
See application file for complete search history.

(56) References Cited

U.S. PATENT DOCUMENTS 2,077,832 A * 4/1937 Gebert ..... 4/391
4,357,720 A * 11/1982 Stahli ..... E03D 1/30 4/378

(Continued)

FOREIGN PATENT DOCUMENTS

JP 60-144669 U 9/1985
JP 61-019082 U 2/1986

(Continued)

OTHER PUBLICATIONS

The English translation of the Written Opinion of the International Searching Authority dated Aug. 16, 2011, which corresponds to PCT/JP2011/060834, and is related to U.S. Appl. No. 13/697,746.

(Continued)

*Primary Examiner* — Paul R Durand
*Assistant Examiner* — Nicholas Ros
(74) *Attorney, Agent, or Firm* — Studebaker & Brackett PC

(57) ABSTRACT

A flush water tank apparatus for storing flush water for flushing a flush toilet is disclosed. The flush water tank apparatus includes: a reservoir tank for storing flush water, the reservoir tank having a discharge port formed on the bottom surface thereof; a valve body for opening and closing a discharge port to supply flush water to a flush toilet; and a side surface extending in the upward direction from the bottom surface of the reservoir tank so as to surround the discharge port; and includes: a cylindrical body opens at the top and forms an opening portion on the side surface; and switching valves for opening and closing the opening portion on the cylindrical body to enable adjustment of the opening surface area of the opening portion of the cylindrical body so that the volume of flush water supplied from the reservoir tank discharge port to the flush toilet can be obtained in multiple stages, including at least the three stages of large, medium, and small.

10 Claims, 33 Drawing Sheets

(51) Int. Cl.

| | |
|---|---|
| ***E03D 1/33*** | (2006.01) |
| ***E03D 1/34*** | (2006.01) |
| ***E03D 5/00*** | (2006.01) |
| ***E03D 5/10*** | (2006.01) |

(56) References Cited

U.S. PATENT DOCUMENTS

| | | | | |
|---|---|---|---|---|
| 4,486,906 | A * | 12/1984 | Meier | 4/378 |
| 4,527,296 | A * | 7/1985 | Musgrove | 4/324 |
| 5,653,252 | A * | 8/1997 | Steg et al. | 137/315.08 |
| 6,584,622 | B1 * | 7/2003 | Nilsson | 4/324 |

FOREIGN PATENT DOCUMENTS

| | | | |
|---|---|---|---|
| JP | 61-19082 | U | 2/1986 |
| JP | 61-72144 | A | 4/1986 |
| JP | 61-072144 | A | 4/1986 |
| JP | 07-011680 | A | 1/1995 |
| JP | 07-119190 | A | 5/1995 |
| JP | 08-311953 | A | 11/1996 |
| JP | 08-319644 | A | 12/1996 |
| JP | 10-121541 | A | 5/1998 |
| JP | 2002-021144 | A | 1/2002 |
| JP | 2003-049471 | A | 2/2003 |
| JP | 2003-239347 | A | 8/2003 |
| JP | 2004-211301 | A | 7/2004 |
| JP | 4254002 | B2 | 4/2009 |

OTHER PUBLICATIONS

Office Action of Japanese Patent Application No. 2010-112511 dispatched on Dec. 1, 2011.
Office Action of Japanese Patent Application No. 2010-112513 dispatched on Dec. 1, 2011.
Office Action of Japanese Patent Application No. 2010-112514 dispatched on Dec. 1, 2011.
International Search Report for PCT/JP2011/060834.

* cited by examiner

FLUSH WATER TANK APPARATUS AND DISCHARGE APPARATUS

TECHNICAL FIELD

The present invention relates to a flush water tank apparatus and a discharge apparatus, and more particularly to a flush water tank apparatus for storing flush water for flushing a toilet, and to a discharge apparatus furnished with a discharge valve for opening and closing a discharge port on a reservoir tank for storing flush water to supply flush water to a toilet.

BACKGROUND ART

Conventionally known flush water tank apparatuses for storing flush water for flushing a toilet furnished with a discharge apparatus have included those such as Japanese Patent Unexamined Publication S61-72144 (Patent Citation 1), wherein as a flush water tank apparatus for storing flush water used to clean a toilet, an opening is formed on the side surface of a cylindrical body disposed to surround a discharge port formed at the bottom portion of a reservoir tank, and a valve body capable of opening and closing that opening is provided, so that for large flushes, the flush water volume is increased by allowing the opening on the cylindrical body to stay open, whereas for small flushes, the flush water volume is reduced by closing the cylindrical body opening with the valve body, so that flushing can be switched between the two stages of large and small flush.

In the discharge apparatus disclosed in Patent Citation 1, a reservoir cylinder is provided on the inside of the cylindrical body; a float capable of up-and-down motion in tandem with the valve body for closing the discharge port is disposed inside this reservoir cylinder, and by forming a small discharge pathway in the reservoir cylinder, discharge of flush water from the small discharge pathway in the reservoir cylinder can be started when discharge starts, gradually lowering the water level in the reservoir cylinder, while the discharge valve body drops together with the drop of the float as that water level falls, and the discharge port is closed by the valve at the desired timing.

Further disclosed in Japanese Patent Unexamined Publication 2002-21144 (Patent Citation 2) as a flush water tanks apparatus for storing flush water for cleaning a toilet, is an apparatus furnished with a discharge apparatus, whereby a discharge port formed at the bottom portion of the reservoir tank is opened and closed by a float valve, multiple water passage holes are formed in the side surface of a cylindrical body disposed to surround that discharge port, and the opening cross sectional area of those water passage holes is adjusted to regulate the volume of flush water supplied to the toilet.

SUMMARY OF THE INVENTION

Technical Problem

It happens that in flush toilet bowls there are almost no cases in which toilet paper or the like are flushed after male urination, and when such toilet paper or the like is not flushed, urine can be discharged with a volume of water less than in a conventional small flush. Because of the need to save water in recent years, there is a need, in addition to conventional large and small flushes, for small flushes using an even smaller volume of water than conventional small flushes, capable of discharging urine only (referred to in this application as "eco-small flush").

In the conventional flush water tank apparatuses described above, however, because large and small flushes are carried out by either fully opening the opening formed in the cylindrical body or by closing same with a valve body, the problem arises that only two stages of flush water volume can be achieved, and the above-described recent demand for water conservation can not be met.

The current force of flush water supplied to the toilet when the level of flush water in the tank is below the opening in the cylindrical body is weak, and this is one reason for poor toilet flushes. There is also a desire, based on the need for water conservation in recent years, to reliably flush the toilet with a smaller volume of flush water.

In addition, based on the need to conserve water in recent years, there has been a demand to reduce flush water volumes respectively in both large and small flushes. There is also a desire for small flushes with an even smaller volume of flush water than in conventional small flushes. On the other hand, when an effort is made to further reduce flush water volumes in this way, flushing defects can arise due to insufficient flush water volumes in old-style toilets fitted with a flush water tank apparatus, or problems such as poor flow of waste can arise due to limitations in sewer piping on the downstream side of the toilet, there are some cases forcing an increase in the volume of flush water.

In response to such problems, the flush water tank apparatus set forth in Patent Citation 1 uses a fixed volume of flush water in the large flush and small flush modes, respectively, and cannot change the volume of flush water.

On the other hand, with the flush water tank apparatus set forth in Patent Citation 2 it is possible to change the volume of flush water by changing the opening surface area of the water passage holes formed on the side surface of the cylindrical body, but flush water flowing inward from outside the cylindrical body flows directly into the float valve which closes the discharge port, so when the current force of that inflowing flush water increases, the motion of the float valve closing the discharge port becomes unstable, leading to the problem that the desired flush water volume can not be obtained.

The present invention was undertaken to solve the above-described problems in the conventional art and satisfy the requirement in recent years for water conservation, and has the object of providing a flush water tank apparatus and water discharge apparatus capable of achieving multiple stages of flush water volumes, including at least three stages consisting of a large flush, a small flush, and an even smaller flush water volume small flush, using a simple structure.

The present invention was undertaken to solve the above-described problems with the conventional art, and has the object of providing a flush water tank apparatus and water discharge apparatus capable of achieving greater water conservation while supplying flush water to a toilet at a strong current force from the start of flush to the end of flush.

Furthermore, the present invention was undertaken to solve the above-described problems with the conventional art, and has the object of providing a flush water tank apparatus and water discharge apparatus capable of changing the volume of flush water to the toilet in each flush mode.

Solution to Problem

In order to accomplish the above-described objects, the present invention is a flush water tank apparatus for storing flush water for flushing a flush toilet, comprising a reservoir tank for storing flush water, reservoir tank having a discharge port formed on the bottom surface thereof; a discharge valve for opening and closing a discharge port to supply flush water to a flush toilet; a cylindrical body having a side surface extending in the upward direction from the bottom surface of the reservoir tank so as to surround the discharge port, the cylindrical body being opened at the top and forming an opening portion on the side surface; and a switching valve for opening and closing the opening portion on the cylindrical body to enable adjustment of the opening surface area (the opening cross-sectional area) of the opening portion on the cylindrical body so that the volume of flush water supplied from the reservoir tank discharge port to the flush toilet can be obtained in multiple stages, including at least the three stages of large, medium, and small.

The present invention thus configured has a switching valve for opening and closing the opening portion on the cylindrical body to enable adjustment of the opening surface area of the opening portion on the cylindrical body so that the volume of flush water supplied from the reservoir tank discharge port to the flush toilet can be obtained in multiple stages, including at least the three stages of large, medium, and small, therefore multiple stages of flush water volume including at least the three stages of large (large flush), medium (small flush), and small (small flush using an even smaller volume of flush water) can be effectively obtained. Furthermore, since the opening surface area of the opening portion is made adjustable using a switching valve to open and close the opening portion and thereby obtain a multistage flush, a simple tank structure can be achieved. As a result, the requirement in recent years for water conservation can be met.

In the present invention, preferably only one of the opening portion of cylindrical body is formed, and the switching valve has a first switching valve configured so as to be able to reduce the opening surface area of the opening portion of the cylindrical body, and a second switching valve, disposed on the outer side of the first switching valve and configured so as to be able to further reduce the opening surface area of the opening portion of the cylindrical body together with the first switching valve.

In the present invention thus configured, only one cylindrical body opening portion is formed, and the switching valve comprises a first switching valve configured so that the opening surface area of the cylindrical body opening portion can be reduced, and a second switching valve, disposed on the outer side of the first switching valve and capable, in conjunction with the first switching valve, of further reducing the opening surface area of the cylindrical body opening portion, and thus, using a simple structure in which one opening portion is opened and closed by two switching valves, enabling multistage flushing with at least three stages: for example, one in which the cylindrical body opening portion is fully opened to achieve a large flow volume of flush water (e.g., a conventional large flush) flowing inward from outside the cylindrical body; one in which the cylindrical body opening portion opening surface area is reduced using the first switching valve to achieve a medium flow volume of flush water flowing in from outside to inside the cylindrical body (e.g., a conventional small flush); and one in which the opening surface area of the cylindrical body opening portion is further reduced by the first switching valve and the second switching valve to achieve an even smaller flow volume of flush water flowing in from outside to inside the cylindrical body (e.g., an "eco-small flush").

In the present invention, preferably the first switching valve includes a communicating port for communicating the outside and inside of the cylindrical body when the opening portion of the cylindrical body is closed, the communication port of the first switching valve has an opening surface area smaller than the opening surface area of the opening portion of the cylindrical body, and the second switching valve is configured so as to reduce the opening surface area of the communicating port of the first switching valve when being brought into proximity with the first switching valve; wherein the first switching valve and second switching valve adjust flush water flow in at least the three stages: a large flush, whereby both the first and second switching valves are separated from the opening portion of the cylindrical body to fully open the opening portion in the cylindrical body so that the volume of water flowing into inside of the cylindrical body is large; a medium flush, wherein by closing the opening portion of the cylindrical body using the first switching valve, and separating the second switching valve from the first switching valve, the opening surface area of the opening portion of the cylindrical body is reduced to an opening surface area at least approximately the same as the opening surface area of the communication port of the first switching valve, so that the volume of water flowing from outside into inside the cylindrical body is medium; and a small flush, wherein by closing the opening portion of the cylindrical body using the first switching valve and bringing the second switching valve into proximity with the first switching valve, the opening surface area of the opening portion of the cylindrical body is made smaller than the opening surface area of the communication port of the first switching valve, so that the volume of water flowing from outside into inside the cylindrical body is small.

In the present invention thus configured, a communicating port with a smaller opening port surface area than the surface area of the cylindrical body opening portion, for effecting communication between the outside and the inside of the cylindrical body when the cylindrical body opening portion is closed, is formed on a first switching valve; a second switching valve is formed so that when brought into proximity with the first switching valve, it reduces the opening surface area of the communicating port formed on the first switching valve, so that simply by adjusting the positions of those switching valves (for the first switching valve, this is a position separated from the cylindrical body opening portion, and a position for closing the opening portion; for the second switching valve, this is a position separated from the cylindrical body opening portion, and a position closely proximate to the first switching valve), the following at least three stages of multistage flush water volumes can be easily obtained: a large flush, obtained by fully opening the cylindrical body opening portion; a medium flush, obtained by reducing the opening surface area of the cylindrical body opening portion to at least approximately the same as the opening surface area of the communicating port on the first switching valve; and a small flush, obtained by reducing the cylindrical body opening portion opening surface area to less than the first switching valve communicating port opening surface area. A multistage flush can be achieved by a simple switching valve structure consisting of a first switching valve on which a communicating port is formed, and a second switching valve, wherein the surface area of the communicating port opening thereof is reduced.

In the present invention, preferably when the first discharge valve discharges water, the first discharge valve, when being set to close the opening portion of the cylindrical body, is preferably held in a state in which the opening portion of the cylindrical body is closed by the pressure differential caused by the flush water flow speed differential between the outside and inside of the cylindrical body.

In the present invention thus configured, during discharge of water the first switching valve is held in a state in which the cylindrical body opening portion is closed by the pressure differential caused by the flush water flow speed differential between the outside and inside of the cylindrical body, thus obviating the need to hold it using an electrical device such as a motor, and a multistage flush can be achieved using a simple structure.

The present invention preferably further comprises an electrical drive apparatus for holding the second switching valve at a position proximate to the first switching valve from the start of water discharge to the end of water discharge.

The present invention thus configured has an electrical drive apparatus, positioned on the outer side of the first switching valve, for holding the second switching valve, which is difficult to hold using the pressure differential between the inside and outside of the cylindrical body, at a position proximate to the first switching valve, from the start of water discharge to the end of water discharge; therefore the state in which the opening surface area of the first switching valve communicating port is reduced can be more reliably maintained, so that multistage flushing can be more reliably achieved.

In the present invention, preferably the second switching valve preferably has a protruding portion extending to the first switching valve side and capable of being inserted into the first switching communicating port valve when brought into proximity of the first switching valve.

In the present invention thus configured, it is not necessary to bring the second switching valve into close proximity with the first switching valve in order to reduce the opening surface area of the first switching valve communicating port, and the opening surface area of the first switching valve communicating port can be reduced by the insertion of the protruding portion of the second switching valve into the communicating port of the first switching valve, even if it has been brought into a proximate state. Therefore the imparting of large tensions to ball chains or the like caused by bringing the second switching valve into close proximity with the first switching valve (close proximity requires the positions to be approximately fixed) due to assembly tolerances or the like in the ball chain linking to the electrical drive apparatus can be suppressed, and breaks in the ball chain, etc. can be prevented from occurring.

In the present invention, preferably the discharge valve preferably has: a valve body for opening and closing the discharge port; a control cylinder furnished with a reservoir portion having a small hole formed for storing flush water and discharging a predetermined small flow volume of the stored flush water; and a float disposed within the reservoir portion so as to drop as the water level within the reservoir portion drops; wherein the discharge valve is configured so that the valve body drops in tandem with the dropping of the float, closing the discharge port.

In the present invention thus configured, the discharge valve carries out the valve closing action using the drop in stored flush water in the reservoir portion of the control cylinder, therefore a structure in which no effect is imparted on the valve closing action is achieved even if the opening surface area of the cylindrical body is adjusted so that the volume of flush water flowing from the outside to the inside of the cylindrical body changes; as a result, multistage flushing can be more reliably obtained.

The present invention is a water discharge apparatus furnished with a discharge valve for opening and closing the discharge port of a reservoir tank for storing flush water to supply flush water to a toilet, comprising: a cylindrical body having a side surface extending upward from the bottom surface of the reservoir tank so as to surround the discharge port, the cylindrical body being opened at the top, and forming an opening portion on the side surface; and a switching valve for opening and closing the opening portion on the cylindrical body to enable adjustment of the opening surface area of the opening portion on the cylindrical body so that the volume of flush water supplied from the reservoir tank discharge port to the flush toilet can be obtained in multiple stages, including at least the three stages of large, medium, and small.

The present invention thus configured has a switching valve for opening and closing the opening portion on the cylindrical body to enable adjustment of the opening surface area of the opening portion on the cylindrical body so that the volume of flush water supplied from the reservoir tank discharge port to the flush toilet can be obtained in multiple stages, including at least the three stages of large, medium, and small; therefore multiple stages of flush water volume including at least the three stages of large (large flush), medium (small flush), and small (small flush using an even smaller volume of flush water) can be effectively obtained. Furthermore, since the opening surface area of the opening portion is made adjustable using a switching valve to open and close the opening portion and thereby obtain a multistage flush, a simple tank structure can be achieved. As a result, the requirement in recent years for water conservation can be met.

In order to accomplish the above-described objects, the present invention is a flush water tank apparatus for storing flush water for flushing a flush toilet, comprising a reservoir tank for storing flush water, the reservoir tank having a discharge port on the bottom surface thereof; a discharge valve for opening and closing the discharge port and supplying flush water to a flush toilet; a cylindrical body having a side surface extending vertically upward from the bottom surface of the reservoir tank so as to surround the discharge port; the cylindrical body being opened at the top and forming an opening portion on the side surface; and a switching valve for opening and closing the opening portion; wherein the water level outside the cylindrical body immediately after the discharge valve closes the discharge port is positioned vertically above the cylindrical body opening portion.

In the present invention thus configured, the water level on the outside of the cylindrical body immediately following the closing of the discharge port by the discharge valve is positioned vertically above the opening portion of the cylindrical body, therefore flush water flowing into the opening portion of the cylindrical body has a high head pressure, and can achieve a strong current force. Therefore flush water at a strong current force can be supplied to the toilet until discharge is complete. As a result, flushing can be reliably performed using a smaller flush water volume, and even further water conservation can be achieved.

In the present invention, preferably the discharge valve has a control cylinder disposed on the inside of the cylindrical body, a float disposed inside the control cylinder, a valve body configured to drop in tandem with the dropping of the float, closing off the discharge port, and a valve body drop motion control device disposed on the control cylinder for controlling the dropping motion of the cylindrical body, wherein the valve body drop motion control device is disposed on the opposite side of the opening portion of the cylindrical body.

In the present invention thus configured, the valve body drop motion control device is disposed on the opposite side of the cylindrical body opening, therefore the valve body drop motion control device suppresses the effects of strong current force flush water flowing into the cylindrical body via the opening portion from outside the cylindrical body, and the valve body drop motion can be stabilized. Therefore the valve body valve closing timing is also stabilized, and water conservation can be more reliably achieved.

In the present invention, the valve body drop motion control device is preferably disposed on the side surface of the control cylinder.

In the present invention thus configured, the valve body drop motion control device is disposed on the side surface of the control cylinder, making it less susceptible to the effects of strong current force flush water flowing into the inside of the cylindrical body from the opening portion, and the dropping motion of the valve body can be more reliably stabilized.

In addition, the present invention is also a flush toilet furnished with the aforementioned flush water tank apparatus.

The present invention thus configured provides a flush toilet for achieving water conservation. In particular, when the flush toilet is a wash-down type of toilet, flush water with current force is provided from the start to the end of the flush, so that the flushing effect is more reliably achieved.

Furthermore, the present invention is a water discharge apparatus furnished with a discharge valve for opening and closing a discharge port on a reservoir tank for storing flush water and supplying flush water to a toilet, comprising a cylindrical body having a side surface extending vertically upward from the bottom surface of the reservoir tank so as to surround the discharge port, the cylindrical body being opened at the top, and forming an opening portion on the side surface; a switching valve for opening and closing the opening portion; a control cylinder disposed inside the cylindrical body; a float disposed inside the control cylinder; a valve body configured to drop in tandem with the dropping of this float, thereby closing the discharge port; and a valve body drop motion control device disposed on the control cylinder for controlling the dropping motion of the valve body, whereby the valve body drop motion control device is disposed on the opposite side of the opening portion of the cylindrical body.

In the present invention thus configured, the valve body drop motion control device is disposed on the opposite side of the cylindrical body opening, therefore the valve body drop motion control device suppresses the effects of strong current force flush water flowing into the cylindrical body via the opening portion from outside the cylindrical body, and the valve body drop motion can be stabilized. Therefore valve body valve closing timing is also stabilized, and water conservation can be more reliably achieved.

In order to achieve the above-described object, the present invention is a flush water tank apparatus for storing flush water for flushing a toilet, comprising a reservoir tank for storing flush water, the reservoir tank having a discharge port on the bottom surface thereof; a cylindrical body having a side surface extending upward from the bottom surface of the reservoir tank so as to surround the discharge port, being opened at the top, and forming an opening portion on the side surface thereof; a switching valve for opening and closing the opening portion formed on this cylindrical body; a control cylinder, disposed on the inside of the cylindrical body and furnished with a reservoir portion for storing flush water; a float disposed inside the reservoir portion so as to be capable of moving up and down in accordance with the water level inside the reservoir portion; a discharge valve, configured to drop in tandem with the dropping of the float accompanying the drop in water level within the reservoir cylinder due to the outflow of flush water in the reservoir portion of the control cylinder, closing the discharge port; and an adjusting member formed on the reservoir portion of the control cylinder, for adjusting the opening surface area of the outflow port which causes flush water in the reservoir portion to flow out.

In the present invention thus configured, the discharge valve is configured to drop in tandem with the dropping of the float accompanying the drop in the water level within the reservoir cylinder caused by the outflow of flush water inside the reservoir portion which closes the discharge port, and the dropping speed of that flush water level in the reservoir portion can be adjusted by adjusting the flow volume at which flush water inside the reservoir portion is allowed to flow out, using a flow adjusting member, therefore the speed of the drop in water level inside the reservoir cylinder and the speed of the float drop can be changed. Therefore the valve closing timing of the discharge valve, which drops in tandem with the float and closes the discharge port, can also be changed. As a result, the volume of flush water supplied to the toilet can be changed in each of the flush modes. Also, by changing the speed at which the discharge valve drops in tandem with the drop in the water level in the reservoir portion, the present invention adjusts the valve closing timing; since the float and discharge valve are disposed further inside the control cylinder, which itself is disposed inside the cylindrical body, effects of flush water flowing in from the opening portion formed on the cylindrical body can be suppressed, the operation of the discharge valve can be stabilized, and desired volumes of flush water can be more reliably obtained. Moreover, the speed at which the water level inside the reservoir cylinder drops, and the speed at which the float drops, can be more reliably changed, such that the valve closing timing of the discharge valve, which drops in tandem with the float and closes the discharge port, can also be more reliably changed. As a result, in each of the flush modes the volume of flush water supplied to the toilet can be more reliably changed.

In the present invention, the reservoir portion outflow port is preferably formed on the opposite side surface of the reservoir portion relative to the opening portion of the cylindrical body.

In the present invention thus configured, the outflow port is formed on the opposite side surface of the reservoir portion relative to the opening portion formed on the cylindrical body, therefore effects of flush water flowing into the cylindrical body from the opening portion of the cylindrical body can be suppressed and flow volumes of flush water flowing out from the outflow port of the reservoir cylinder can be stabilized, with the result that operation of the discharge valve can be stabilized.

In the present invention, the adjusting member preferably slides relative to the outflow port to adjust the opening surface area of the outflow port.

In the present invention thus configured, the timing at which the discharge valve is closed can be changed using a simple structure.

In the present invention, at least two outflow ports are preferably formed in the reservoir portion, and the adjusting member is a switching member for switching so that one of the two at least opening portions is always open, and the remaining outflow port is opened and closed in stages according to the desired flush water volume.

In the present invention thus configured, in each of the flush modes at least two levels of flush water volume can be obtained.

In the present invention, at least two outflow ports are preferably formed in the reservoir portion, and the adjusting member is a switching member installed so that only one outflow port of the two outflow ports is opened and closed. In the present invention thus configured, two outflow ports are kept in a constant open state by the adjusting member, and the reservoir cylinder interior water level drop speed and the float drop speed are increased so that the closing timing of the discharge valve is also sped up, flush water volumes are reduced, and the demand in recent years for water conservation is met, while on the hand in cases where the desired flush water volume is greater than in such cases, the timing at which the discharge valve closes is delayed by using the adjusting member to reduce the number of outflow ports to 1; by further delaying the reservoir cylinder interior water level drop speed and the float drop speed, the discharge valve closing timing is further delayed, and the volume of flush water can be increased by the amount of delay to the valve closing timing.

The present invention is a water discharge apparatus furnished with a discharge valve for opening and closing a discharge port on a reservoir tank for storing flush water to supply flush water to a toilet, comprising: a cylindrical body having a side surface extending upward from the bottom surface of the reservoir tank so as to surround the discharge port, the cylindrical body being opened at the top thereof, and forming an opening portion on the side surface; a switching valve for opening and closing the opening portion formed on this cylindrical body; a control cylinder, disposed on the inside of the cylindrical body and furnished with a reservoir portion for storing flush water; a float disposed inside the reservoir portion so as to be capable of moving up and down in accordance with the flush water level inside the reservoir portion; the discharge valve, configured to drop in tandem with the dropping of the float accompanying the drop in water level within the reservoir cylinder due to the outflow of flush water in the reservoir portion of the control cylinder, closing the discharge port; and an adjusting member formed on the reservoir portion of the control cylinder, for adjusting the opening surface area of the outflow port which causes flush water in the reservoir portion to flow out.

In the present invention thus configured, the discharge valve is configured to drop in tandem with the dropping of the float accompanying the drop in the water level within the reservoir cylinder caused by the outflow of flush water inside the reservoir portion which closes the discharge port, and the dropping speed of that flush water level in the reservoir portion can be adjusted by adjusting the flow volume at which flush water inside the reservoir portion is allowed to flow out, using a flow adjusting member, therefore the speed of the drop in water level inside the reservoir cylinder and the speed of the float drop can be changed. Hence the valve closing timing of the discharge valve, which drops in tandem with the float and closes the discharge port, can also be changed. As a result, in each of the flush modes the volume of flush water supplied to the toilet can be changed. Also, by changing the speed at which the discharge valve drops in tandem with the drop in the water level in the reservoir portion, the present invention adjusts the valve closing timing; since the float and discharge valve are disposed further inside the control cylinder, which itself is disposed inside the cylindrical body, effects of flush water flowing in from the opening portion formed on the cylindrical body can be suppressed, the operation of the discharge valve can be stabilized, and desired volumes of flush water can be more reliably obtained. Moreover, the speed at which the water level inside the reservoir cylinder drops, and the speed at which the float drops, can be more reliably changed, such that the valve closing timing of the discharge valve which drops in tandem with the float and closes the discharge port, can also be more reliably changed. As a result, in each of the flush modes the volume of flush water supplied to the toilet can be more reliably changed.

Advantageous Effects of the Invention

According to the flush water tank apparatus and water discharge apparatus of the present invention, multistage flush water volumes can be achieved, including at least three stages comprising large and small flushes, as well as a small flush using an even smaller flush water volume.

Also, according to the flush water tank apparatus and water discharge apparatus of the present invention, greater water conservation can be achieved while supplying flush water at a strong current force from the start of flush to the end of flush.

Moreover, according to the flush water tank apparatus and water discharge apparatus of the present invention, the volume of flush water to the toilet in each flush mode can be changed.

DESCRIPTION OF EMBODIMENTS

Next, referring to the attached figures, the flush water tank apparatus according to a first embodiment of the present invention will be explained.

Figure 1:
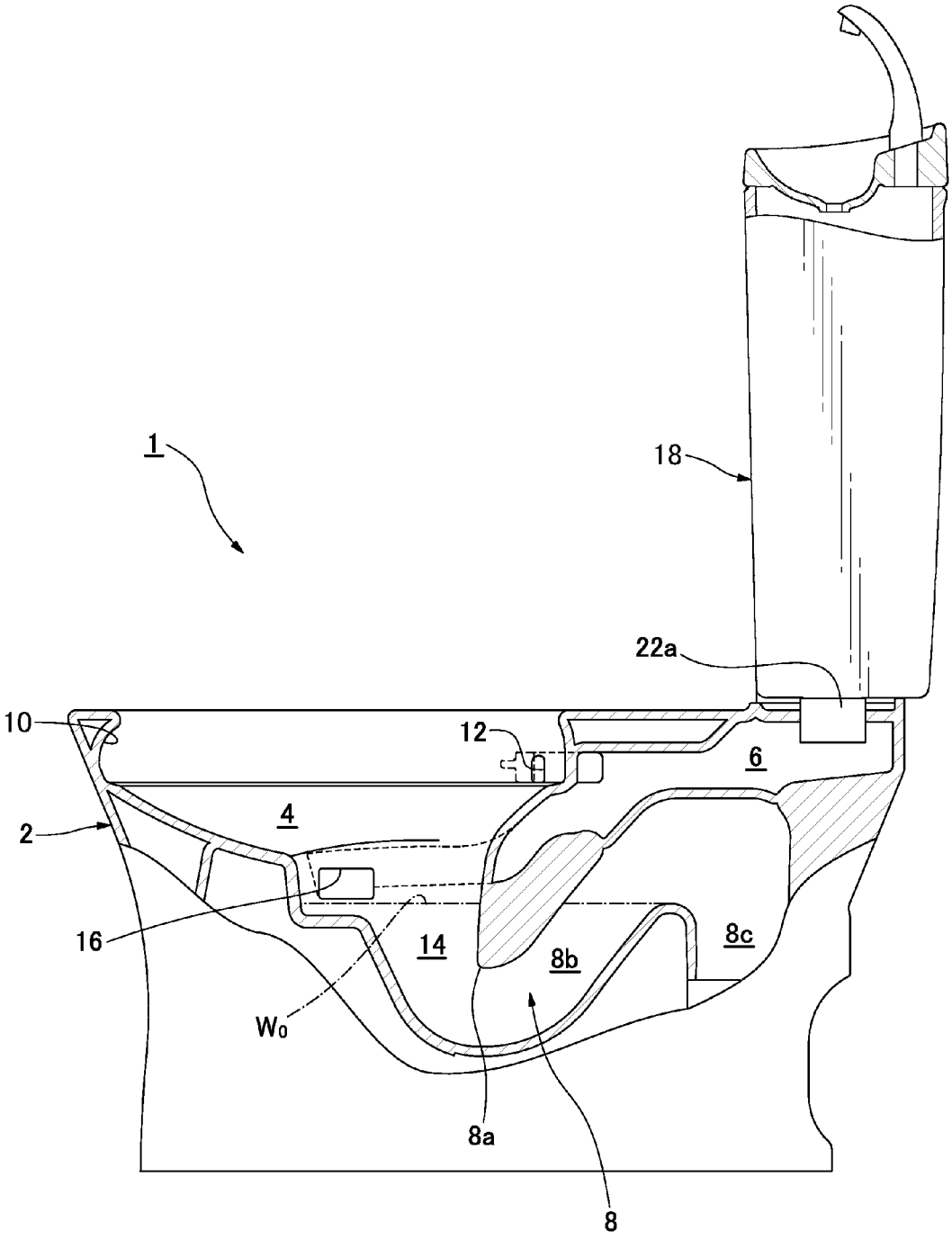
FIG. 1 is a sectional view of a flush toilet to which the flush water tank apparatus of the first embodiment of the present invention is applied.

First, referring to FIG. 1, a flush toilet, to which the flush water tank apparatus of the first embodiment of the present invention is applied, will be explained. FIG. 1 is a sectional view of a flush toilet to which the flush water tank apparatus of the first embodiment of the present invention is applied.

As shown in FIG. 1, reference numeral 1 indicates a wash-down type of flush toilet; this flush toilet 1 is furnished with a toilet main unit 2, and respectively formed on this toilet main unit 2 are a bowl portion 4, a water conducting path 6, and a trap conduit 8 communicating with the bottom portion of the bowl portion 4. Formed on the top edge portion of the toilet main unit 2 bowl portion 4 are a rim 10 having an inwardly overhanging shape and a first water spout port 12 for spouting flush water supplied from the water conducting path 6; flush water spouted from this first water spout port 12 descends as it circulates, washing the bowl portion.

Formed at the bottom of the bowl portion 4 is a water accumulating portion 14 on which a storage surface $W_0$ is shown by a dot-and-dash line. An intake 8*a* of the discharge trap conduit 8 is opened at the bottom of the water accumulating portion 14; a rising path 8*b* extends rearward from this intake 8*a*. A dropping path 8*c* is connected to this rising path 8*b*, and the bottom end of the dropping path 8*c* connects to a discharge pipe (not shown) in the floor through a discharge socket (not shown). Formed at the top position of the storage surface $W_0$ in the bowl portion 4 is a second water spout port 16 for spouting flush water supplied from the water conducting path 6; flush water spouted from this second water spout port 16 generates a circulating flow causing the accumulated water in the water accumulating portion 14 to circulate in the up and down direction.

A flush water tank apparatus 18 for storing flush water supplied to the toilet main unit 2 is disposed above the water conducting path 6 of the toilet main unit 2. As will be described below, a discharge port 22*a* communicating with the toilet main unit 2 water conducting path 6 is formed at the bottom portion of the flush water tank apparatus 18 spout port 22, and flush water in the spout port 22 is discharged to the water conducting path 6.

Figure 2:
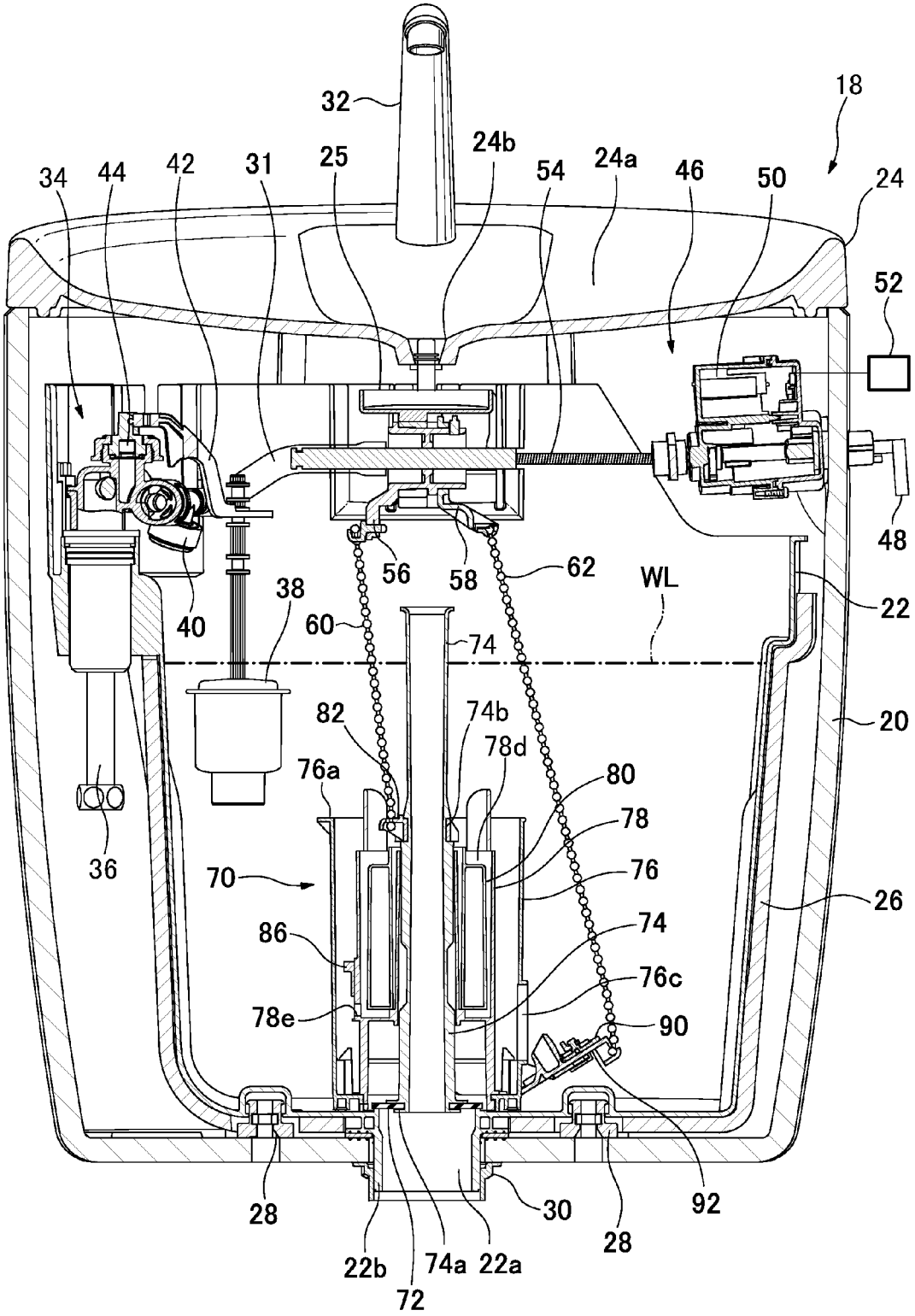
FIG. 2 is a front elevation sectional view showing the outline structure of a flush water tank apparatus according to a first embodiment of the present invention.

Next, referring to FIG. 2, a summary configuration of the flush water tank apparatus 18 is explained. FIG. 2 is a front elevation sectional view showing the outline structure of a flush water tank apparatus according to a first embodiment of the present invention. Note that the flush water tank apparatus according to the present embodiment can also be applied to other types of flush toilets besides the above-described wash-down type (e.g., siphon-type flush toilets, etc.).

As shown in FIG. 2, the flush water tank apparatus 18 is furnished with a ceramic exterior tank 20, a reservoir tank 22 disposed on the inside thereof, in which flush water is stored, and a lid body 24 placed on top of the exterior tank 20.

A thermal insulating body 26 is disposed to surround the reservoir tank 22 and, interposed by the thermal insulating body 26, the reservoir tank 22 is attached to the exterior tank 20 using a predetermined fitting member 28. A discharge port 22*a* communicating with the above-described toilet main unit water conducting path 6 is formed on the bottom surface of the reservoir tank 22. The reservoir tank 22 can also be attached to the exterior tank 20 by affixing a water discharge port member 22*b* extending to the side surface of the discharge port 22*a*, using a predetermined engaging member 30.

Disposed on the lid body 24 is a hand-washing tap 32 for spouting water on a wash basin 24*a* formed in the lid body 24 for washing hands. Water in the wash basin 24*a* spouted from the hand washing tap 32 flows into the reservoir tank 22 by means of a spouting port (inflow port) formed on the wash basin 24*a*.

A water conduit member 25 for conducting water flowing in from the water spouting port 24*b* to outside a control cylinder 78 on a water discharge apparatus 70, described below, is disposed underneath the lid body 24.

Next, the flush water tank apparatus 18 is furnished with a flush water supply apparatus 34. The flush water supply apparatus 34 is the same as in the past; it is furnished with a water supply pipe 36 connected to a water supply source (not shown) such as an external water pipe or the like; a water supply apparatus float 38, an overflow pipe 40 communicating with the water supply pipe 36 for spouting flush water to the reservoir tank 22, a water supply valve 44 connected to the water supply apparatus float 38 via an operating lever 42, and the like.

In the present embodiment, by using this flush water supply apparatus 34, the supply of water starts after a predetermined time from the start of water discharge. In the present embodiment, the stop water level when the reservoir tank 22 is filled is set to be fixed at the position (WL) shown in FIG. 2.

The flush water supply apparatus 34 is furnished with a hand washing water supply pipe 31 for supplying water to the hand washing tap 32, and supplying of water to above-described the lid body 24 hand washing tap 32 is started at the beginning of the supply of flush water to the toilet (the start of water discharge).

Next, the flush water tank apparatus 18 is furnished with an operating apparatus 46 and a water discharge apparatus 70 activated by operating this operating apparatus 46.

The operating apparatus 46 will be firstly explained.

The operating apparatus 46 is furnished with an operating lever 48, a motor 50, and an operating button 52 (shown only in FIG. 2) connected to this motor 50. The operating button 52 is furnished with three operating buttons for the large flush, small flush, and eco-small flush described below.

The operating lever 48 is a manually operated lever for activating the water discharge apparatus 70, which when rotated (90°) in one direction (toward the front in this embodiment) starts a large flush, described below, and when rotated) (90°) in the other direction (toward the back in this embodiment), starts a small flush, described below. The motor 50 rotates in the same direction as the operating lever 48 (toward the front) when the large flush button is pushed, and rotates in the same direction (toward the back) as the operating lever 48 when the small flush button is pushed, activating the water discharge apparatus 70 so that the large flush and the small flush are respectively started. Thus in the present embodiment a user may, for the large flush and small flush, either operate the operating lever 48 or push the operating button 52. With respect to the eco-small flush, the water discharge apparatus 70 is activated by the motor 50 alone, i.e., by a user pushing a button.

A rotary transmission member 54 comprising a wire member, a universal joint, and the like is linked to this operating lever 48 and motor 50. Attached at the other end of this rotary transmission member 54 are a first lifting member 56 and a second lifting member 58 oscillating about the rotary transmission member 54 with its rotation; the top end part of the first bead chain 60 and the top end part of the second bead chain 62 are respectively attached to tip portions of the first lifting member 56 and the second lifting member 58.

The first lifting member 56 and second lifting member 58 are a mechanical structure whereby when rotary transmission member 54 is rotated to one side (for a large flush), only the first lifting member 56 oscillates on that one side, lifting only the first bead chain 60; when the rotary transmission member 54 is rotated on the other side (for a small flush or an eco-small flush) both the first lifting member 56 and second lifting member 58 oscillate on that other side, lifting both the first bead chain 60 and the second bead chain 62.

Next, referring to FIGS. 2 through 5, a water discharge apparatus 70 is explained.

Figure 3:
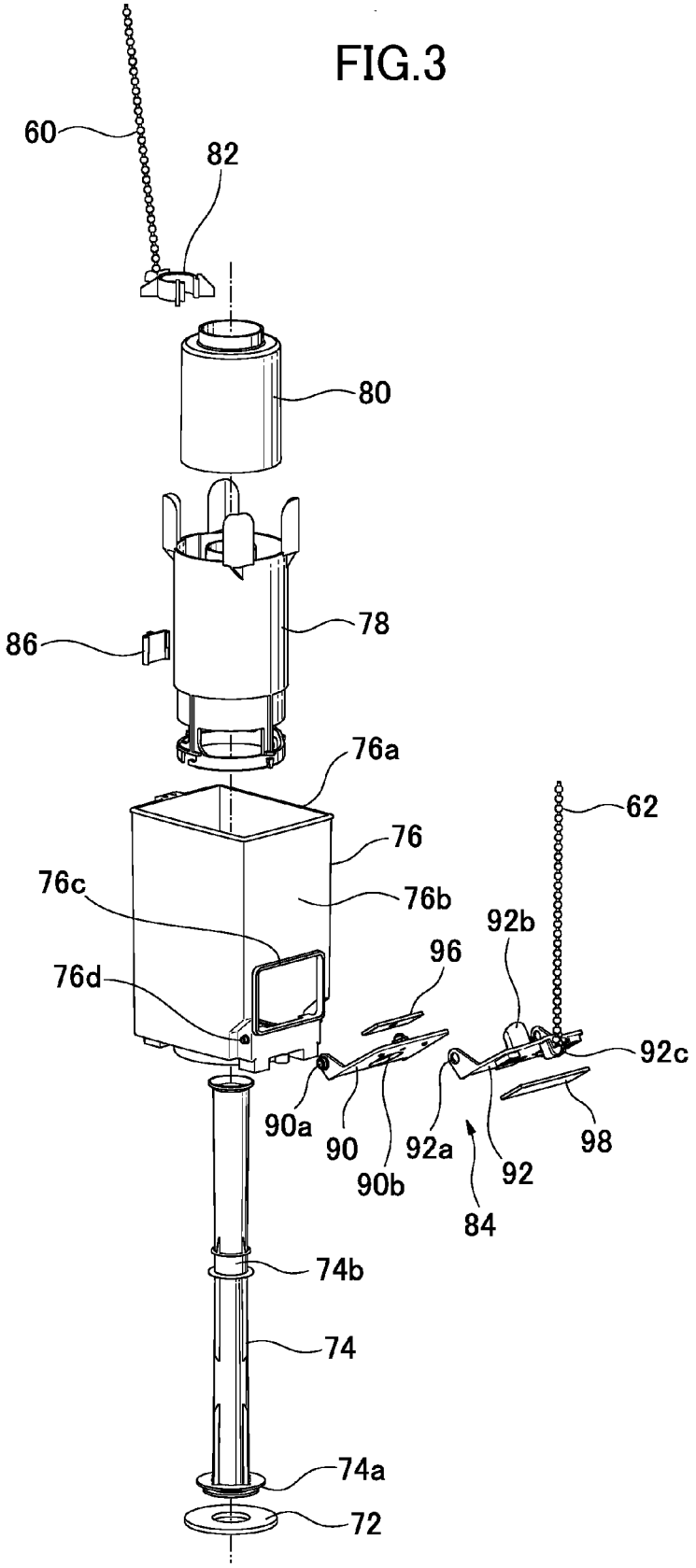
FIG. 3 is an exploded perspective view of the water discharge apparatus in a flush water tank apparatus according to a first embodiment of the present invention.
Figure 4:
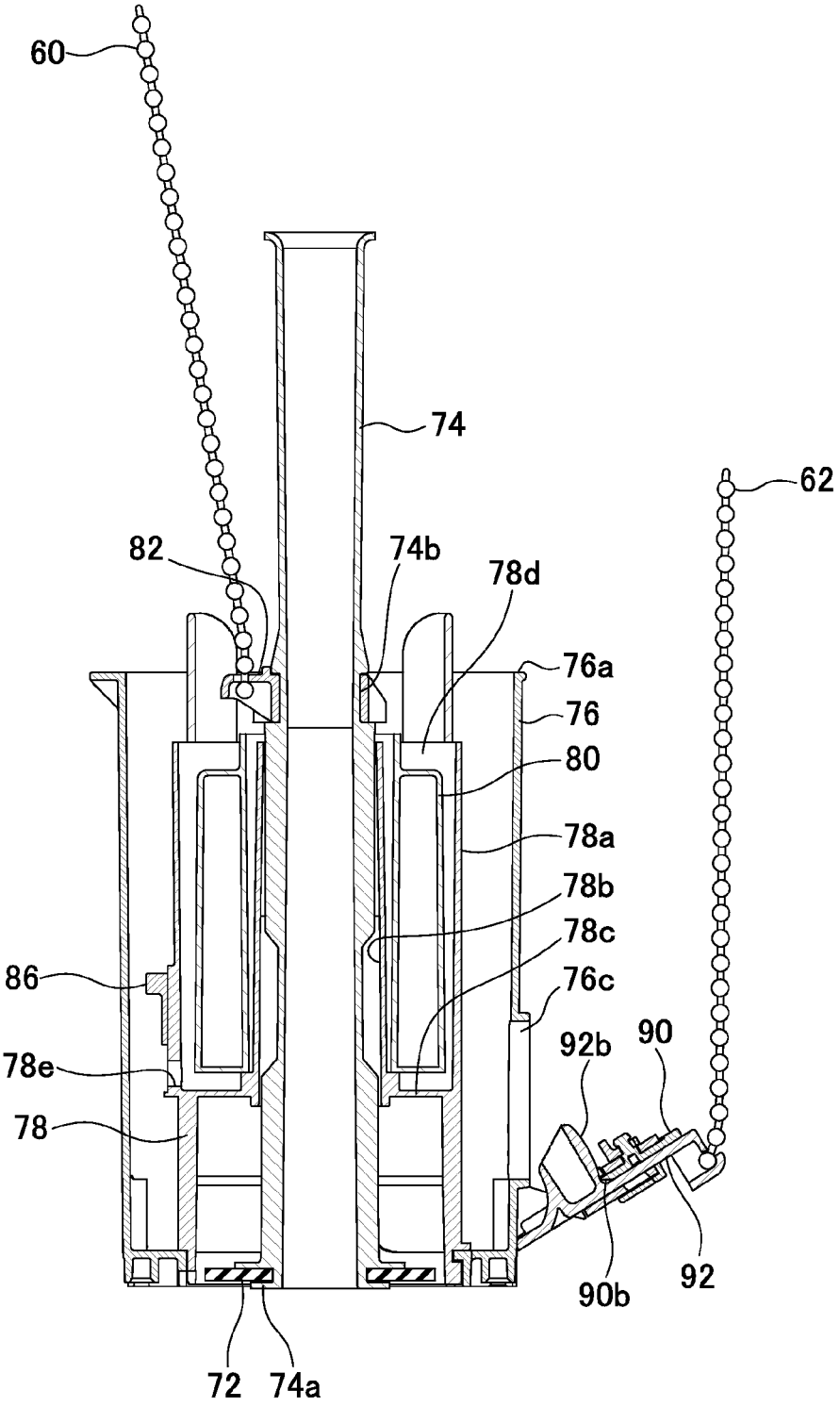
FIG. 4 is a sectional view of the water discharge apparatus in a flush water tank apparatus according to a first embodiment of the present invention.
Figure 5:
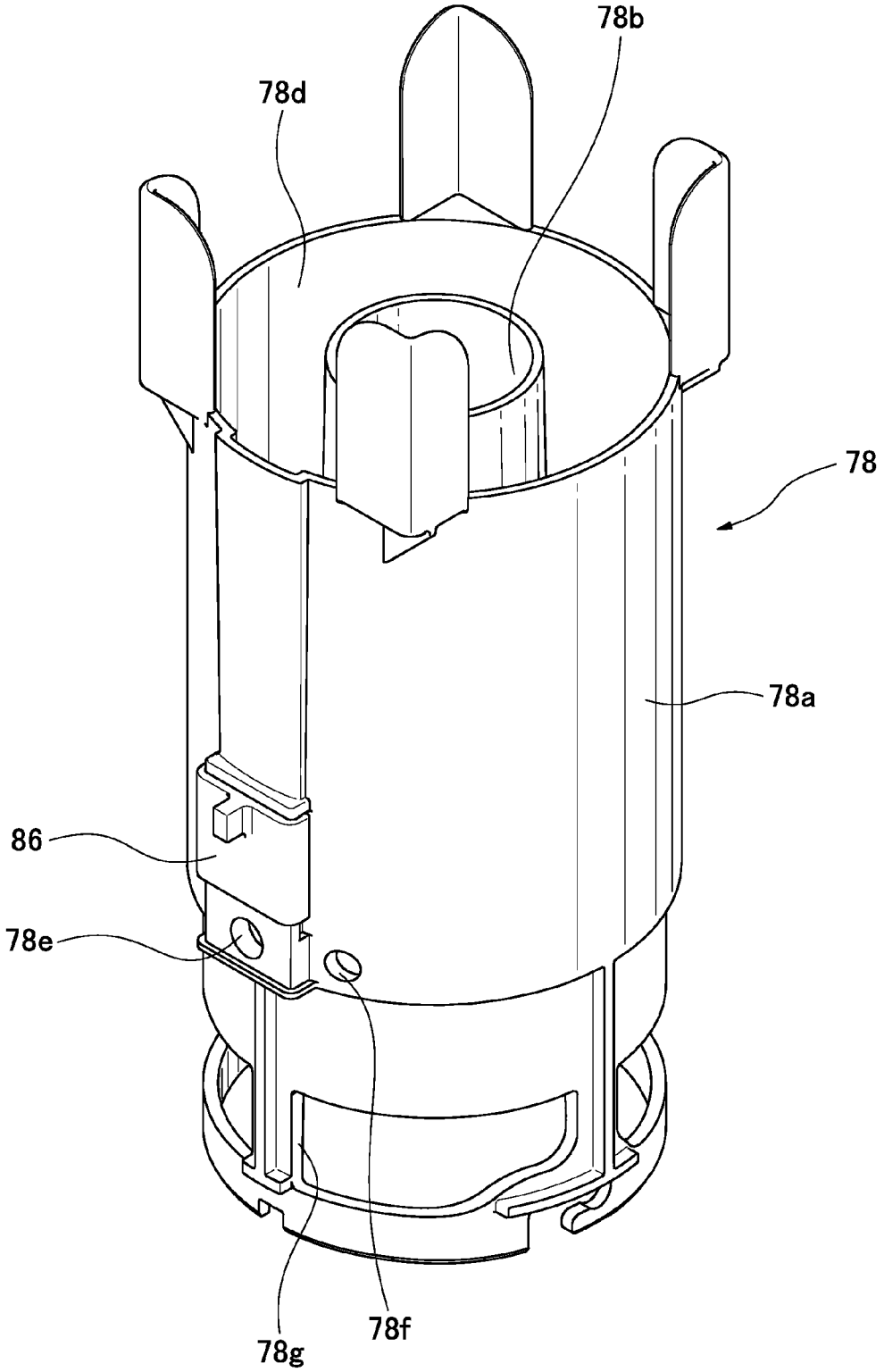
FIG. 5 is a perspective view of the control cylinder of the water discharge apparatus in a flush water tank apparatus according to a first embodiment of the present invention.
Figure 6:
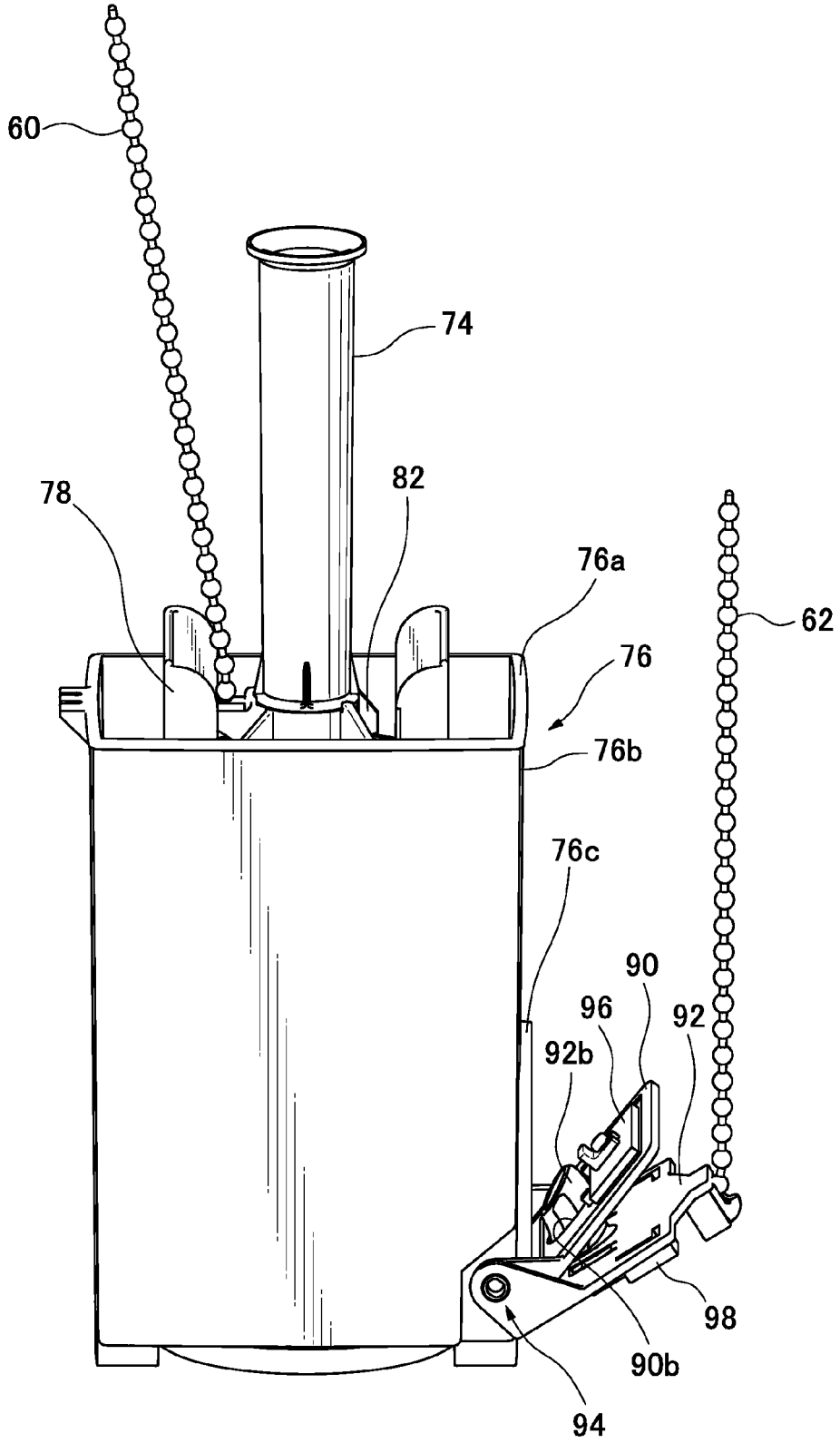
FIG. 6 is a perspective view of the water discharge apparatus in a flush water tank apparatus according to a first embodiment of the present invention.

FIG. 3 is an exploded perspective view of the water discharge apparatus in a flush water tank apparatus according to a first embodiment of the present invention; FIG. 4 is a sectional view of the water discharge apparatus in a flush water tank apparatus according to a first embodiment of the present invention; FIG. 5 is a perspective view of the control cylinder of the water discharge apparatus in a flush water tank apparatus according to a first embodiment of the present invention; FIG. 6 is a perspective view of the water discharge apparatus in a flush water tank apparatus according to a first embodiment of the present invention.

First, as shown in FIG. 3, the water discharge apparatus 70 of the flush water tank apparatus according to the present embodiment has a valve body 72, an overflow pipe 74, a cylindrical body 76, a control cylinder 78, a float 80, an affixing member 82 affixed to the overflow pipe, and a switching valve 84 (90, 92) for opening and closing the opening portion 76*c*, described below, which is formed on the cylindrical body 76.

First, referring to FIGS. 2 through 6, the water discharge valve mechanism, with which the water discharge apparatus 70 is equipped, is explained.

First, as shown in FIGS. 2 through 4, the valve body 72 is inserted onto a U-channeled valve body holding portion 74*a* formed at the bottom end portion of the overflow pipe 74, and moves up and down with the overflow pipe 74, functioning as a discharge valve to open and close discharge port 22*a*. Formed at a vertically intermediate portion on the side surface of the overflow pipe 74 so as to extend around the perimeter thereof is an indentation 74*b* for holding the affixing member 82.

Next, as shown in FIGS. 4 and 5, an approximately cylindrical outside wall 78*a*, and an inside wall 78*b* with the role of guiding the up-down motion of the overflow pipe 74, are formed on the control cylinder 78. As shown in FIG. 4, an intermediate horizontal wall 78*c*, which together with these side walls 78*a* and 78*b* enables the storing of flush water, is formed on the control cylinder 78; these side walls 78*a* and 78*b*, and the intermediate horizontal wall 78*c*, together constitute a reservoir cylinder (reservoir portion) 78*d*.

In addition, two small holes 78*e*, 78*f* are formed on the outside wall 78*a* of the reservoir cylinder 78*d* to allow the outflow of a predetermined flow volume of flush water stored in the reservoir cylinder 78*d*. One of the small holes 78*e* can be slid open and closed using a slide member (switching member) 86, and the flow volume of flush water allowed to flow out from inside the reservoir cylinder 78*d* can thus be adjusted.

An inflow port 78*g* for allowing inflow of flush water outside the control cylinder 78 to the discharge port 22*a* during water discharge is formed below the reservoir cylinder 78*d* on the outside wall 78*a* of the control cylinder 78.

Next, as shown in FIG. 4, a float 80 is disposed inside the above-described reservoir cylinder 78*d*. Above the float 80, an affixing member 82 is inserted from the side into the indentation 74*b* of the above-described overflow pipe 74. The affixing member 82 has a predetermined function, by the affixing member 82 being attached so as to be able to rotate in a horizontal direction relative to the overflow pipe 74, and being affixed so as not to be able to move up and down relative to the overflow pipe 74.

First, the bottom end part of the first bead chain 60, attached to the above-described first lifting member 56, is attached to the affixing member 82; during water discharge, this is used to lift the overflow pipe 74. When a user rotates the operating lever 48 or the motor 50 is activated by pushing the flush water button, the first bead chain 60 is lifted, but at that point the overflow pipe 74 valve body 72 is pressed in the vertically downward direction by the head pressure of flush water stored in the reservoir tank 22, such that the affixing member 82 first rotates in the horizontal direction relative to the overflow pipe 74, and thereafter the overflow pipe 74 moves in the vertically upward direction.

With a structure of this type, movement by the overflow pipe 74 in the vertically upward direction as it rotates can be prevented, and the valve opening action of the water discharge apparatus 70 can be stabilized.

Next, the affixing member 82 functions as a stopper to suppress rising of the float 80 when the tank is full of water; during water discharge, as described below, it has the function of connecting the overflow pipe 74 and the float 80 so that overflow pipe 74 and valve body 72 move in tandem with the drop of the float 80. The affixing member 82 is formed in a shape and size such that it can sufficiently contact the top surface of the float 80 in order to have these functions. Here the buoyancy of the float 80 is set so that when full of water, that buoyancy does not cause the overflow pipe 74 and the valve body 72 to rise due to the water pressure acting on the valve body 72, and so that buoyancy is slightly larger than the downward force acting on the overflow pipe 74 and the valve body 72 during water discharge. Note that the float 80 and the overflow pipe 74 may also be mutually affixed so as to be connected at all times.

Next, referring to FIGS. 2 through 4 and FIG. 6, the flow adjustment mechanism configured by cylindrical body 76 and slide member 86, etc is explained.

First, as shown in FIGS. 3 and 6, the cylindrical body 76 is formed to have an approximately rectangular shape in cross section, with four sides of top edge portions 76*a*, and is open at the top. Of the four side surfaces of the rectangularly-formed cylindrical body 76, only one opening portion 76*c* is formed, on only one side surface 76*b*, of the four side surfaces of the cylindrical body 76. The opening portion 76*c* is formed as a rectangle.

With the opening portion 76*c* serving as a switching valve 84 capable of opening and closing, a first switching valve 90, and a second switching valve 92 disposed on the outside of the first switching valve 90, are provided as shown in FIGS. 3, 4 and 6.

As shown in FIG. 3, the cylindrical body 76 is furnished with shafts 76*d* at both sides on the bottom side portions of the opening portion 76*c*; the first switching valve 90 is furnished with receiving portions 90*a* engaged so as to be oscillated by those shafts 76*d*, and hole portions 92*a* are formed on the second switching valve 92, engaged to the receiving portions 90*a* so as to oscillate freely. As shown in FIG. 6, shaft bodies 94 are configured by shafts 76*d*, receiving portions 90*a*, and hole portions 92*a* when the first switching valve 90 and the second switching valve 92 are attached to the cylindrical body 76.

Therefore by virtue of the shaft body 94, the first switching valve 90 is able to oscillate about the shaft body 94 from a lower position to the position at which the opening portion 76*c* is closed, and the second switching valve 92 is able to oscillate from a lower position to the position adjacent to the first switching valve 90 on which the opening portion 76*c* is closed.

Next, as shown in FIGS. 3, 4, and 6, a communicating port 90*b* is formed on the first switching valve 90, for effecting communication between the outside and inside of the cylindrical body 76 when the first switching valve 90 closes the opening portion 76*c*. The opening surface area of this communicating port 90*b* is smaller than the opening surface area of the opening portion 76*c*, and the size thereof is formed so that the flow volume of flush water is smaller by a predetermined volume than when the opening portion 76*c* is fully open. In this manner, the first switching valve 90 is able to adjust (reduce) the opening surface area of the cylindrical body 76 opening portion 76*c*.

Next, a raised portion 92*b* protruding toward the first switching valve 90 side is formed on the second switching valve 92. This raised portion 92*b* is formed at a position and angle such that it can be inserted into the first switching valve communicating port 90*b* when the second switching valve 92 is brought into proximity or adjacency with the first switching valve 90.

Attached to this second switching valve 92 at the tip position on the opposite side of the above-described shaft body 94 is the bottom end part of the second bead chain 62, which is attached to the above-described second lifting member 58. A weight 96 is attached to the first switching valve 90, and a weight 98 is attached to the second switching valve 92.

As shown in FIGS. 2 through 4, a control cylinder 78 is attached to the inside of the cylindrical body 76; as shown in FIG. 2, the cylindrical body 76 and control cylinder 78 are attached to the bottom portion of the reservoir tank 22 so as to surround the discharge port 22*a*, thus enabling the overflow pipe 74 to move up and down, so that the valve body 72 opens and closes the discharge port 22*a*.

At this point, as shown in FIGS. 2 and 4, the control cylinder 78 and cylindrical body 76 are respectively attached so that the small holes 78*e*, 78*f* formed on the outside wall 78*a* of the control cylinder 78 reservoir cylinder (reservoir portion) 78*d* are positioned on the opposite side of the opening portion 76*c* formed on the cylindrical body 76.

Next the motion of the flush water tank apparatus according to a first embodiment of the present invention will be explained.

Figure 7:
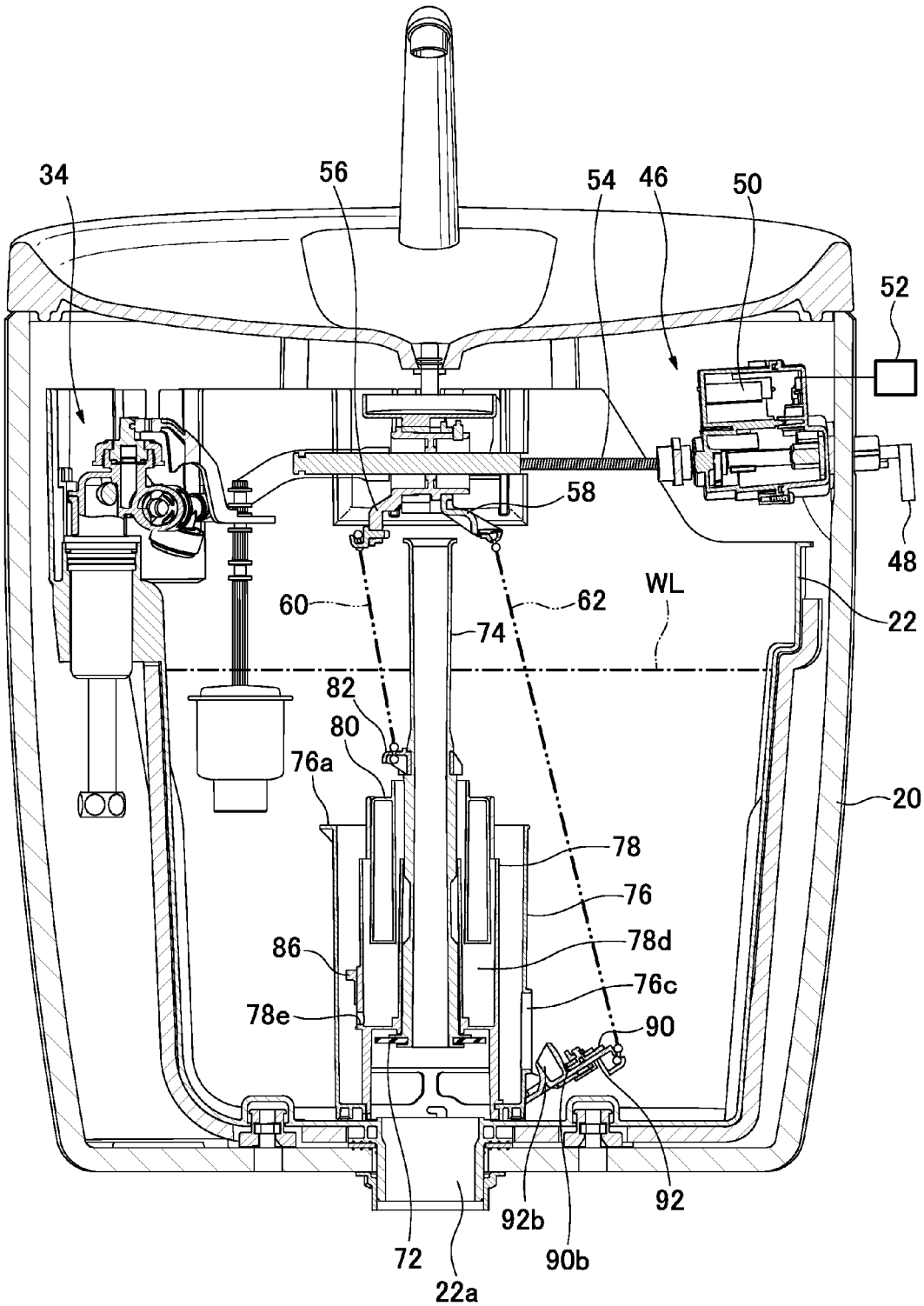
FIG. 7 is an overview sectional view showing the state of a flush water tank apparatus according to a first embodiment of the present invention in the large flush mode at the start of water discharge.
Figure 8:
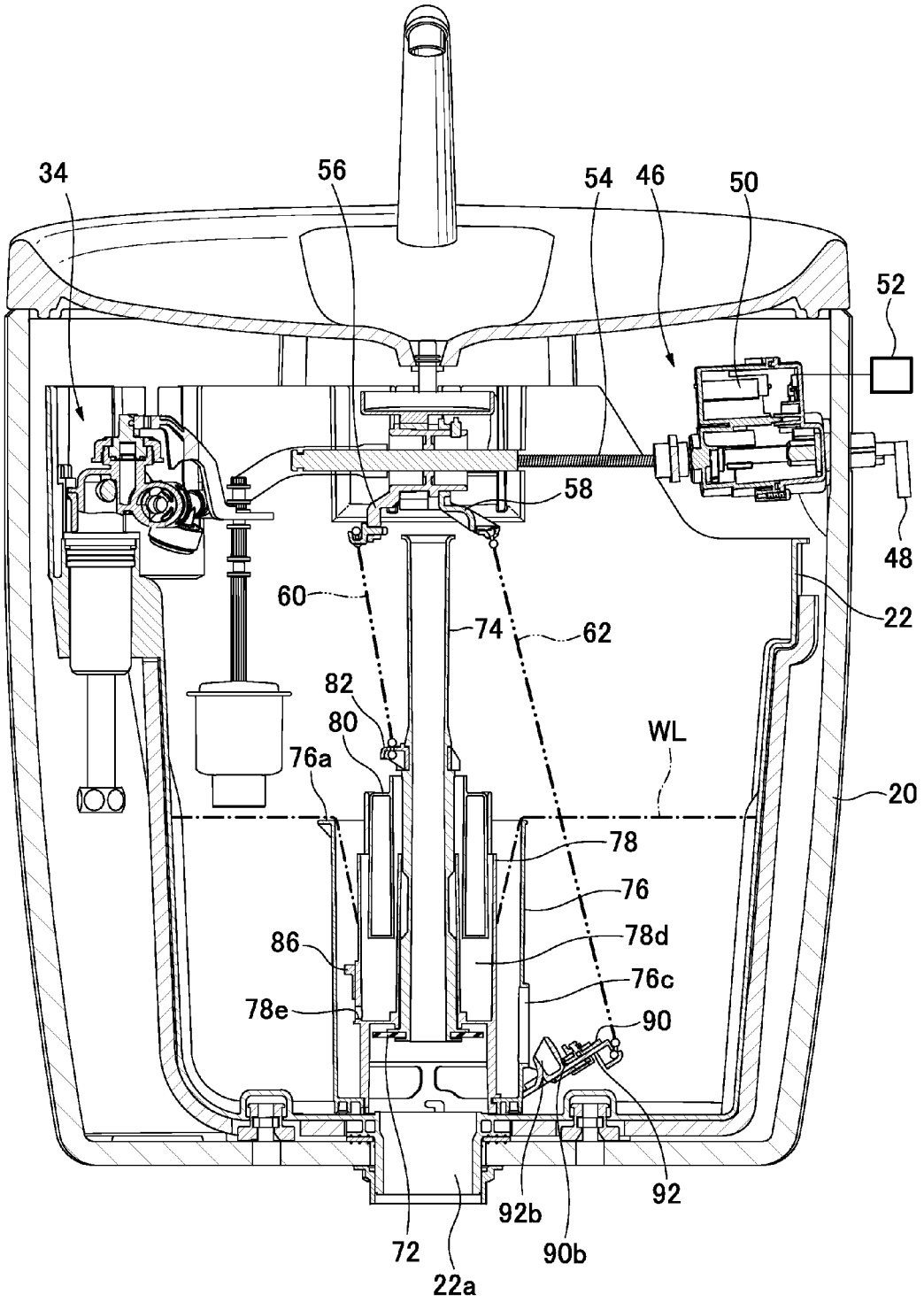
FIG. 8 is an overview sectional view showing the state of a flush water tank apparatus according to a first embodiment of the present invention in the large flush mode midway through water discharge.
Figure 9:
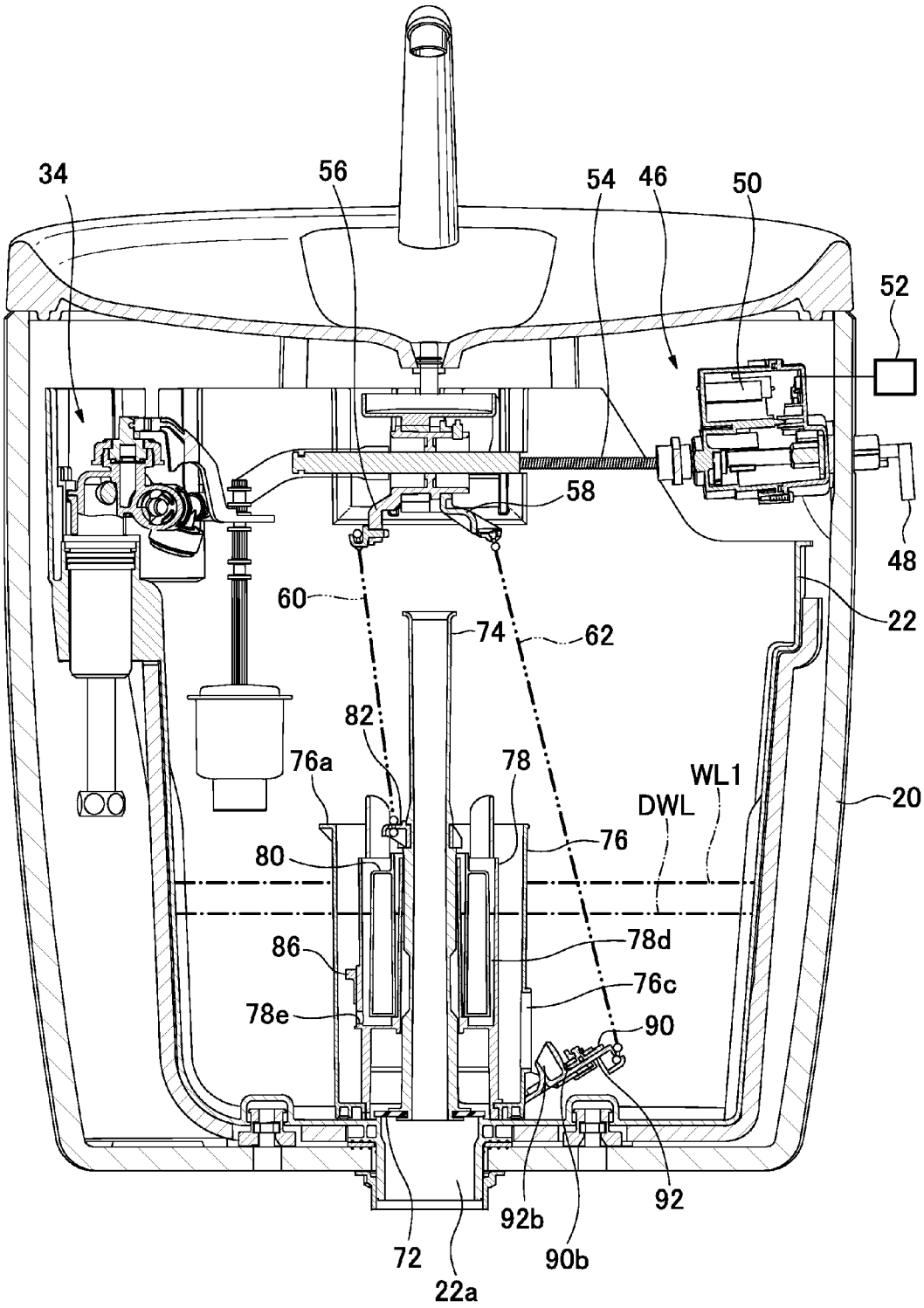
FIG. 9 is an overview sectional view showing the state of a flush water tank apparatus according to a first embodiment of the present invention in the large flush mode after the end of water discharge.

First, referring to FIGS. 7 through 9, there is explained the large flush mode among the three types of flush mode executed by the flush water tank apparatus according to a first embodiment of the present invention.

FIG. 7 is a summary sectional view showing the state upon the start of water discharge in the large flush mode in a flush water tank apparatus according to a first embodiment of the present invention; FIG. 8 is a summary sectional view showing the state midway through water discharge in the large flush mode in a flush water tank apparatus according to a first embodiment of the present invention; and FIG. 9 is a summary sectional view showing the state after completion of water discharge in the large flush mode in a flush water tank apparatus according to a first embodiment of the present invention.

Note that the large flush, small flush, and eco-small flush modes described below are each examples of the state in which the small holes 78*e*, 78*f* formed in the above-described reservoir cylinder 78*d* are both open (slide member 86 is not closing the small hole 78*e*).

First, as shown in FIG. 7, at the start of the large flush mode, when a user rotates the operating lever 48 by 90° toward the front, or when the large flush button is pushed and the motor 50 is activated (driven), only the first lifting member 56 oscillates, and the overflow pipe 74 and valve body 72 are pulled via the first bead chain 60 to a position at the height shown in FIG. 7, by which the discharge port 22*a* is opened and water discharge is started.

When the operating lever 48 is returned to its initial position immediately after completion of such lifting, the first lifting member 56 is returned to its initial position, or when lifting is carried out by activation of a motor 50, the motor 50 is activated so that the first lifting member 56 returns to its initial position immediately after lifting is completed.

Note that at this point the second lifting member 58 is not oscillated, so each of the switching valves 90, 92 which open and close the cylindrical body 76 opening portion 76*c* remain at a position separated from the opening portion 76*c*, as shown in FIG. 7. Therefore the cylindrical body 76 opening portion 76*c* is fully open, nor is there any change in its opening surface area.

Next, as shown in FIG. 8, the overall water level (WL) of flush water in the reservoir tank 22 drops with time after the start of discharge, and when the water level drops to the vicinity of the cylindrical body 76 top edge portion 76*a*, flush water in the cylindrical body 76 is rapidly discharged from the discharge port 22*a*.

In conjunction, the level of flush water inside the reservoir cylinder 78*d* begins to drop at a predetermined speed in accordance with the flow volume flowing out from the small holes 78*e*, 78*f*. Therefore the float 80 also drops with that drop in the water level in the reservoir cylinder 78*d*, and the overflow pipe 74 and valve body 72 also drop in tandem with the dropping of that float 80 at the same dropping speed as the float 80. When, after a predetermined time has elapsed, the level of flush water inside the reservoir cylinder 78*d* falls to a level whereby no buoyancy is imparted to the float 80, the valve body 72 closes the discharge port 22*a* (closes the valve), and water discharge ends.

Next, the water level shown in FIG. 9 (WL1) is the water level outside the cylindrical body 76 immediately after valve closing operation, whereas the water level (DWL) is the dead water level finally obtained when, after that valve closing, flush water outside the cylindrical body 76 flows into the cylindrical body 76 via the opening portion 76*c*.

Thus by causing the water level outside the cylindrical body 76 immediately following valve closing (WL1) to be positioned above the top edge of the opening portion 76*c*, the head pressure of flush water flowing into the opening portion 76*c* is high, and flush water is discharged at a high current force until the flush is complete.

Next, referring to FIGS. 10 through 15, there is explained the small flush mode executed by the flush water tank apparatus according to the first embodiment of the present invention.

Figure 10:
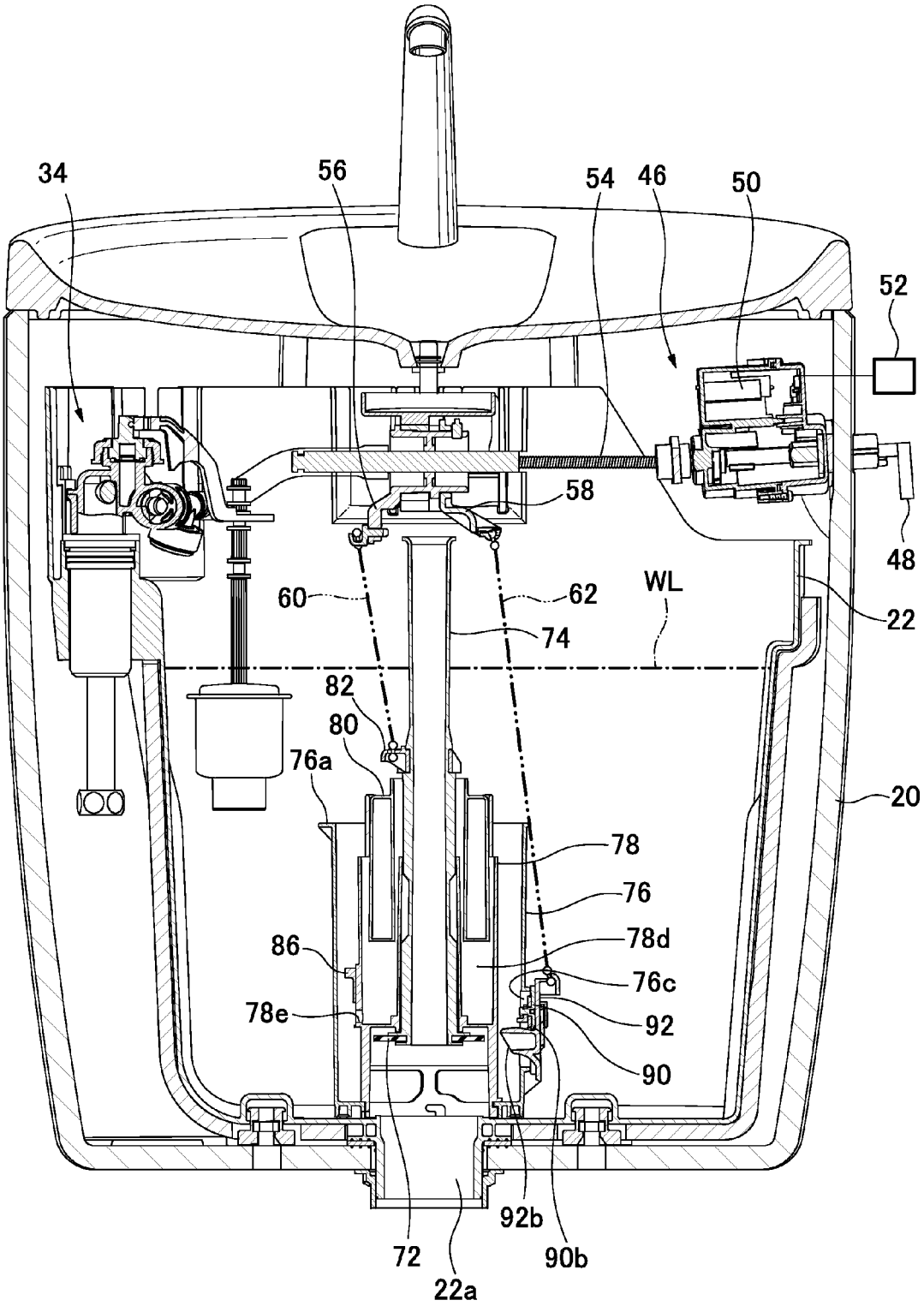
FIG. 10 is an overview sectional view showing the state of a flush water tank apparatus according to a first embodiment of the present invention in the small flush mode at the start of water discharge.
Figure 11:
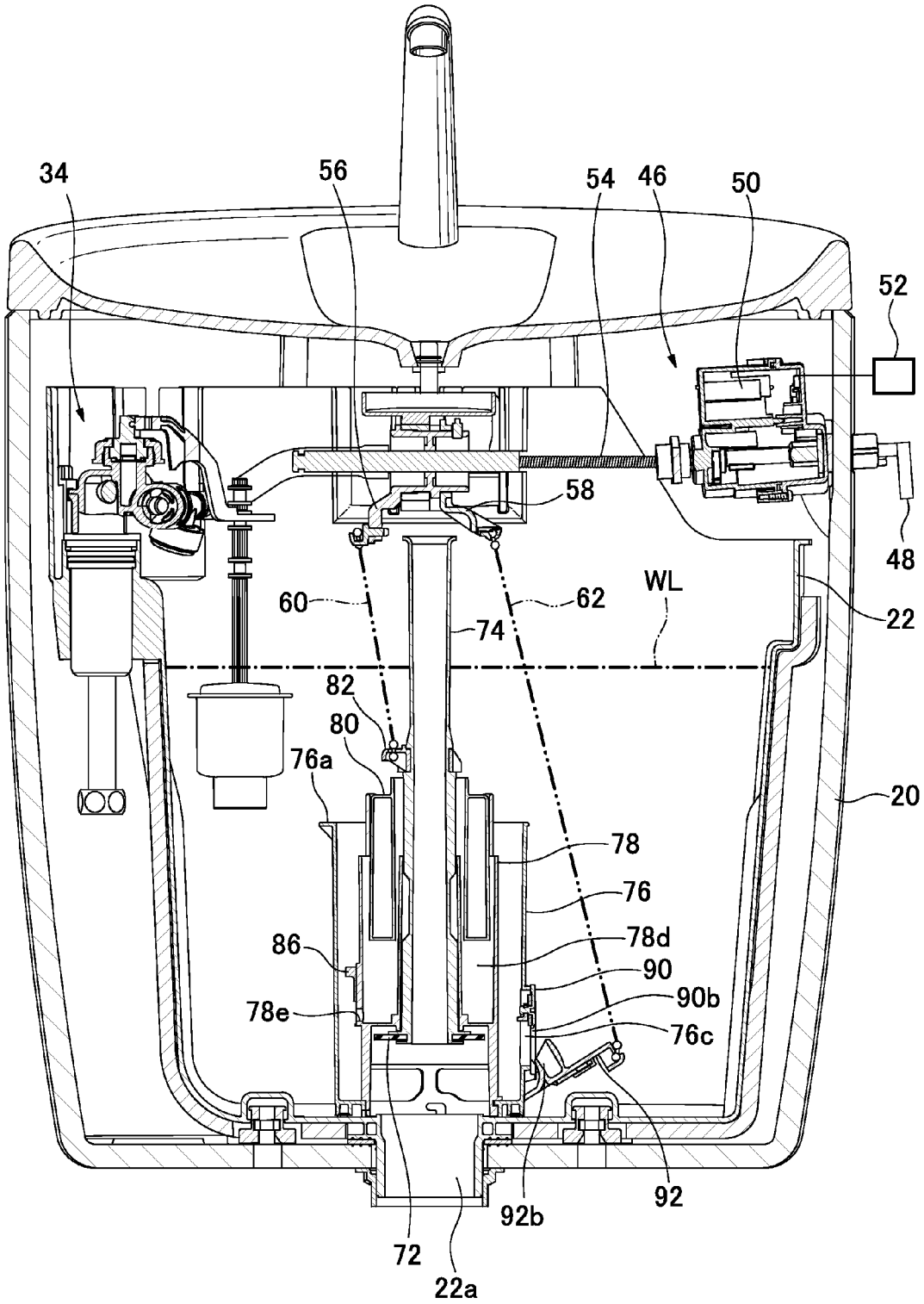
FIG. 11 is an overview sectional view showing the state of a flush water tank apparatus according to a first embodiment of the present invention in the small flush mode immediately after the start of water discharge.
Figure 12:
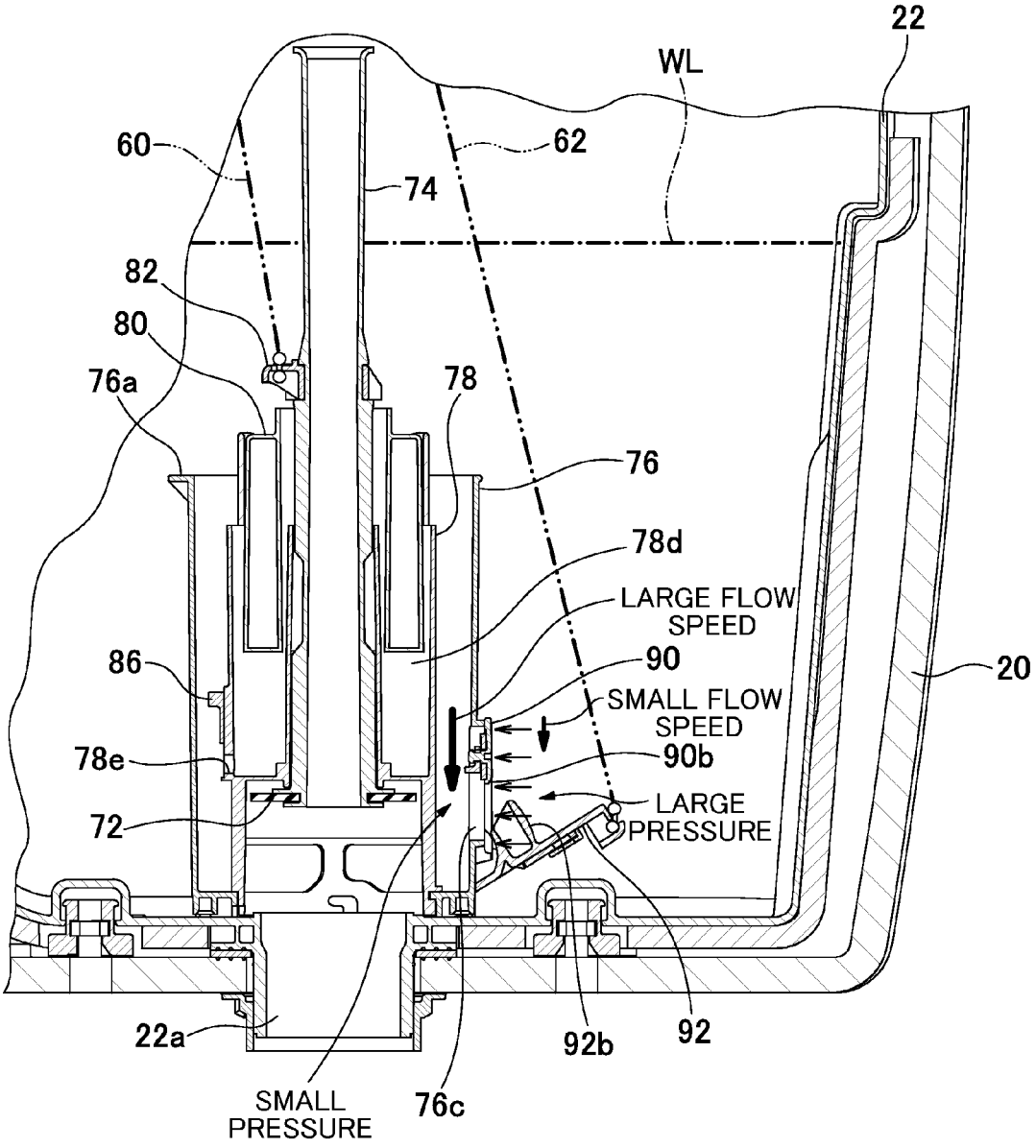
FIG. 12 is an expanded sectional view of the main parts for explaining the holding state of a first switching valve midway through water discharge in the small flush mode.
Figure 13:
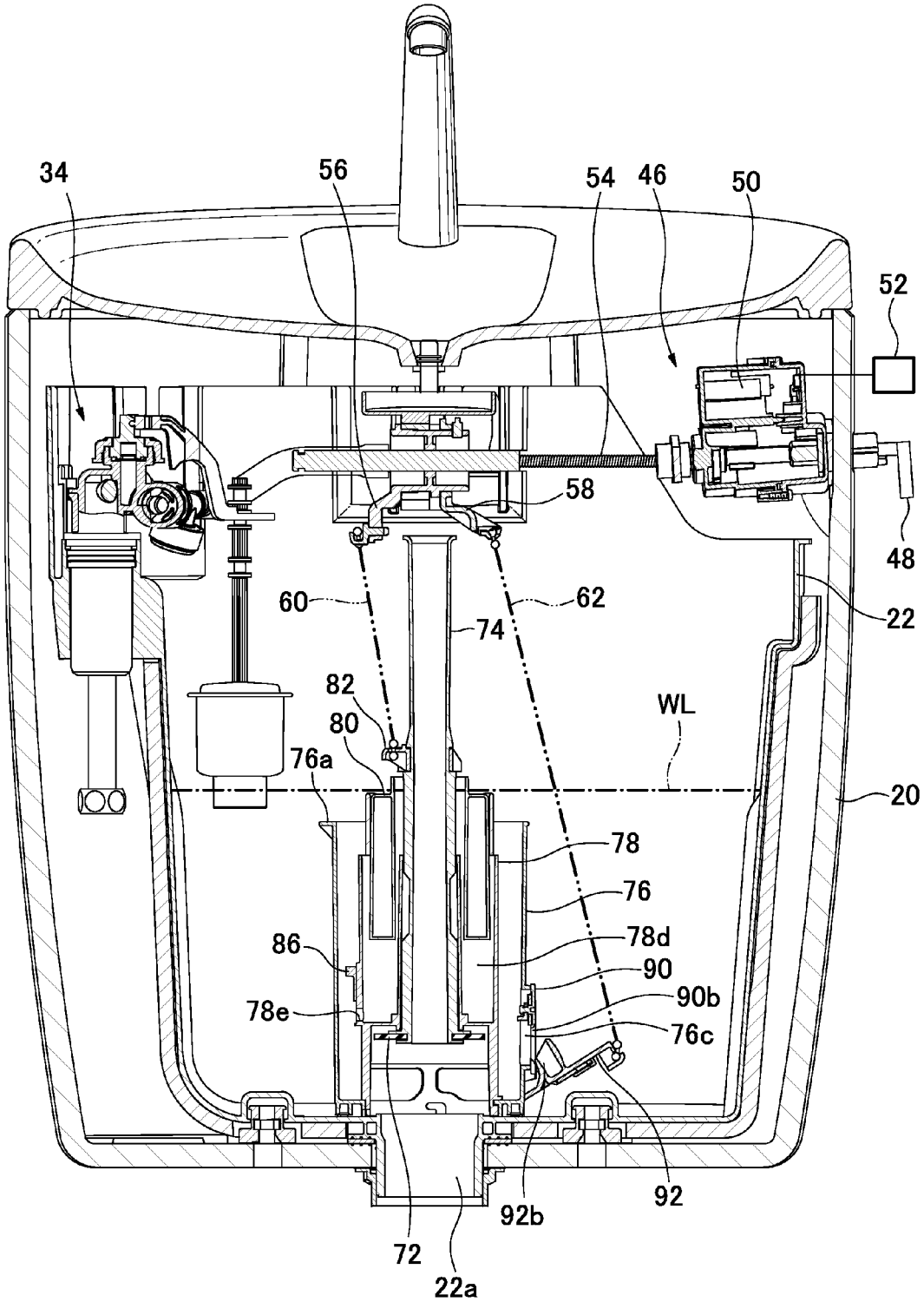
FIG. 13 is an overview sectional view showing the state of a flush water tank apparatus according to a first embodiment of the present invention in the small flush mode midway through water discharge.
Figure 14:
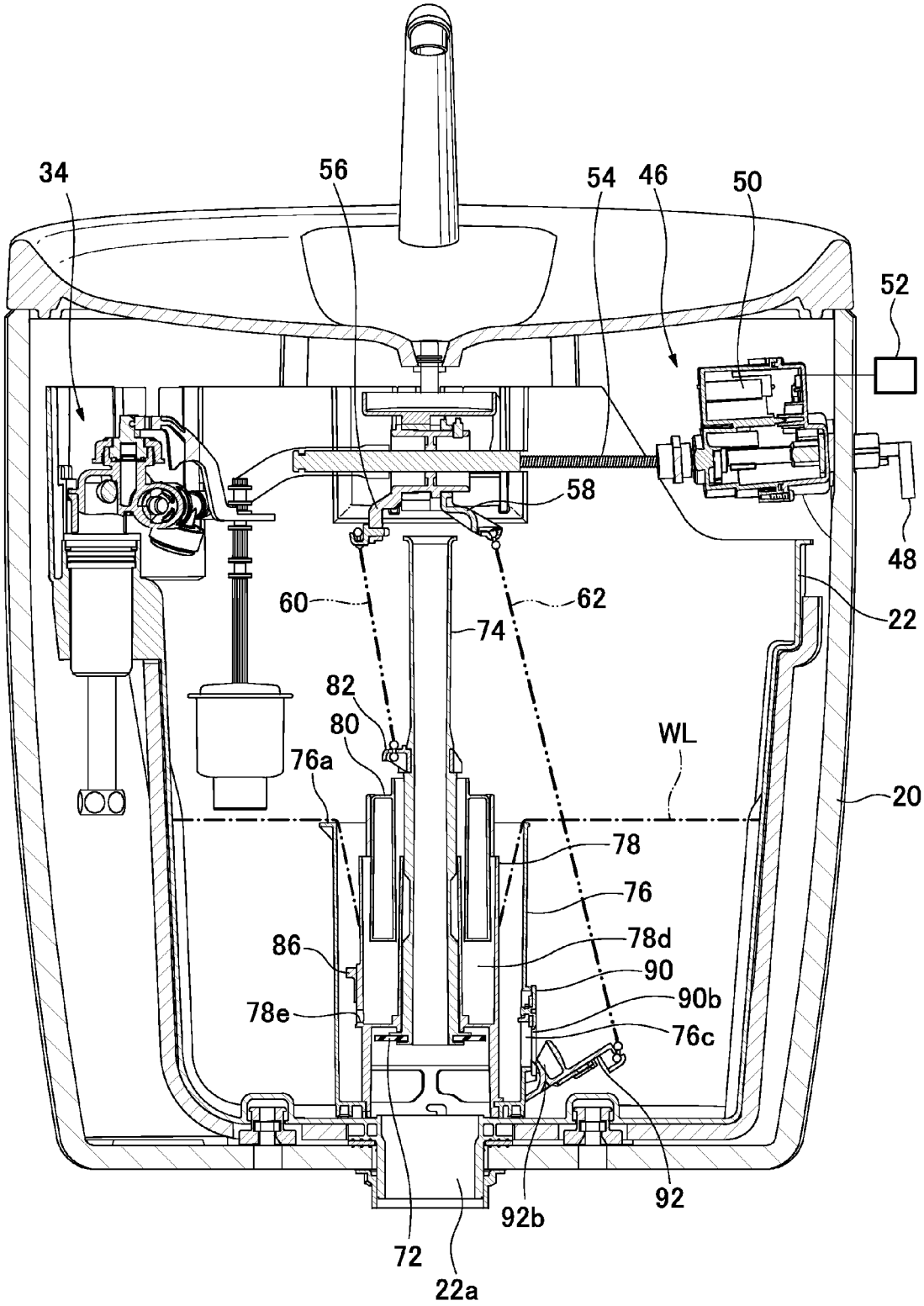
FIG. 14 is an overview sectional view showing the state of a flush water tank apparatus according to a first embodiment of the present invention in the small flush mode midway through water discharge.
Figure 15:
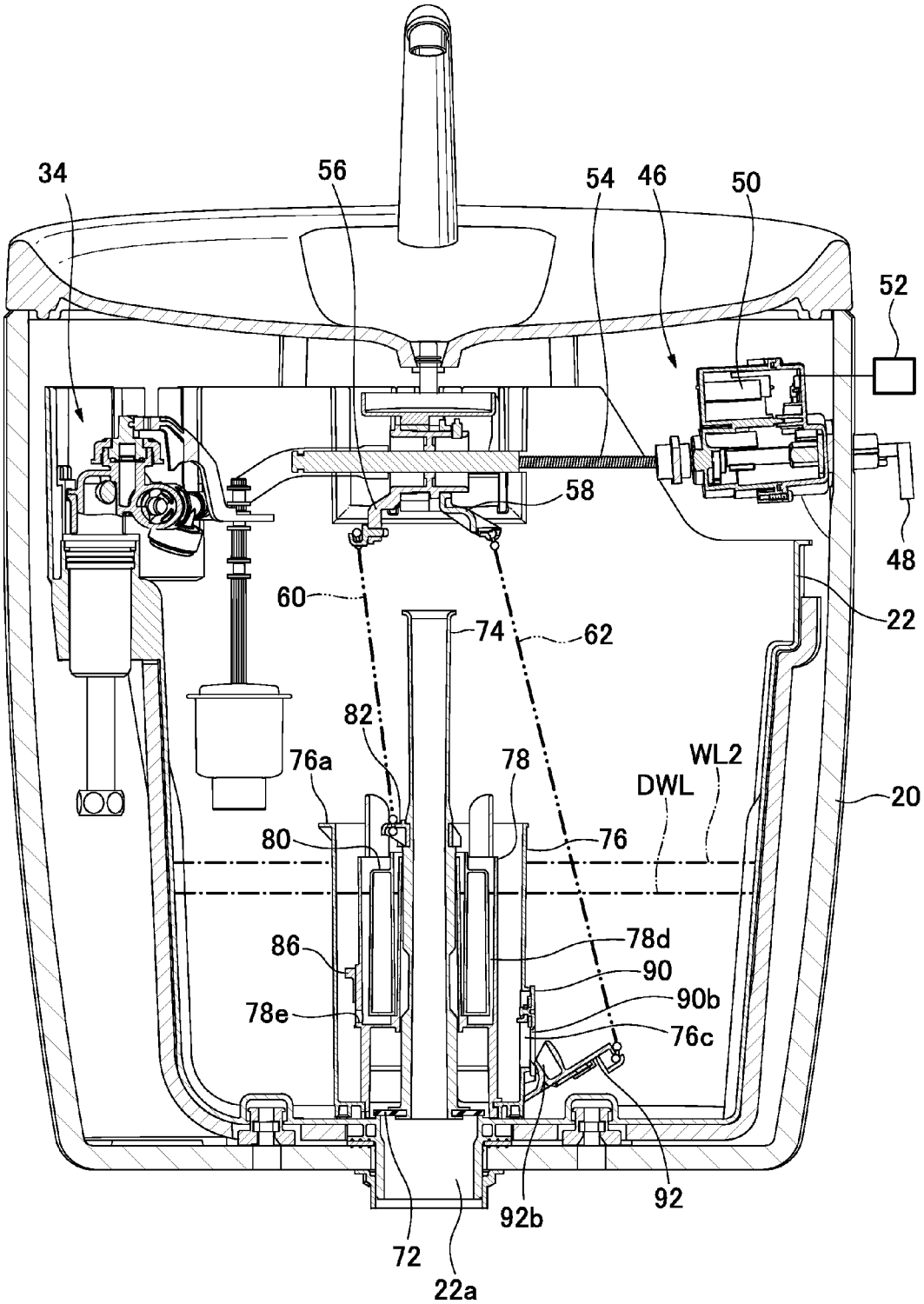
FIG. 15 is an overview sectional view showing the state of a flush water tank apparatus according to a first embodiment of the present invention in the small flush mode after the end of water discharge.

FIG. 10 is a summary sectional view showing the state upon start of water discharge in the small flush mode of a flush water tank apparatus according to a first embodiment of the present invention; FIG. 11 is a summary sectional view showing the state immediately after the start of water discharge in the small flush mode of a flush water tank apparatus according to a first embodiment of the present invention; FIG. 12 is an expanded sectional view of main portions, explaining the holding state of the first switching valve during water discharge in the small flush mode; FIG. 13 is a summary sectional view showing the state during discharge in the small flush mode of a flush water tank apparatus according to a first embodiment of the present invention; FIG. 14 is a summary sectional view showing the state during discharge in the small flush mode of a flush water tank apparatus according to a first embodiment of the present invention; FIG. 15 is a summary sectional view showing the state after discharge in the small flush mode of a flush water tank apparatus according to a first embodiment of the present invention.

First, as shown in FIG. 10, at the start of the small flush mode, when a user rotates the operating lever 48 by 90° toward the back, or when the small flush button is pushed and the motor 50 is activated, both the first lifting member 56 and the second lifting member 58 oscillate, and the overflow pipe 74 and valve body 72 are pulled via the first bead chain 60 to a position at the height shown in FIG. 10, such that the discharge port 22*a* is opened and water discharge is started. At the same time, the second switching valve 92 is lifted via the second bead chain 62. The first switching valve 90 is disposed on the inner side of the second switching valve 92, so that the first switching valve 90 is also lifted by the second switching valve 92 and, as shown in FIG. 10, in the present embodiment is lifted up to the position at which the opening portion 76*c* is closed.

When the operating lever 48 is returned to its initial position immediately after completion of such lifting, the first lifting member 56 and second lifting member 58 are returned to the initial position, or when lifting is carried out by activation of the motor 50, the motor 50 is activated so that the first lifting member 56 and second lifting member 58 return to the initial position immediately after lifting is completed.

When the second lifting member 58 is returned to its initial position, the second switching valve 92 returns to the initial position shown in FIG. 11 under its own weight. The weight 98 enables an even more reliable such return to the initial position.

On the other hand, the first switching valve 90 is disposed at the position at which the opening portion 76*c* is closed. This is explained by FIG. 12.

As shown in FIG. 12, the flow speed of flush water flowing inside the cylindrical body 76 after start of water discharge becomes larger relative to the flow speed of flush water flowing on the outside of the cylindrical body 76. This is because the flow path surface area on the inside of the cylindrical body 76 is larger than the flow path surface area of the first switching valve 90 communicating port 90*b*. When the flow speed of flush water flowing on the inside of the cylindrical body 76 becomes relatively larger than the flow speed of flush water flowing on the outside of the cylindrical body 76, a pressure differential arises between the inside and outside of the first switching valve 90, and a force such as shown in FIG. 12 is applied, so that the closed state is maintained.

As explained in FIG. 14, in a state whereby flush water inside the cylindrical body 76 is rapidly discharged from the discharge port 22*a*, and flush water inside the cylindrical body 76 disappears, it is held in by the water pressure from the flush water outside the cylindrical body 76.

On the other hand, because its pressure receiving surface area is small, the second switching valve 92 is little affected by this type of pressure differential, and as described above, it returns to its initial position under its own weight, as well as weight 98, and so forth.

In this manner, the first switching valve 90 is held in a state in which the opening portion 76*c* is closed, and the opening surface area of the cylindrical body 76 opening portion 76*c* is reduced to the opening surface area of the first switching valve 90 communicating port 90*b*. Therefore the flow volume of flush water flowing in from the outside of the cylindrical body 76 via the opening portion 76*c* is reduced by the amount of reduction in that opening surface area.

Next, as shown in FIG. 13, the overall water level (WL) of flush water in the reservoir tank 22 drops with time; thereafter, as shown in FIG. 14 and as in the above-described large flush mode, when the water level drops to the vicinity of the cylindrical body 76 top edge portion 76*a*, flush water in the cylindrical body 76 is rapidly discharged from the discharge port 22*a*.

In conjunction, flush water inside the reservoir cylinder 78*d* also begins to drop at a predetermined speed in accordance with the flow volume flowing out from small holes 78*e*, 78*f*. Therefore the float 80 also drops with that drop in the water level in the reservoir cylinder 78*d*, and the overflow pipe 74 and valve body 72 also drop in tandem with the dropping of that float 80 at the same speed as the float 80 dropping speed. When, after a predetermined time has elapsed, the level of flush water inside the reservoir cylinder 78*d* falls to a water level whereby no buoyancy is imparted to the float 80, the valve body 72 closes the discharge port 22*a*, and water discharge ends. At this point the dropping speed of the float 80, overflow pipe 74, and valve body 72 are approximately the same as during a large flush. Therefore the time from when the flush water level begins to drop inside the reservoir cylinder 78*d* until valve closing is reached is approximately the same as in the large flush mode.

The water level shown in FIG. 15 (WL2) is the water level outside the cylindrical body 76 immediately after valve closing, and the water level (DWL) is the dead water level finally obtained when, after that valve closing, flush water outside the cylindrical body 76 flows into the cylindrical body 76 via the opening portion 76*c*.

In this manner, by causing the water level outside the cylindrical body 76 immediately following valve closing (WL2) to be positioned above the top edge of the opening portion 76*c*, the head pressure of flush water flowing into the opening portion 76*c* is high, and in the small flush mode as well as the large flush mode, flush water is discharged at a high current force until the flush is complete.

Next, referring to FIGS. 16 through 20, there is explained the eco-small flush mode executed by the flush water tank apparatus according to the first embodiment of the present invention.

Figure 16:
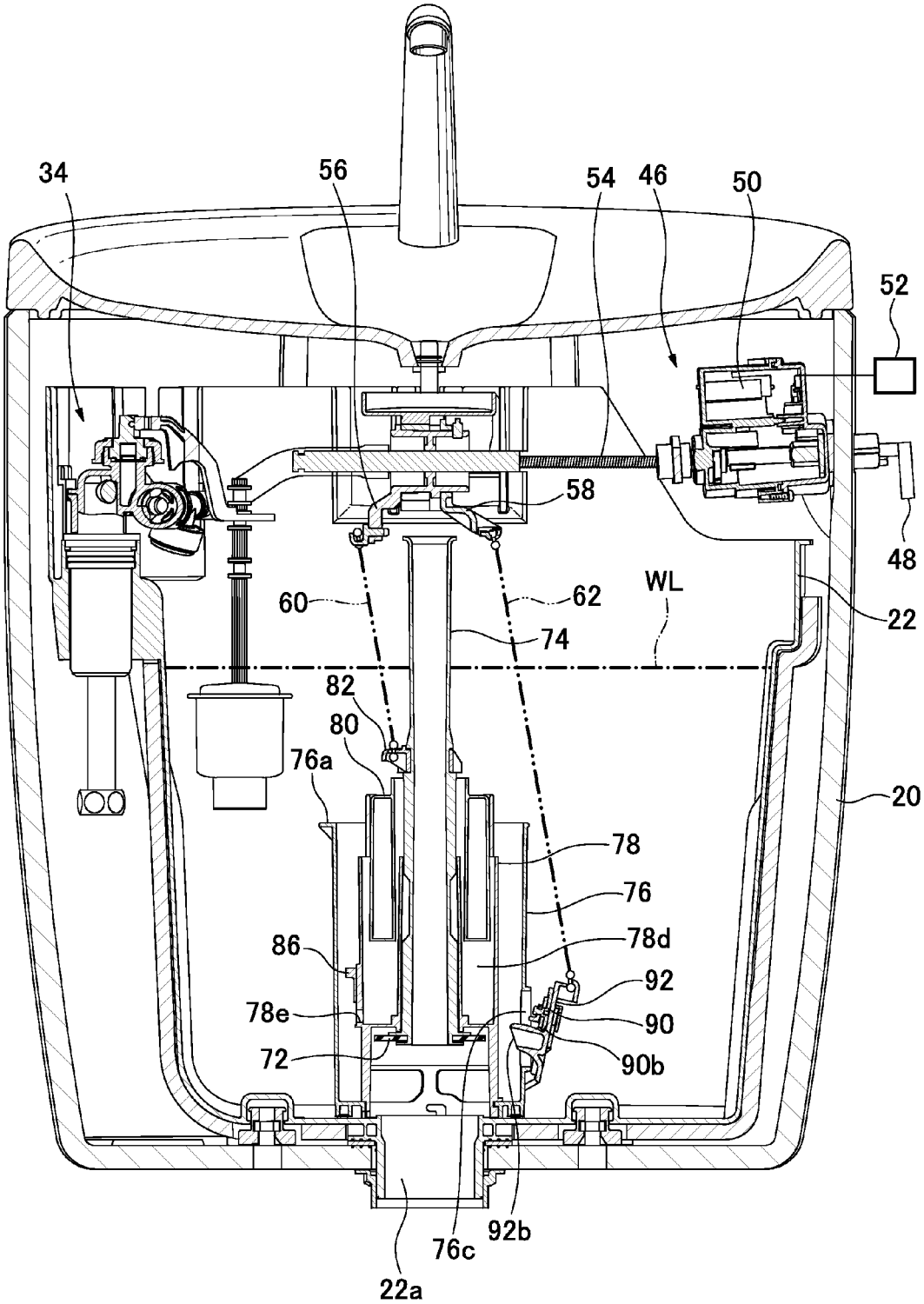
FIG. 16 is an overview sectional view showing the state of a flush water tank apparatus according to a first embodiment of the present invention in the eco-small flush mode at the start of water discharge.
Figure 17:
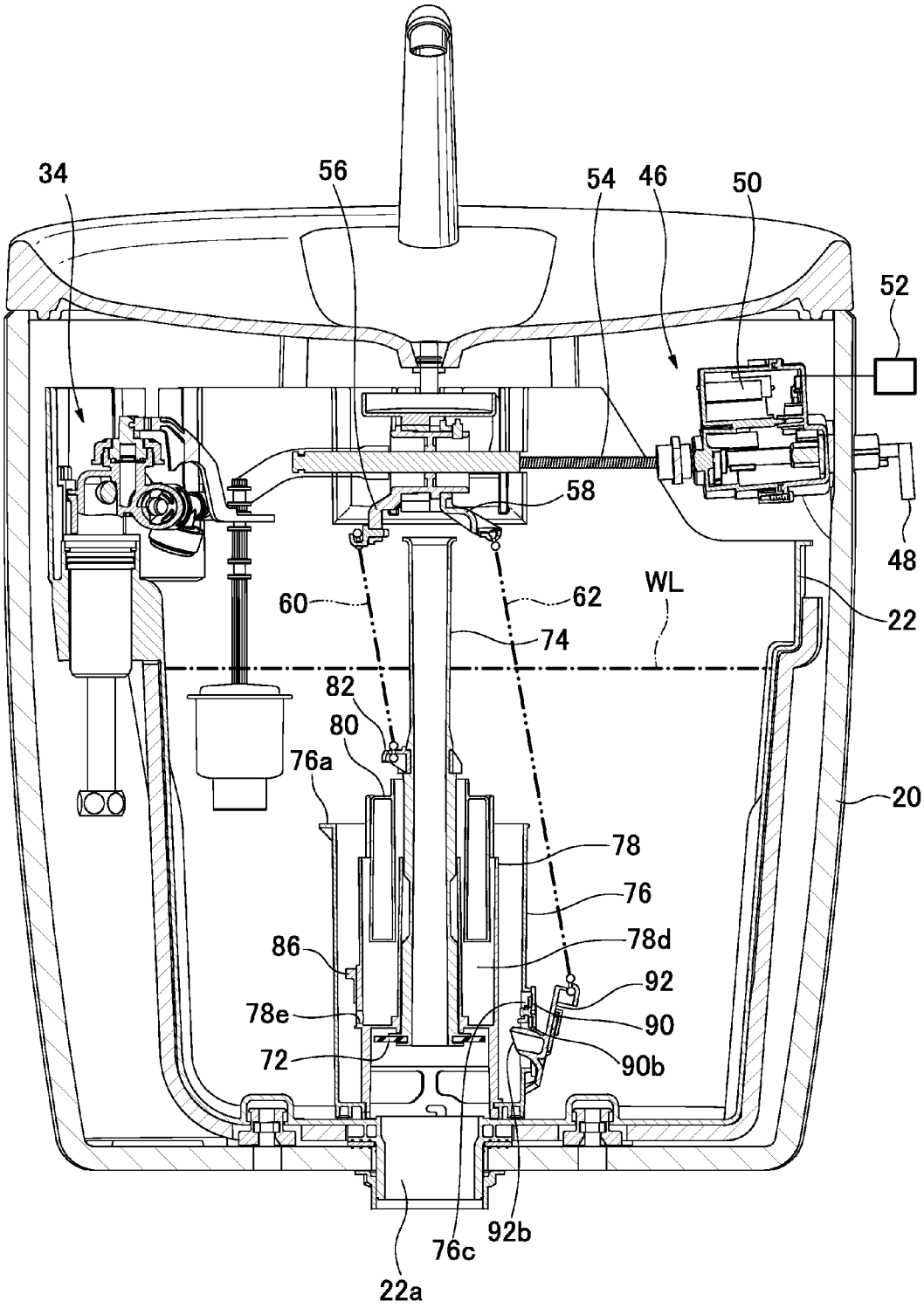
FIG. 17 is an overview sectional view showing the state of a flush water tank apparatus according to a first embodiment of the present invention in the eco-small flush mode immediately after the start of water discharge.
Figure 18:
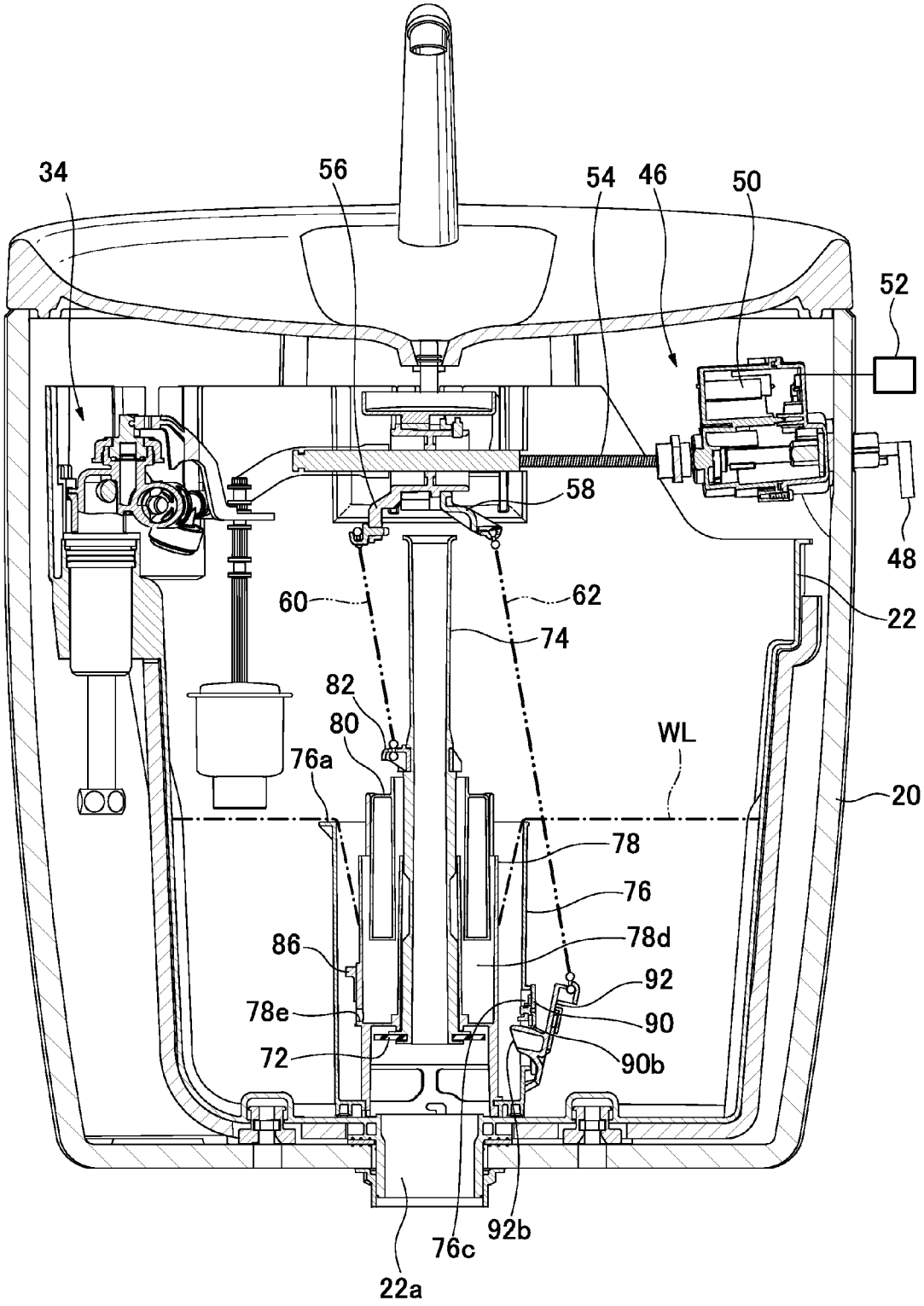
FIG. 18 is an overview sectional view showing the state of a flush water tank apparatus according to a first embodiment of the present invention in the eco-small flush mode midway through water discharge.
Figure 19:
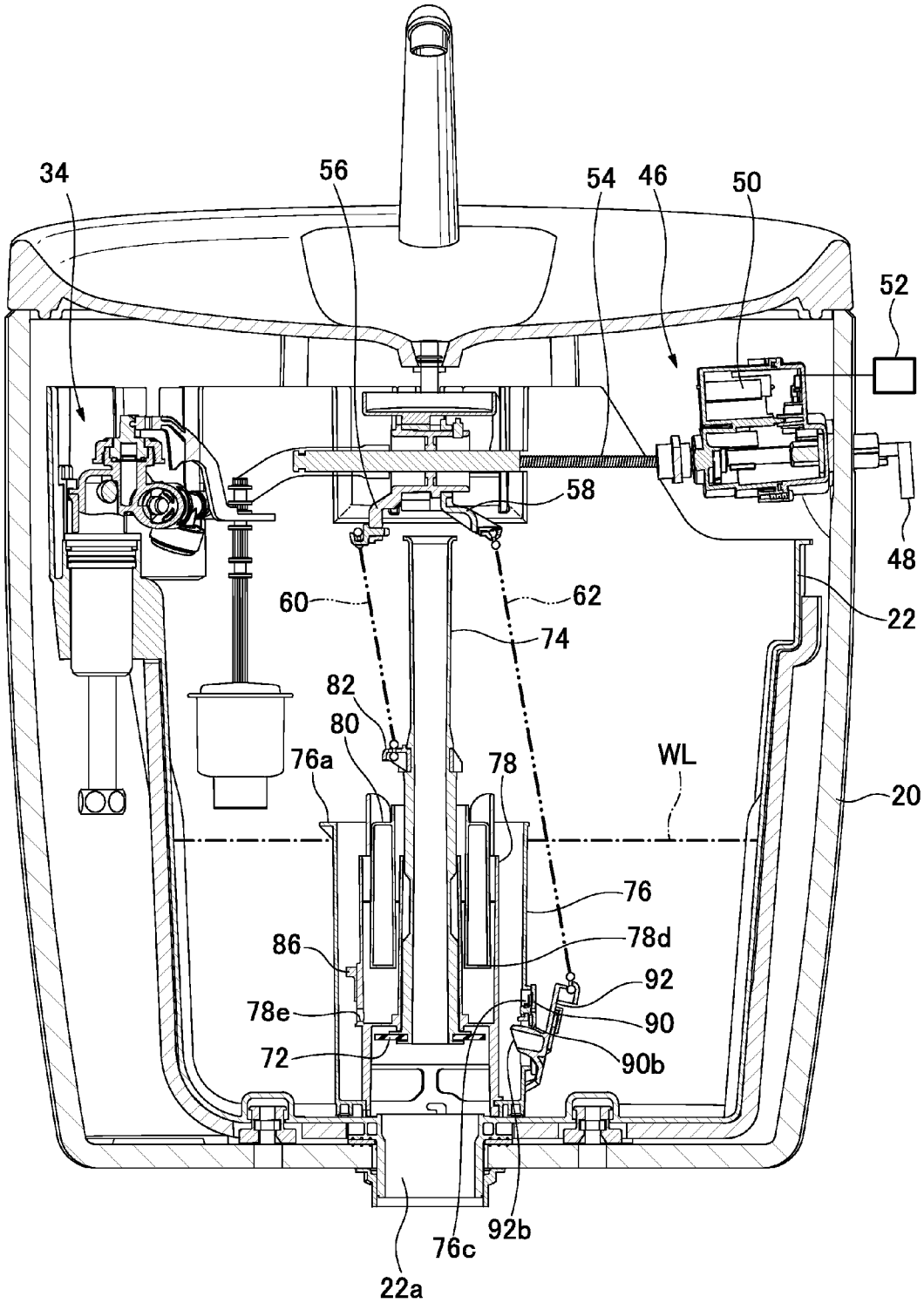
FIG. 19 is an overview sectional view showing the state of a flush water tank apparatus according to a first embodiment of the present invention in the eco-small flush mode immediately prior to the end of water discharge.
Figure 20:
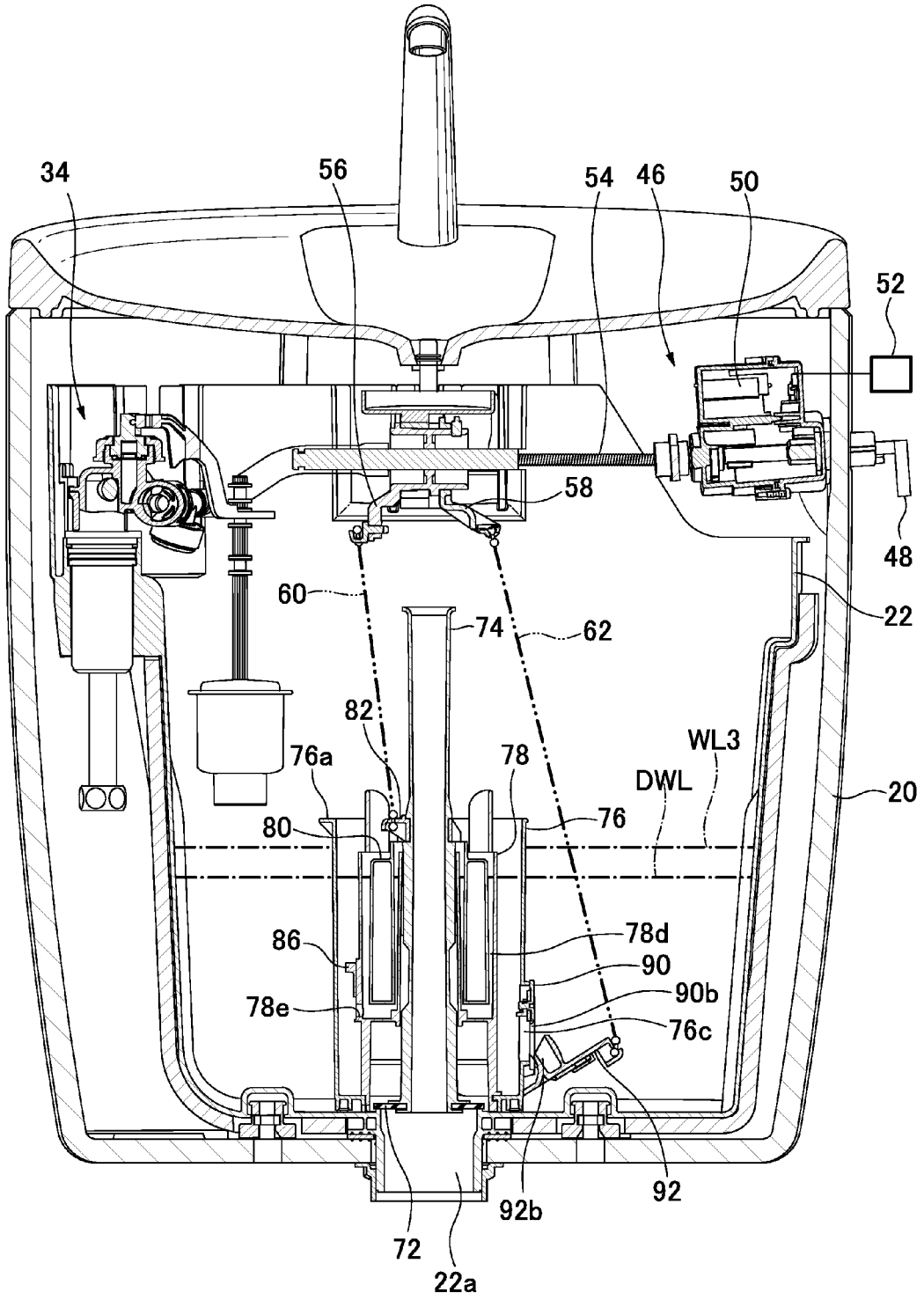
FIG. 20 is an overview sectional view showing the state of a flush water tank apparatus according to a first embodiment of the present invention in the eco-small flush mode after the end of water discharge.

FIG. 16 is a summary sectional view showing the state upon start of water discharge in the eco-small flush mode of a flush water tank apparatus according to a first embodiment of the present invention; FIG. 17 is a summary sectional view showing the state immediately after the start of water discharge in the eco-small flush mode of a flush water tank apparatus according to a first embodiment of the present invention; FIG. 18 is a summary sectional view showing the state during discharge in the eco-small flush mode of a flush water tank apparatus according to a first embodiment of the present invention; FIG. 19 is a summary sectional view showing the state immediately prior to discharge in the eco-small flush mode of a flush water tank apparatus according to a first embodiment of the present invention; FIG. 20 is a summary sectional view showing the state after discharge in the eco-small flush mode of a flush water tank apparatus according to a first embodiment of the present invention.

First, as shown in FIG. 16, at the start of the eco-small flush mode when a user pushes the eco-small flush button and the motor 50 is activated, both the first lifting member 56 and the second lifting member 58 oscillate, and the overflow pipe 74 and valve body 72 are pulled via the first bead chain 60 to a position at the height shown in FIG. 16, by which the discharge port 22*a* is opened and water discharge is started. At the same time, the second switching valve 92 is lifted via the second bead chain 62. The first switching valve 90 is disposed on the inner side of the second switching valve 92, so that the first switching valve 90 is also lifted by the second switching valve 92, and in the present embodiment the first switching valve 90 and the second switching valve 92 are lifted to the angle position shown in FIG. 16, and brought into proximity at a predetermined distance from the opening portion 76*c*.

In the present embodiment, when in the eco-small flush mode, after completion of this lifting the motor 50 is activated so that the first lifting member 56 and the second lifting member 58 are held at that position. I.e., the overflow pipe 74, valve body 72, and second switching valve 92 are held at the positions shown in FIG. 16, and as described below, that state is maintained for a predetermined time.

At the same time, the first switching valve 90, as shown in FIG. 17, is pulled to the opening portion 76*c* side by the negative pressure resulting from the flow speed of flush water flowing inside the cylindrical body 76 and, as described above, is thereafter held at the position for closing the opening portion 76*c* by the pressure differential arising from the flow speed differential between the inside and outside of the cylindrical body 76. As shown in FIG. 17, the angle position at which the second switching valve 92 is held is set so that when the first switching valve 90 is held at the position for closing the opening portion 76*c*, the raised portion 92*b* formed on the second switching valve 92 is inserted into the first switching valve 90 communicating port 90*b*.

Note that it is also acceptable in the above-described small flush mode for the lifting of the second switching valve 92 at the start of water discharge to stop at the angle position shown in FIG. 16, and for the first switching valve 90 to be pulled to the opening portion 76*c* side by the above-described negative pressure and held at the position at which the opening portion 76*c* is closed by the above-described pressure differential between the inside and outside of the cylindrical body.

Thus in the eco-small flush mode the first switching valve 90 is held in a state in which the opening portion 76*c* is closed, and the second switching valve 92 is held at the angle position shown in FIG. 17 by the motor 50 mediated by the second lifting member 58, the second bead chain 62, and the like; at this angle position, the raised portion 92*b* formed on the second switching valve 92 is inserted into the first switching valve 90 communicating port 90*b* so that the opening surface area of the first switching valve 90 communicating port 90*b* is reduced. Therefore the opening surface area of the cylindrical body 76 opening portion 76*c* is reduced further than in the small flush mode, and the flow volume of flush water flowing in from outside the cylindrical body 76 via the opening portion 76*c* is even less than in the small flush mode.

Next, as shown in FIG. 18, and as during the above-described large flush and small flush, flush water in the cylindrical body 76 is rapidly discharged from the discharge port 22*a* when the water level drops to the vicinity of the cylindrical body 76 top edge portion 76*a*.

In conjunction, flush water inside the reservoir cylinder 78*d* also begins to drop at a predetermined speed in accordance with the flow volume flowing out from the small holes 78*e*, 78*f*. Here, in this eco-small flush mode, the overflow pipe 74 and the valve body 72 are held, therefore unlike the large flush mode and the small flush mode, only the float 80 drops with the fall in the water level within the reservoir cylinder 78*d*, as shown in FIG. 19.

After the elapse of a predetermined time, the hold on the valve body 72 and the hold on the second switching valve 92 are released, the overflow pipe 74 and the valve body 72 are allowed to drop, then the valve body 72 closes discharge port 22*a*, and water discharge ends.

Details of the release of the holds on the overflow pipe 74 and the valve body 72 when water discharge ends are now explained. In the present embodiment the hold by the motor 50 is released and the overflow pipe 74 and valve body 72 are basically allowed to free fall and descend under their own weight, but that dropping speed is reduced to a predetermined speed by imparting an opposing force, albeit small, from the mechanical friction and the like of the gears, etc. in the motor 50. Note that after the hold is released, the motor 50 may also be electrically driven to adjust the dropping speed.

In the present embodiment the timing at which the holds are released is set as the time when the flush water level inside the reservoir cylinder 78*d* drops to a water level not imparting buoyancy to the float 80.

Note that the timing at which the holds are released may also be set so that the point at which the overflow pipe 74 and valve body 72 drop at the above-described predetermined speed and the affixing member 82 affixed to the overflow pipe 74 contacts the top surface of the float 80 is approximately the same time as the point at which the flush water level in the reservoir cylinder 78*d* drops to a water level not imparting buoyancy to the float 80.

The water level shown in FIG. 20 (WL3) is the water level outside the cylindrical body 76 immediately after valve closing, and the water level (DWL) is the dead water level finally obtained when, after that valve closing, flush water outside the cylindrical body 76 flows into the cylindrical body 76 via the opening portion 76*c*.

By thus causing the water level outside the cylindrical body 76 immediately following valve closing (WL3) to be positioned above the top edge of the opening portion 76*c*, the head pressure of flush water flowing into the opening portion 76*c* is high, and in the eco-small flush mode as well, as in the large flush mode and the small flush mode, flush water is discharged at a high current force until the flush is completed.

As explained above, in each flush mode, by positioning the water levels (WL1, WL2, WL3) outside the cylindrical body 76 immediately after valve closing above the opening portion 76*c*, the head pressure of flush water flowing into the opening portion 76*c* can be made high, so that in the flush water tank apparatus of the present embodiment, particularly when provided on a wash-down type of toilet such as shown in FIG. 1, can sustain the flushing effect until the end of water discharge, thereby yielding a superior the effect.

Here, there is explained each of the large flush, small flush, and eco-small flush modes relative to a state in which both the small holes 78*e*, 78*f* formed on the above-described reservoir cylinder 78*d* are open (the state in which the small hole 78*e* is not closed by the slide member 86), but in the large flush mode and the small flush mode if, of the small holes 78*e*, 78*f*, one small hole 78*e* is closed by the slide member 86, the dropping speed of the flush water level in that reservoir cylinder 78*d* is slowed, and the valve close timing is slowed (also see the explanation in FIG. 8), enabling the volume of flush water in each flush mode to be increased.

Note that in the present embodiment, in each of the eco-small flush modes the eco-small flush is carried out by activating the motor 50 when the eco-small flush button is pushed, driving the first lifting member 56 and the second lifting member 58, and bringing the first switching valve 90 and the second switching valve 92 into a proximity of a predetermined distance relative to the opening portion 76*c*, but the eco-small flush mode can also be carried out by a user rotating the operating lever 48 in a direction which lifts both the first lifting member 56 and the second lifting member 58, holding for a predetermined short time, and thereafter allowing the first switching valve 90 and the second switching valve 92 to be tightly adhered to the opening portion 76*c* by the flush water pressure outside the cylindrical body 76.

Next, referring to FIGS. 9, 15, and 21, adjustment of the flush water volume in each flush mode in the present embodiment will be explained.

Figure 21A:
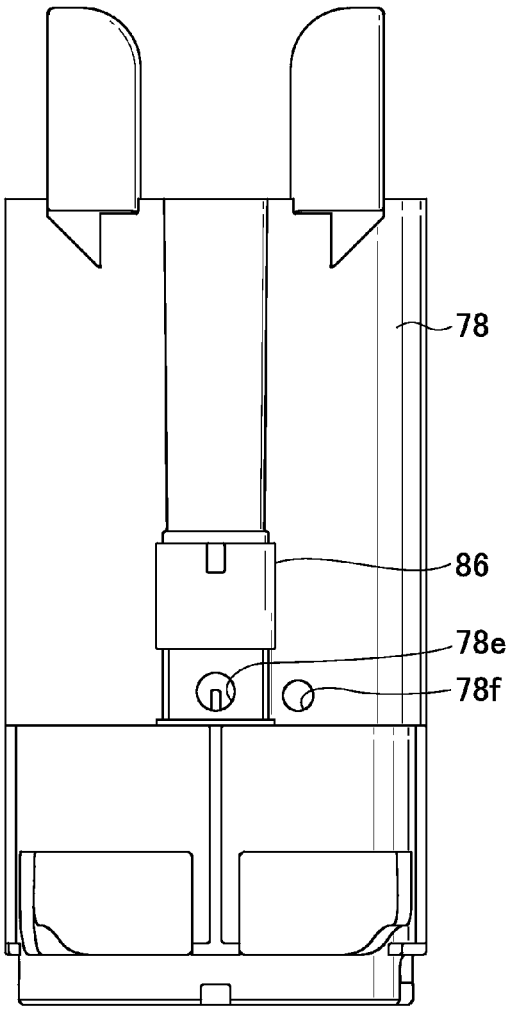
FIG. 21A is a side elevation of the control cylinder in the water discharge apparatus of a flush water tank apparatus according to an embodiment of the present invention, showing the state in which the slide member opens one of the small holes.
Figure 21B:
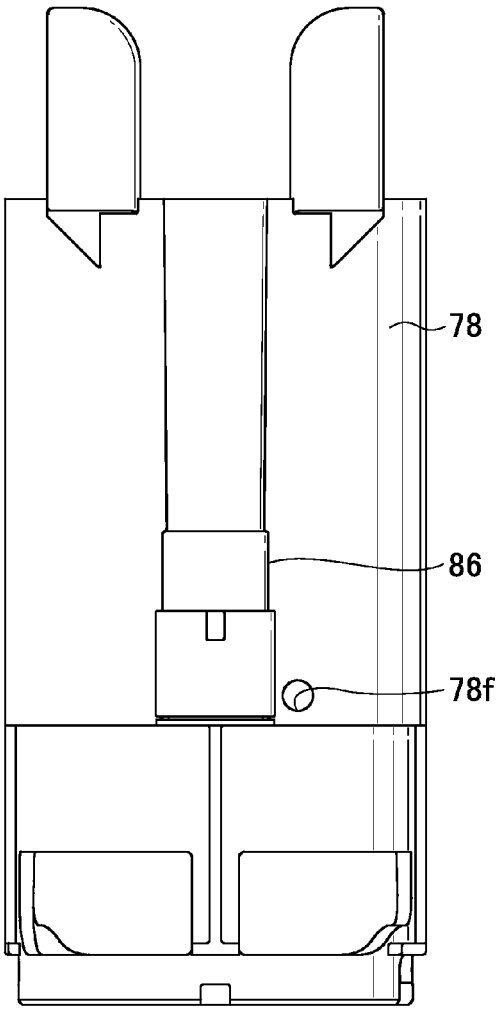
FIG. 21B is a side elevation of the control cylinder in the water discharge apparatus of a flush water tank apparatus according to an embodiment of the present invention, showing the state in which the slide member closes one of the small holes.

FIGS. 21A and 21B are side elevations of the control cylinder in the water discharge apparatus of a flush water tank apparatus according to an embodiment of the present invention, respectively showing the state in which the slide member opens one of the small holes, and the state in which the slide member closes one of the small holes.

In FIGS. 7 through 20 above, for each of the large flush, small flush, and eco-small flush modes, the small holes 78*e*, 78*f* formed in the above-described reservoir cylinder 78*d* are both in an open state (the state shown in FIG. 21(A)).

Here, in the large flush mode and the small flush mode, by closing the small hole 78*e* of the small holes 78*e*, 78*f* using the slide member 86 (the state shown in FIG. 21(B)), the volume of flush water in each of those flush modes can be increased. I.e., as explained primarily in FIGS. 5 and 8, in the present embodiment the control cylinder 78 is formed so that the level of flush water inside the reservoir cylinder 78*d* drops at a predetermined speed in accordance with the flow volume flowing out from the small holes 78*e*, 78*f*. Therefore if one of the small holes 78*e* is closed by the slide member 86, the flow volume of flush water flowing out from within the reservoir cylinder 78*d* can be reduced, and the speed at which the flush water level inside the reservoir cylinder 78*d* drops can be slowed. Therefore as described above, the dropping speed of the valve body 72, configured to drop in tandem with the dropping of the float 80 inside the reservoir cylinder 78*d*, can be slowed, and the valve closing timing can be delayed by the degree to which the dropping speed is slowed, thereby increasing the volume of flush water.

In FIGS. 9 and 15, the dead water level obtained in a state whereby one small hole 78*e* is closed by the slide member 86 (FIG. 21(B)) is shown as "DWL(b)." This dead water level (DWL(b)) is below the dead water level (DWL(a)) when the two small holes 78*e*, 78*f*, 78*f* are open. In the present embodiment, as shown by these dead water levels, for the large flush mode and the small flush mode, water is conserved with the two small holes small holes 78*e* in an open state basically and, as needed, the flush water volume can be increased by closing one small hole 78*e*.

Note that in the eco-small flush mode according to the present embodiment, the timing at which the hold on the overflow pipe 74 and the valve body 72 is released is delayed to increase the flush water volume.

Also, the number of small holes is not limited to two; holes may be plurally disposed. By disposing multiple small holes and closing them in a staged manner using a slide member, adjustment of the flush water volume in each flush mode (adjustment of valve closing timing) can be finely set according to the desired flush water volume. So long as it is able to adjust the flow volume of flush water flowing out of the reservoir cylinder 78*d*, the invention is not limited to small holes; for example, a mechanism may be provided whereby long holes extending laterally are provided on the side surface of the reservoir cylinder 78*d*, and the opening surface area of those long holes is steplessly adjusted using a slide member capable of sliding in the same direction as that in which the long holes extend.

Using the flush water tank apparatus 18 according to the above-described first embodiment of the present invention, switching valves 90, 92 for opening and closing so as to adjust the opening surface area of the cylindrical body 76 opening portion 76*c* are provided so that the volume of flush water supplied from the reservoir tank 22 discharge port 22*a* to the flush toilet 1 can be obtained in multiple stages including a large flush mode, a small flush mode, and a eco-small flush mode, therefore multiple stages of flush water volumes can be effectively obtained using a simple structure. As a result, the requirement in recent years for water conservation can be met.

In the present invention thus configured, only one opening portion 76*c* is formed on the cylindrical body 76, and there are a first switching valve 90 configured so that the opening surface area of the one opening portion 76*c* thereof can be reduced, and a second switching valve 92 capable, in conjunction with the first switching valve, of further reducing the opening surface area of the opening portion 76*c*; therefore a large flush mode in which the cylindrical body 76 opening portion 76*c* is fully opened to achieve a large flow volume of flush water flowing in from outside to inside the cylindrical body 76, a small flush mode in which the cylindrical body 76 opening portion 76*c* opening surface area is reduced using the first switching valve 90 to achieve a medium flow volume of flush water flowing in from outside to inside the cylindrical body 76, and an eco-small flush mode in which the cylindrical body opening portion opening surface area is further reduced by the first switching valve 90 and the second switching valve 92 to achieve an even smaller flow volume of flush water flowing in from outside to inside the cylindrical body 76 can each be achieved using a simple structure in which the cylindrical body opening portion 76 is opened and closed by the two switching valves 90, 92.

Formed on the first switching valve 90 is a communicating port 90*b*, the opening surface area of which is smaller than that of the cylindrical body 76 opening portion 76*c*, on which a communicating port 90*b* is formed for communicating between the outside and inside of the cylindrical body 76 when the cylindrical body 76 opening portion 76*c* is closed; the second switching valve 92 is formed to reduce the opening surface area of the communicating port 90*b* formed on the first switching valve 90 when brought into proximity with the first switching valve 90, therefore by simply adjusting the positions of those switching valves as described above, the following three stages of flush water volume can be easily obtained: a large flush mode obtained by fully opening the cylindrical body 76 opening portion 76*c*, a small flush mode obtained by reducing the opening surface area of the cylindrical body 76 opening portion 76*c* to approximately the same opening surface area as the first switching valve 90 communicating port 90*b*, and an eco-small flush mode obtained by making the opening surface area of the cylindrical body 76 opening portion 76*c* smaller than opening surface area of the first switching valve 90 communicating port 90*b*. A multistage flush can be achieved by a simple switching valve structure consisting of a first switching valve 90 on which a communicating port 90*b* is formed, and a second switching valve 92 which reduces the opening surface area of that communicating port 92.

During discharge of water the first switching valve 90 is held in a state whereby the cylindrical body 76 opening portion 76*c* is closed by the pressure differential caused by the flush water flow speed differential between the outside and inside of the cylindrical body 76, thus obviating the need to hold it using an electrical device such as a motor, and a multistage flush can be achieved using a simple structure.

During the eco-small flush mode, the second switching valve 92 is held at a position close to the first switching valve 90 by the motor 80 from the start of discharge to the end of discharge, therefore the second switching valve 92, which is disposed outside the first switching valve 90, and which is difficult to hold using the pressure differential between the inside and outside of the cylindrical body 76, can be more reliably maintained in a state whereby the opening surface area of the first switching valve 90 communicating port 90*b* is reduced, from start of discharge to end of discharge.

The second switching valve 92 extends on the first switching valve 90 side, and has a raised portion 92*b* capable of insertion into the first switching valve 90 communicating port 90*b* when brought into proximity with the first switching valve 90, therefore it is not necessary for the second switching valve 92 to tightly contact the first switching valve 90 in order to reduce the opening surface area of the first switching valve 90 communicating port 90*b*; the position may move somewhat so long as they are in a proximate state. Therefore during the eco-small flush mode, the imparting of large tensions to ball chain 62 or the like caused by bringing the second switching valve 92 into close proximity with the first switching valve 90 (close proximity requires the positions to be approximately fixed) due to assembly tolerances or the like in the ball chain 62 raised by the motor 50 can be suppressed, and breaks in the ball chain can be prevented from occurring.

The water discharge apparatus 70 is furnished with a valve body 72 for opening and closing the discharge port 22*a*, a control cylinder 78 furnished with a reservoir portion 78*d* for storing flush water, furnished with small holes 78*f* (78*e*) formed to discharge a predetermined small volume of flush water stored, and a float 80 disposed inside the reservoir portion 78*d* so as to drop together with the drop in water level inside the reservoir portion 78*d*; the valve body 72 is configured to drop in tandem with the dropping of the float 80 so as to close the discharge port 22*a*, and therefore performs a stopping action by means of the dropping of the flush water stored in the control cylinder 78 reservoir portion 78*d*, resulting in a structure in which the valve closing action is not affected even if the cylindrical body 76 opening surface area is adjusted to change the flush water flow volume flowing from outside to inside the cylindrical body 76, and as a result a more reliable multistage flush can be obtained.

Using the flush water tank apparatus 18 according to the above-described first embodiment of the present invention, water levels outside the cylindrical body 76 immediately after the valve body 72 closes the discharge port 22*a* (large flush mode (FIG. 9: WL1), small flush mode (FIG. 15: WL2), eco-small flush mode (FIG. 20: WL3)) are respectively positioned above the cylindrical body 76 opening portion 76*c*, therefore flush water flowing into the cylindrical body 76 opening portion 76*c* has high head pressure, and achieves a strong current force. Therefore flush water at a strong current force can be supplied to the toilet 1 until discharge is complete. As a result, flushing can be reliably performed using a smaller flush water volume, and even further water conservation can be achieved.

Also, the valve body drop motion control device (78*f*, 78*e*) disposed on control cylinder 78, which control the dropping motion of the valve body 72 using flow volume, are disposed on the opposite side from the control cylinder 78 on the cylindrical body 76, therefore susceptibility to the effects of strong current flush water flowing inward to the cylindrical body 76 via the opening portion 76*c* from outside the cylindrical body 76 is suppressed, and downward motion of the valve body 72 can be stabilized. Valve body 72 valve closing timing is therefore also stabilized, and water conservation can be more reliably achieved.

Also, the valve body drop motion control device (78*f*, 78*e*) are disposed on the side surface of the control cylinder 78, making them less susceptible to the effects of strong current force flush water flowing into the inside of the cylindrical body 76 from the opening portion 76*c*, hence the dropping motion of the valve body 72 can be more reliably stabilized.

The present invention is a flush toilet 1 furnished with the aforementioned flush water tank apparatus 18.

The present invention thus configured provides a flush toilet 1 for achieving water conservation. In particular, when the flush toilet 1 is a wash-down type of toilet, flush water with current force is provided from the start to the end of the flush, so that a flushing effect is more reliably achieved.

Using the flush water tank apparatus 18 according to the above-described first embodiment of the present invention, the overflow pipe 74 and valve body 72 are configured to drop in tandem with the drop of the float 80 accompanying the fall in the water level inside the reservoir portion 78*d* caused by the outflow of flush water in the reservoir portion 78*d*, thereby closing the discharge port 22*a*, and the speed at which the level of the flush water inside the reservoir portion 78*d* drops can be adjusted by adjusting the outflow volume of flush water inside the reservoir cylinder 78*d* using the small holes 78*f*, 78*e*, therefore the dropping speed of the water level inside the reservoir cylinder 78*d* and the dropping speed of the float 80 can be changed. Hence the valve closing timing by the valve body 72, which drops in tandem with the float 80 and closes the discharge port 22*a*, can also be changed. As a result, in the large flush mode and the small flush mode, the volume of flush water supplied to the toilet 1 can be changed. Also, by changing the speed at which the valve body 72 drops in tandem with the drop in the water level inside the reservoir portion 78*d*, the present invention adjusts the valve closing timing; since the float 80, the overflow pipe 74, and the valve body 72 are disposed further inside the control cylinder 78, which itself is disposed inside the cylindrical body 76, effects of flush water flowing in from the opening portion 76*c* formed on the cylindrical body 76 can be suppressed, the up-and-down motion of the overflow pipe 74 and the valve body 72 can be stabilized, and desired volumes of flush water can be more reliably obtained.

Due to the presence of the small holes 78*f*, 78*e* (outflow ports) for allowing the outflow of flush water in the reservoir cylinder 78*d*, and the slide member (adjusting member) 86 for adjusting the opening surface area of these small holes 78*f*, 78*e*, the dropping speed of the water level in the reservoir cylinder 78*d* and the dropping speed of the float 78*d* can be more reliably changed, therefore timing of the closing of the valve body 72, which drops in tandem with the float 80 to close the discharge port 22*a*, can also be more reliably changed. As a result, in the large flush mode and the small flush mode, the volume of flush water supplied to the toilet 1 can be more reliably changed.

The small holes 78*e*, 78*e* on the reservoir portion 78*d* are formed on the opposite side surface relative to the opening portion 76*c* formed on the cylindrical body 76, therefore effects of flush water flowing into the cylindrical body from the opening portion 76*c* of the cylindrical body 76 can be suppressed, and flow volumes of flush water flowing out from the outflow port of the reservoir cylinder can be stabilized, with the result that operation of the discharge valve can be stabilized.

The slide member 86 slides relative to the small hole 78*e* to adjust the opening surface area thereof, so that the valve closing timing by the valve body 72 can be changed using a simple structure.

At least two outflow ports—small holes 78*f*, 78*e*—are formed on the reservoir cylinder 76*d*; the slide member 86 holds small hole 78*f*, one of at least two outflow ports, constantly open, and is switched to open and close the remaining small hole 78*f* in stages in accordance with the desired flush water volume, so that in each flush mode at least two different flush water volumes can be obtained.

The slide member 86 is disposed so that of the two small holes 78*f*, 78*e* formed on the reservoir cylinder 76*d*, it opens and closes only one small hole, 78*e*, therefore the two small holes 78*f*, 78*e* are placed in a constantly open state by the slide member 86 to increase the dropping speed of the water level inside the reservoir cylinder 76*d* and the dropping speed of the float 80, thereby speeding up the timing of valve closing by the valve body 72 to reduce flush water volume and fulfill the requirement in recent years for water conservation; when, on the other hand, the desired volume of flush water is greater than such cases, the small hole 78*e* is closed by the slide member 86, so that outflow of flush water occurs only from the small hole 78*f*, further slowing down the dropping speed of the water level inside the reservoir cylinder 78*d* and the dropping speed of the float 80, thereby delaying the timing of valve closing by the valve body 72, so that the volume of flush water can be increased by the amount of that delay in the valve closing timing.

Next, referring to FIG. 22, the flush water tank apparatus according to a second embodiment of the present invention will be explained.

Figure 22:
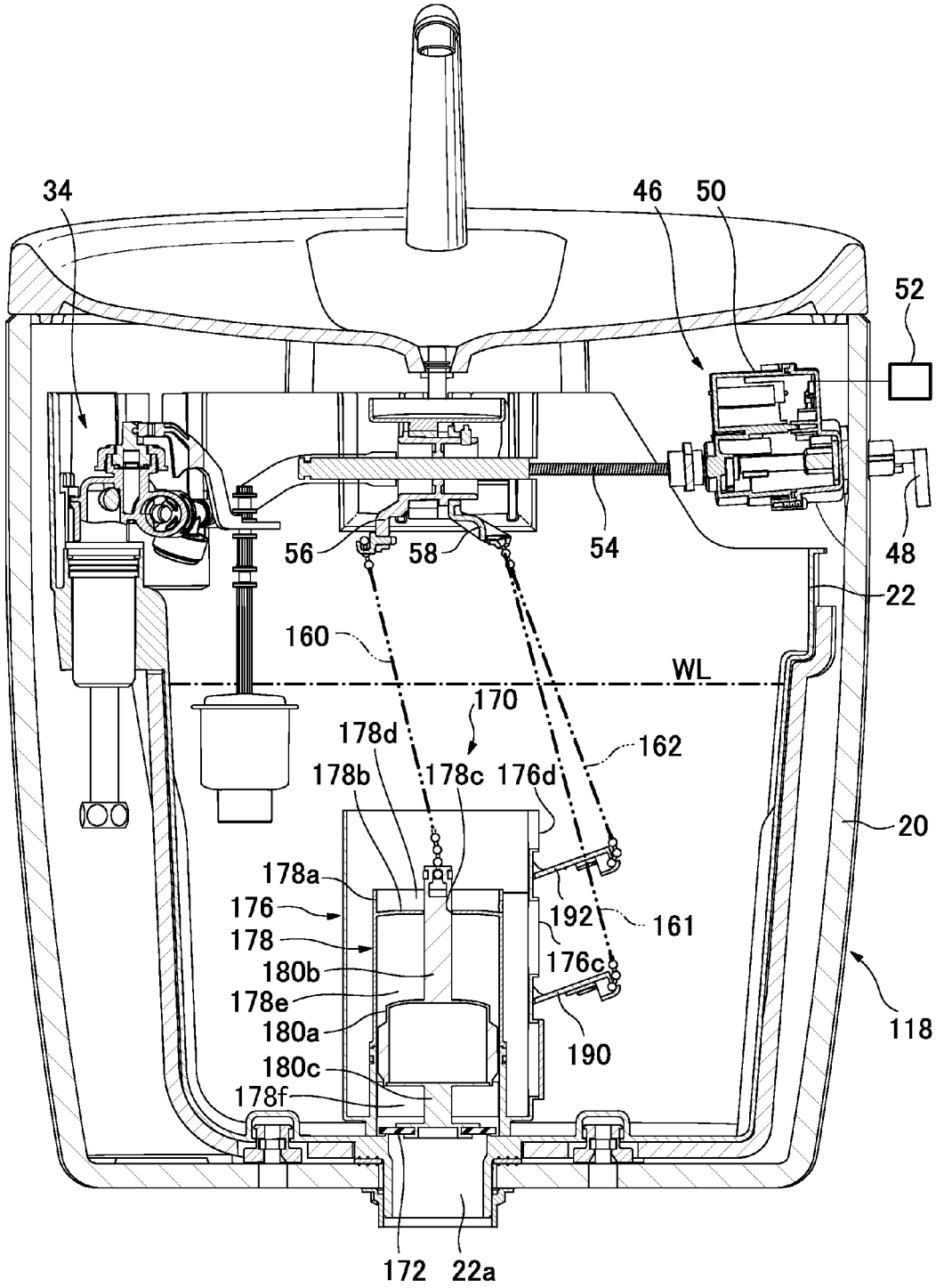
FIG. 22 is a front elevation sectional view showing the outline structure of a flush water tank apparatus according to a second embodiment of the present invention.

FIG. 22 is front elevation sectional view showing the outline structure of a flush water tank apparatus according to a second embodiment of the present invention. Note that in the flush water tank apparatus according to the second embodiment, the basic structure is the same as in the above-described first embodiment, with the structures of the water discharge apparatus 170 and the ball chain being different, so only those differing parts are explained. Note that the same reference numerals are used for those parts which are the same as in the first embodiment.

As shown in FIG. 22, the water discharge apparatus 170 in the flush water tank apparatus 118 according to the second embodiment is furnished with a cylindrical body 176, a control cylinder 178 disposed inside this cylindrical body 176, and a float 180 disposed inside this control cylinder 178.

The cylindrical body 176 is formed in an approximately rectangular shape in section; formed on one side surface thereof at approximately the midway portion in the vertical direction is a first opening portion 176*c*, and formed on the same side surface above the first opening portion 176*c*, cut away so as to be open at its top, is a second opening portion (cutaway opening portion) 176*d*. Note that this second opening portion 176*d* may also be like the first opening portion 176*c*, the top part of which is not open.

Placed on the cylindrical body 176 are a first switching valve 190 capable of opening and closing the first opening portion 176*c*, and a second switching valve 192, capable of opening and closing the side of the second opening portion 176*d*. These switching valves 190, 192 are capable of plugging each the opening portions 176*c*, 176*d* from the side; no structure of the first switching valve 90 communicating port 90*b* in the above-described first embodiment is formed.

In the second embodiment, the top end parts of a second ball chain 161 and a third ball chain 162 are respectively attached to the second lifting member 58; the bottom end part of the second ball chain 161 is attached to the first switching valve 190, and the bottom end part of the third ball chain 162 is attached to the second switching valve 192.

The top end part of the first ball chain 160 is attached to the first lifting member 56.

The float 180 has a float main unit 180*a* having a top surface formed in an arcuate shape and rod-shaped parts 180*b*, 180*c* extending up and down; the bottom end part of the first ball chain 160 is attached to the top end portion of the rod-shaped part 180*b*. A valve body 172 for opening and closing the discharge port 22*a* is attached to the bottom end portion of rod-shaped part 180*c*.

The control cylinder 178 has a cylindrical sidewall 178*a* and an arcuate lateral wall portion 178*b* formed to fit the shape of the top surface of a float main unit 180*a*; a hole portion 178*c* penetrating the upper rod-shaped part 180*b* of the float 180 is formed on this lateral wall portion 178.

Respectively formed on the control cylinder 178 are a reservoir portion 178*d* for storing flush water when, as described below, buoyancy causes the float 180 to tightly contact the bottom surface of the lateral wall portion 178*b*, and a flush water holding portion 178*e* for holding flush water.

Formed at the bottom part of control cylinder 178 is an inflow port 178*f* for allowing flush water to flow into the discharge port 22*a* from outside.

Next the motion of the flush water tank apparatus according to a second embodiment of the present invention will be explained.

Figure 23:
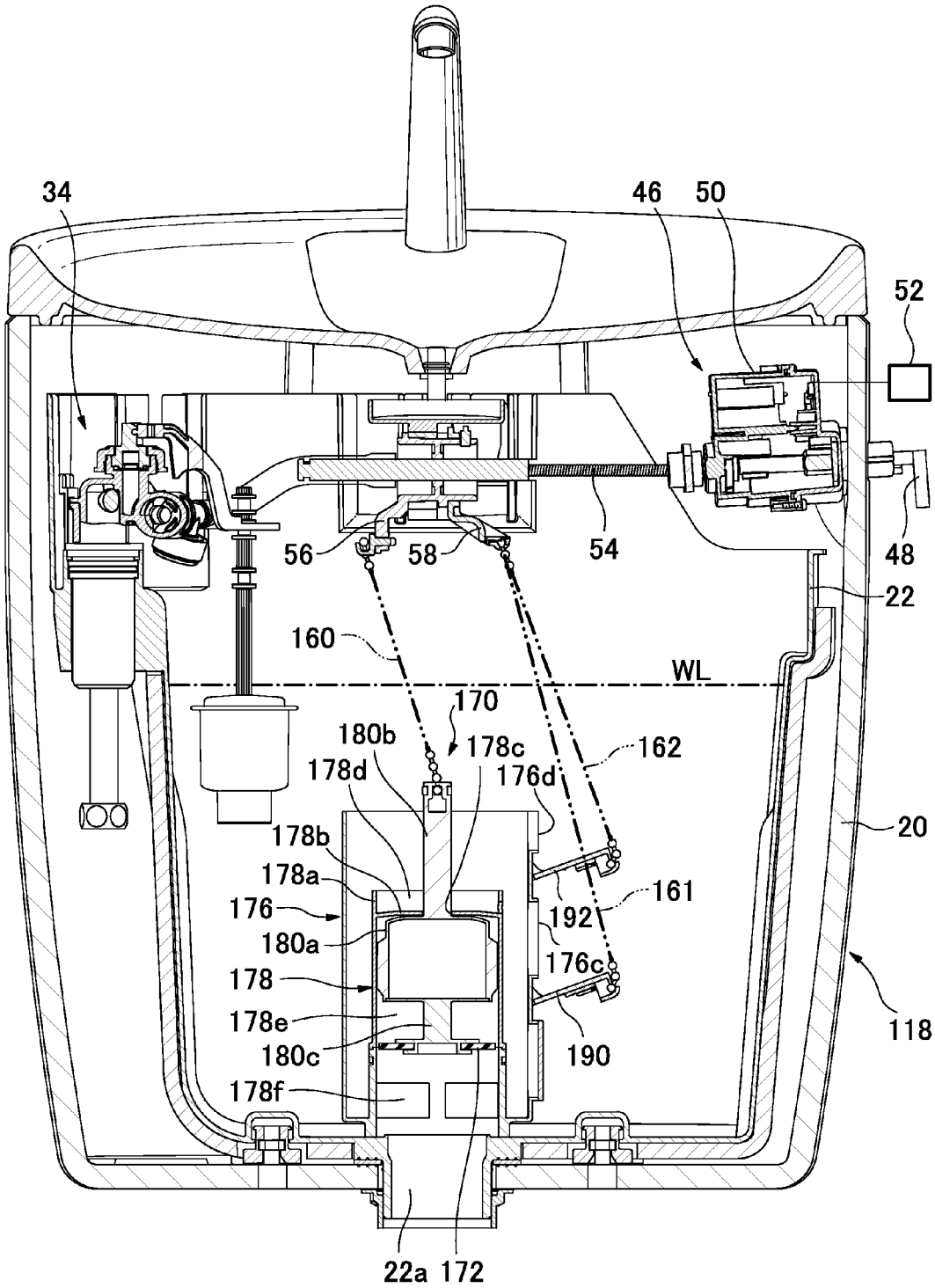
FIG. 23 is an overview sectional view showing the state of a flush water tank apparatus according to a second embodiment of the present invention in the large flush mode at the start of water discharge.
Figure 24:
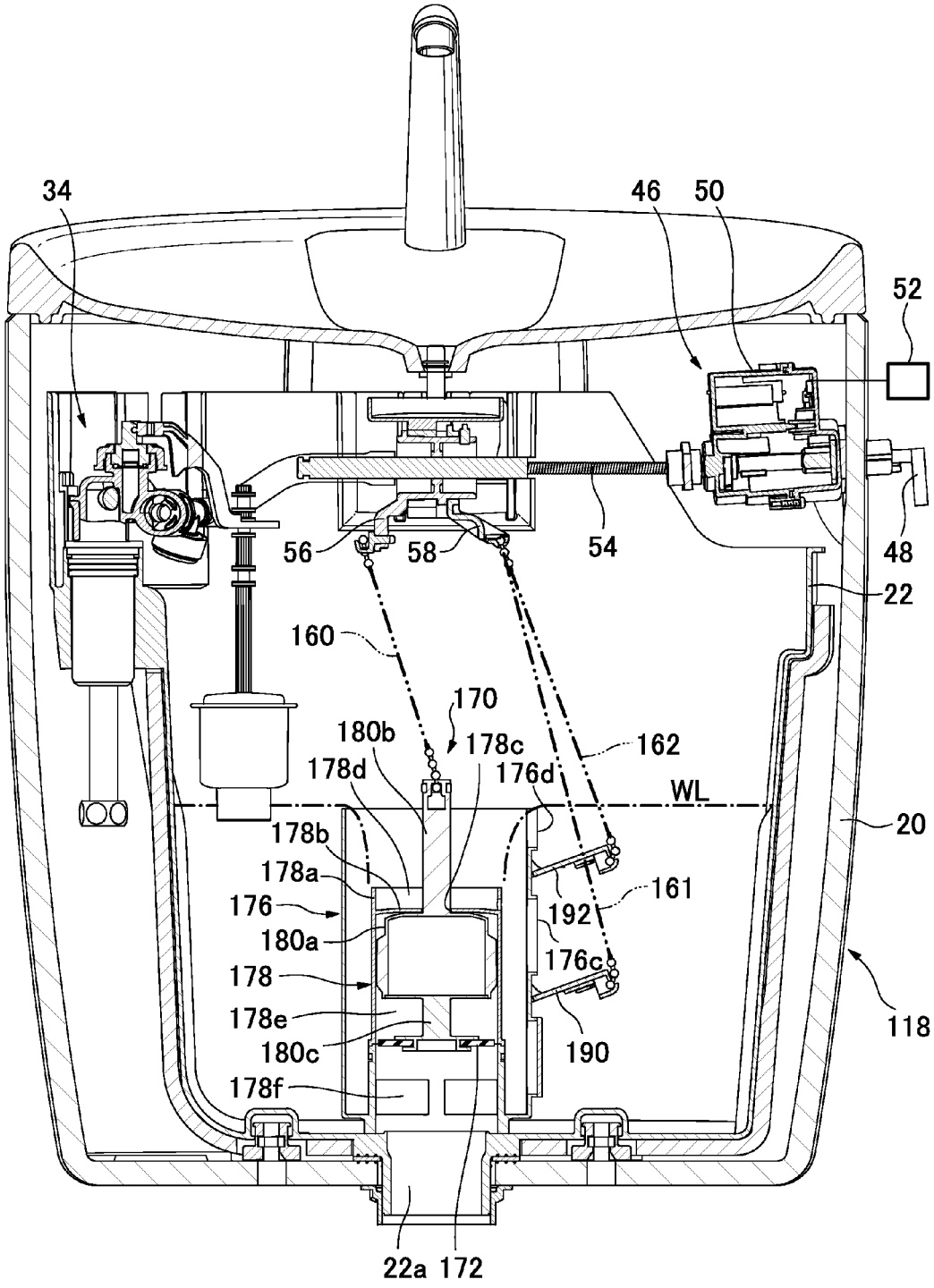
FIG. 24 is an overview sectional view showing the state of a flush water tank apparatus according to a second embodiment of the present invention in the large flush mode midway through water discharge.
Figure 25:
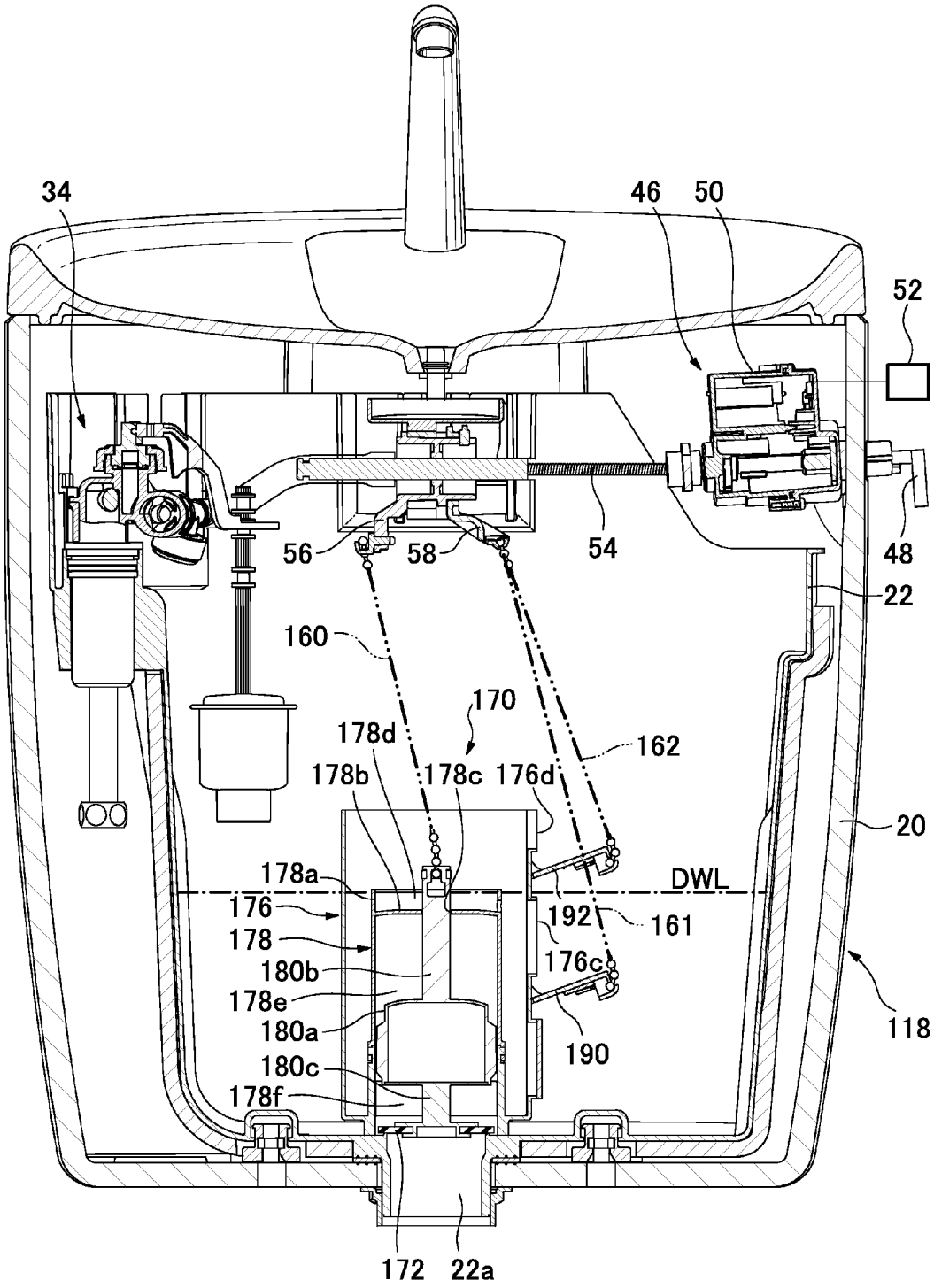
FIG. 25 is an overview sectional view showing the state of a flush water tank apparatus according to a second embodiment of the present invention in the large flush mode after the end of water discharge.

First, referring to FIGS. 23 through 25, the large flush mode according to a second embodiment of the present invention is explained.

FIG. 23 is a summary sectional view showing the state upon the start of water discharge in the large flush mode in a flush water tank apparatus according to a second embodiment of the present invention; FIG. 24 is a summary sectional view showing the state midway through water discharge in the large flush mode in a flush water tank apparatus according to a second embodiment of the present invention; and FIG. 25 is a summary sectional view showing the state after completion of water discharge in the large flush mode in a flush water tank apparatus according to a second embodiment of the present invention.

First, as shown in FIG. 23, at the start of the large flush mode, when a user rotates the operating lever 48 by 90° toward the front, or when the large flush button is pushed and the motor 50 is activated, only the first lifting member 56 oscillates, and the float 180 is lifted via the first ball chain 160. By this, the discharge port 22*a* opens and water discharge begins.

At this point the float 180 tightly contacts a lateral wall portion 178*b* formed in an arcuate shape such as that shown in FIG. 23; it is pulled up to the position at which it blocks the hole portion 178*c*, and the reservoir portion 178*d* and flush water holding portion 178*e* are respectively filled with flush water.

When the operating lever 48 is returned to its initial position immediately after completion of such lifting, the first lifting member 56 is returned to its initial position, or the motor 50 is activated so that the first lifting member 56 returns to its initial position.

Next, as shown in FIG. 24, the overall water level (WL) of flush water in the reservoir tank 22 drops with time after the start of discharge, and when the water level drops to the vicinity of the cylindrical body 176 top edge portion (top surface), flush water in the cylindrical body 176 is rapidly discharged from the discharge port 22*a*.

At this point air enters the flush water holding portion 178*e* from the bottom portion of the flush water holding portion 178*e* via the inflow port 178*f*, the float 180 loses buoyancy, the flush water in the reservoir portion 178*d* and flush water holding portion 178*e* flows out in the downward direction as the float 180 drops, closing the valve body 172 discharge port 22*a* (closing the valve), and water discharge ends.

After such a valve closing, the water level shown in FIG. 25 (DWL) is the water level outside the cylindrical body 176 is the dead water level finally obtained when flush water outside the cylindrical body 176 flows into the cylindrical body 176 via the opening portions 176*c*, 176*d*.

Next, referring to FIGS. 26 through 29, the small flush mode according to a second embodiment of the present invention is explained.

Figure 26:
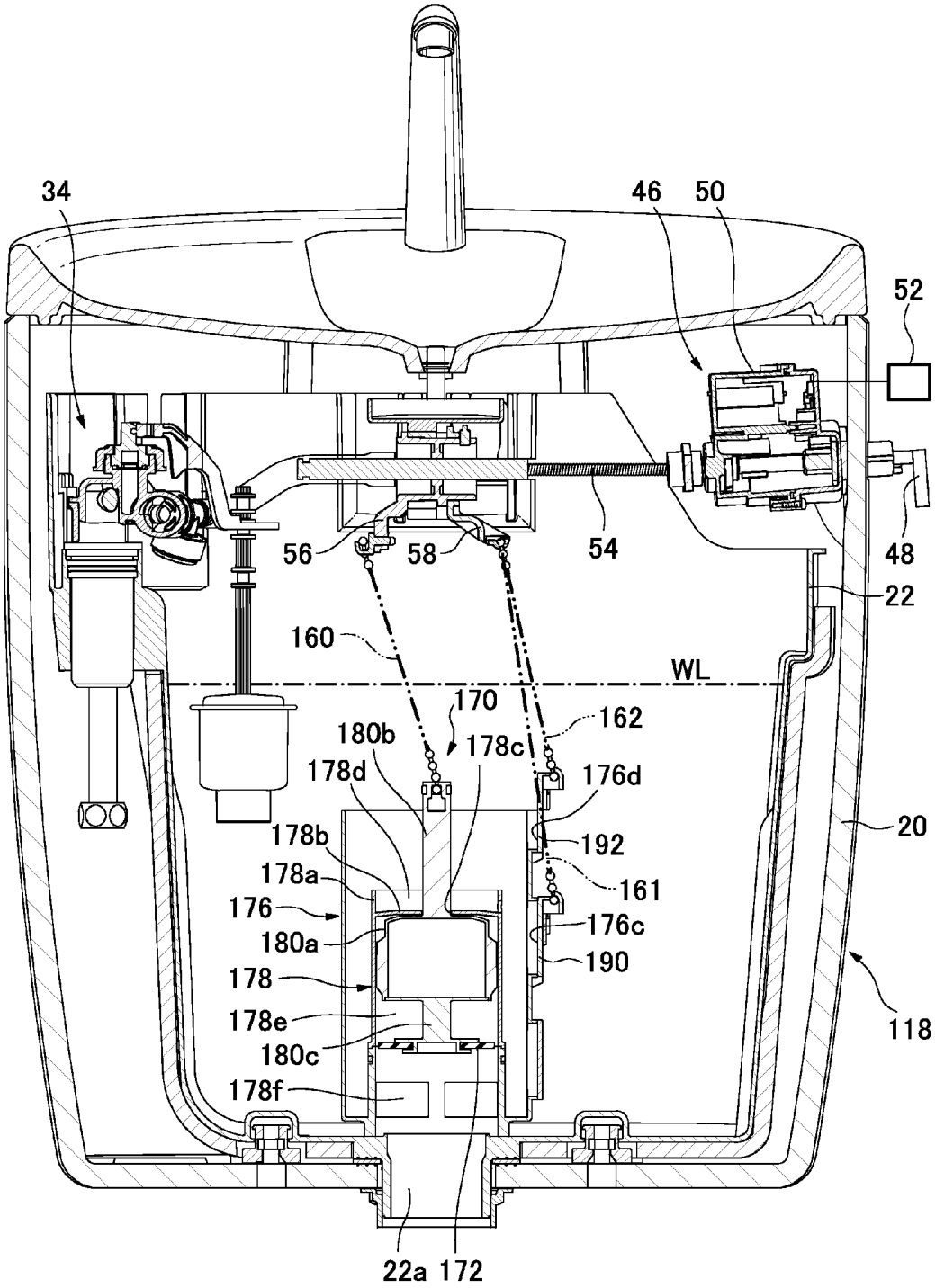
FIG. 26 is an overview sectional view showing the state of a flush water tank apparatus according to a second embodiment of the present invention in the small flush mode at the start of water discharge.
Figure 27:
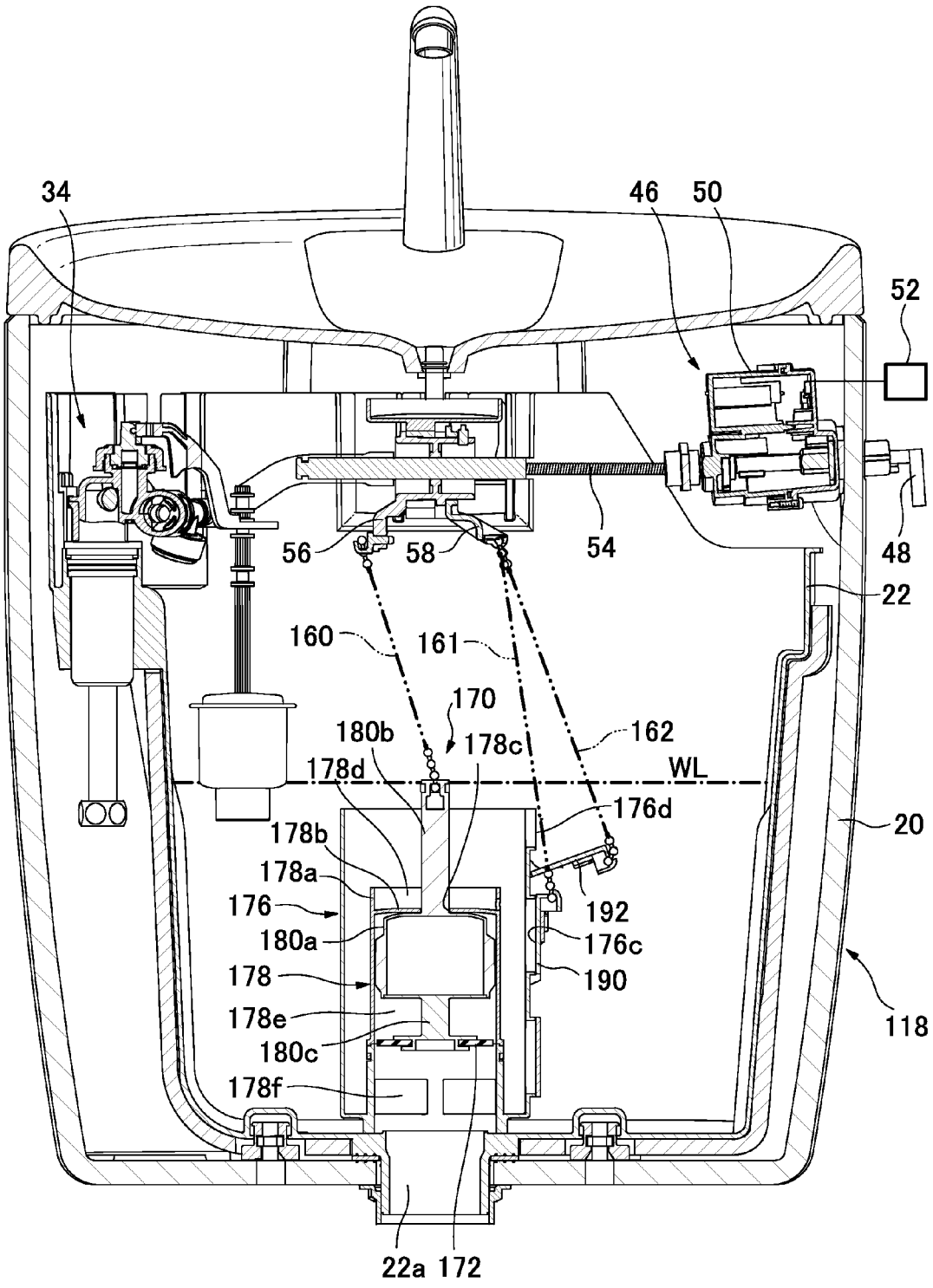
FIG. 27 is an overview sectional view showing the state of a flush water tank apparatus according to a second embodiment of the present invention in the small flush mode midway through water discharge.
Figure 28:
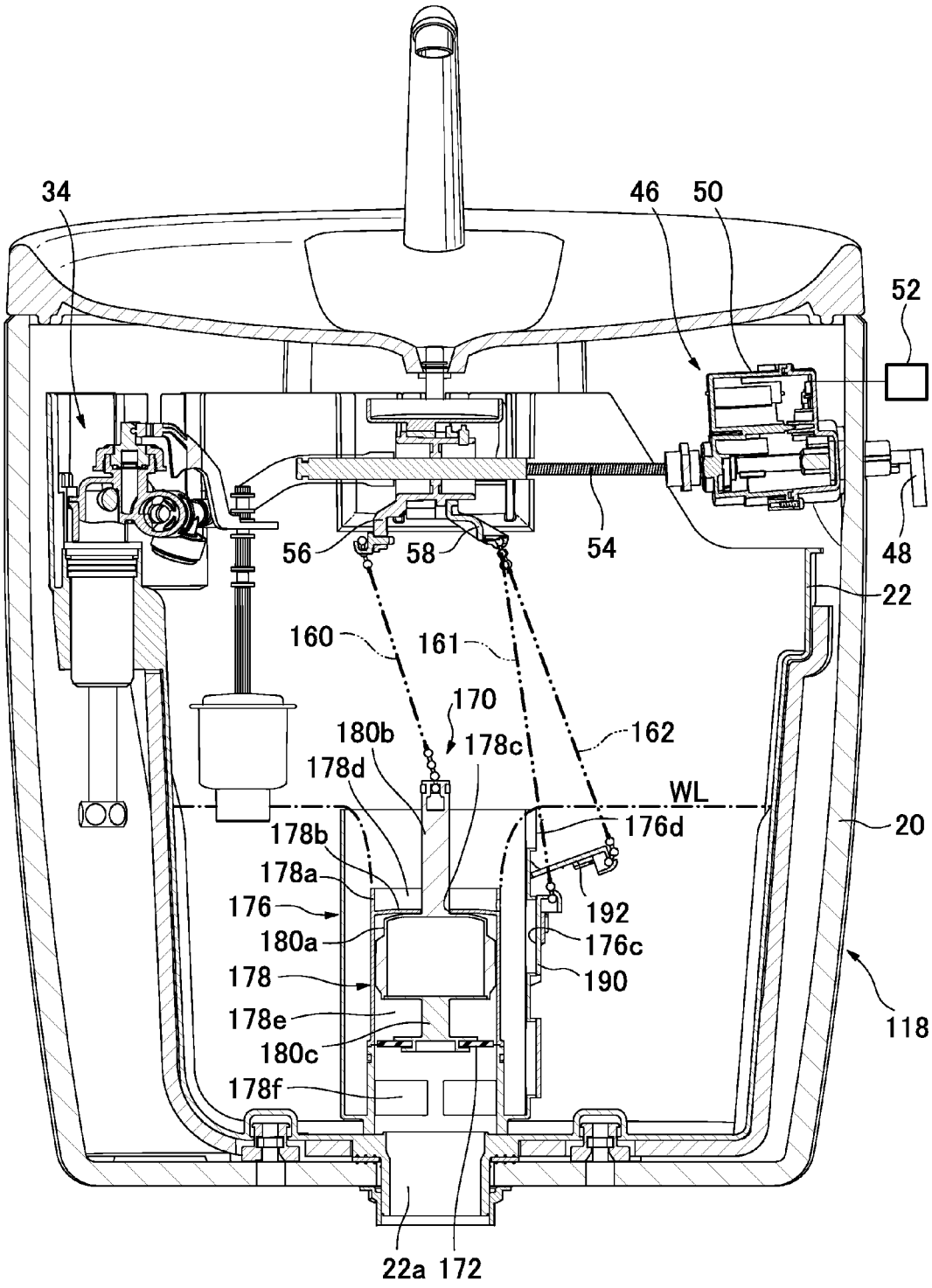
FIG. 28 is an overview sectional view showing the state of a flush water tank apparatus according to a second embodiment of the present invention in the small flush mode midway through water discharge.
Figure 29:
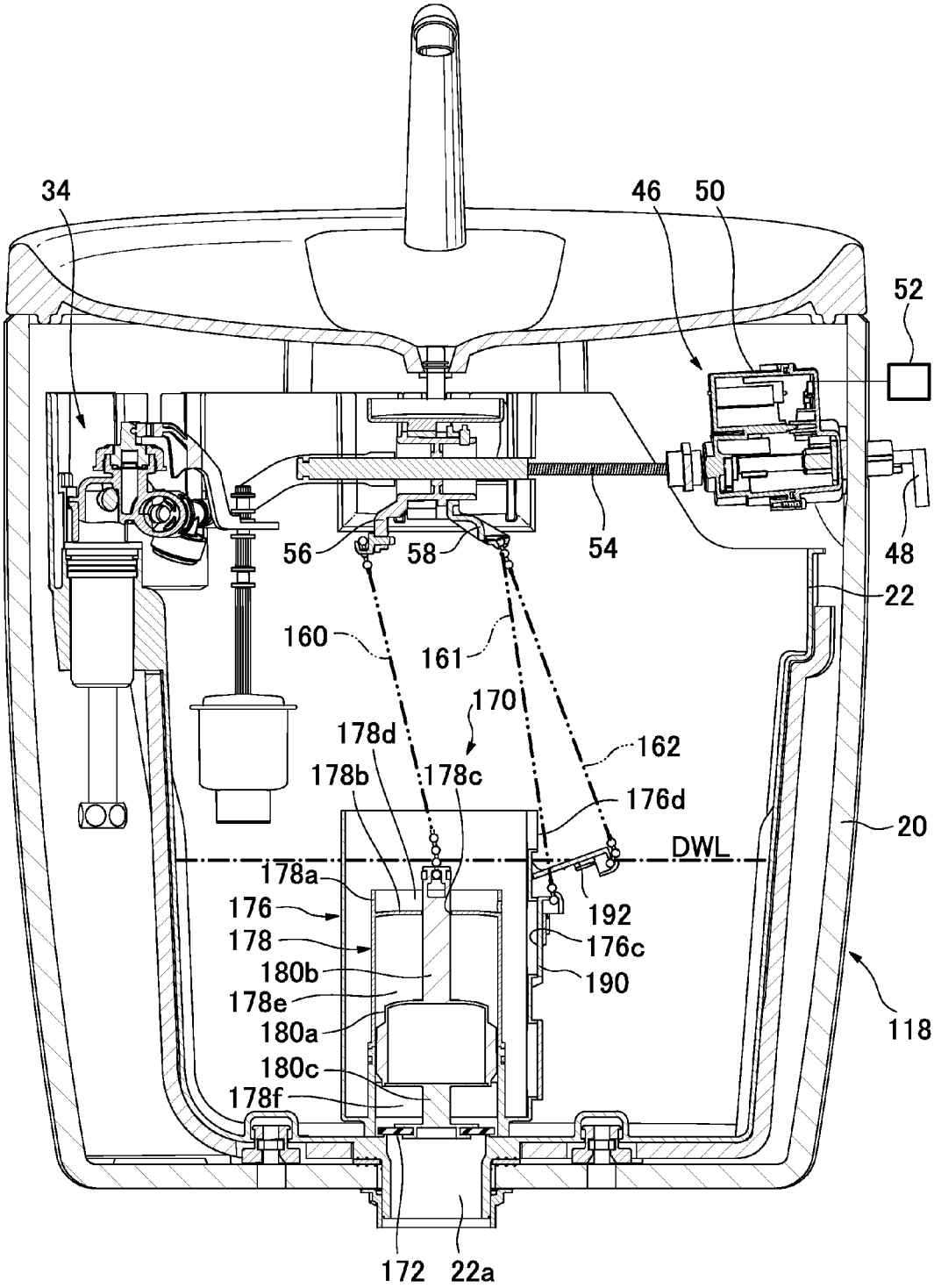
FIG. 29 is an overview sectional view showing the state of a flush water tank apparatus according to a second embodiment of the present invention in the small flush mode after the end of water discharge.

FIG. 26 is a summary sectional view showing the state upon the start of water discharge in the small flush mode in a flush water tank apparatus according to a second embodiment of the present invention; FIG. 27 is a summary sectional view showing the state midway through water discharge in the small flush mode in a flush water tank apparatus according to a second embodiment of the present invention; FIG. 28 is a summary sectional view showing the state during water discharge in the small flush mode in a flush water tank apparatus according to a second embodiment of the present invention; and FIG. 29 is a summary sectional view showing the state after completion of water discharge in the small flush mode in a flush water tank apparatus according to a second embodiment of the present invention.

First, as shown in FIG. 26, at the start of the small flush mode, when a user rotates the operating lever 48 by 90° toward the back, or when the small flush button is pushed and the motor 50 is activated, both the first lifting member 56 and the second lifting member 58 oscillate.

Float 180 is lifted via the first ball chain 160 by the oscillation of the first lifting member 56; this results in opening of the discharge port 22*a*, such that water discharge is started. The first switching valve 190 is lifted via the second ball chain 161 and the second switching valve 192 is lifted via the third ball chain 162 as the result of oscillation of the second lifting member 58.

When the operating lever 48 is returned to its initial position immediately after completion of such lifting, the first lifting member 56 is returned to its initial position, or the motor 50 is activated so that the first lifting member 56 returns to its initial position.

At this point the float 180 tightly contacts a lateral wall portion 178*b* formed in an arcuate shape such as that shown in FIG. 23; it is pulled up to the position at which it blocks the hole portion 178*c*, and the reservoir portion 178*d* and flush water holding portion 178*e* are respectively filled with flush water.

As shown in FIG. 27, when the second lifting member 58 is returned to its initial position, the second switching valve 192 returns to the initial position shown in FIG. 27 under its own weight.

On the other hand the first switching valve 190, as described above in the first embodiment, is held by the pressure differential produced by the flush water flow speed differential between the inside and outside of the cylindrical body 176 at the position where the opening portion 176*c* is closed.

Next, as shown in FIG. 28, the overall water level (WL) of flush water in the reservoir tank 22 drops with time after the start of discharge, and when the water level drops to the vicinity of the cylindrical body 176 top edge portion (top surface), flush water in the cylindrical body 176 is rapidly discharged from the discharge port 22*a*. The overall water level (WL) of flush water in the reservoir tank 22 drops down to the vicinity of the lower edge of the cylindrical body 176 second opening portion 176*d*.

At this point, air enters the flush water holding portion 178*e* from the bottom portion of the flush water holding portion 178*e* via the inflow port 178*f*, the float 180 loses buoyancy, the flush water in the reservoir portion 178*d* and flush water holding portion 178*e* flows out in the downward direction as the float 180 drops, closing the valve body 172 discharge port 22*a* (closing the valve), and water discharge ends.

After such a valve closing, the water level shown in FIG. 29 (DWL) is the dead water level finally obtained when flush water outside the cylindrical body 176 flows into the cylindrical body 176 via the opening portion 176*d*.

Next, referring to FIGS. 30 through 33, the eco-small flush mode according to a second embodiment of the present invention is explained.

Figure 30:
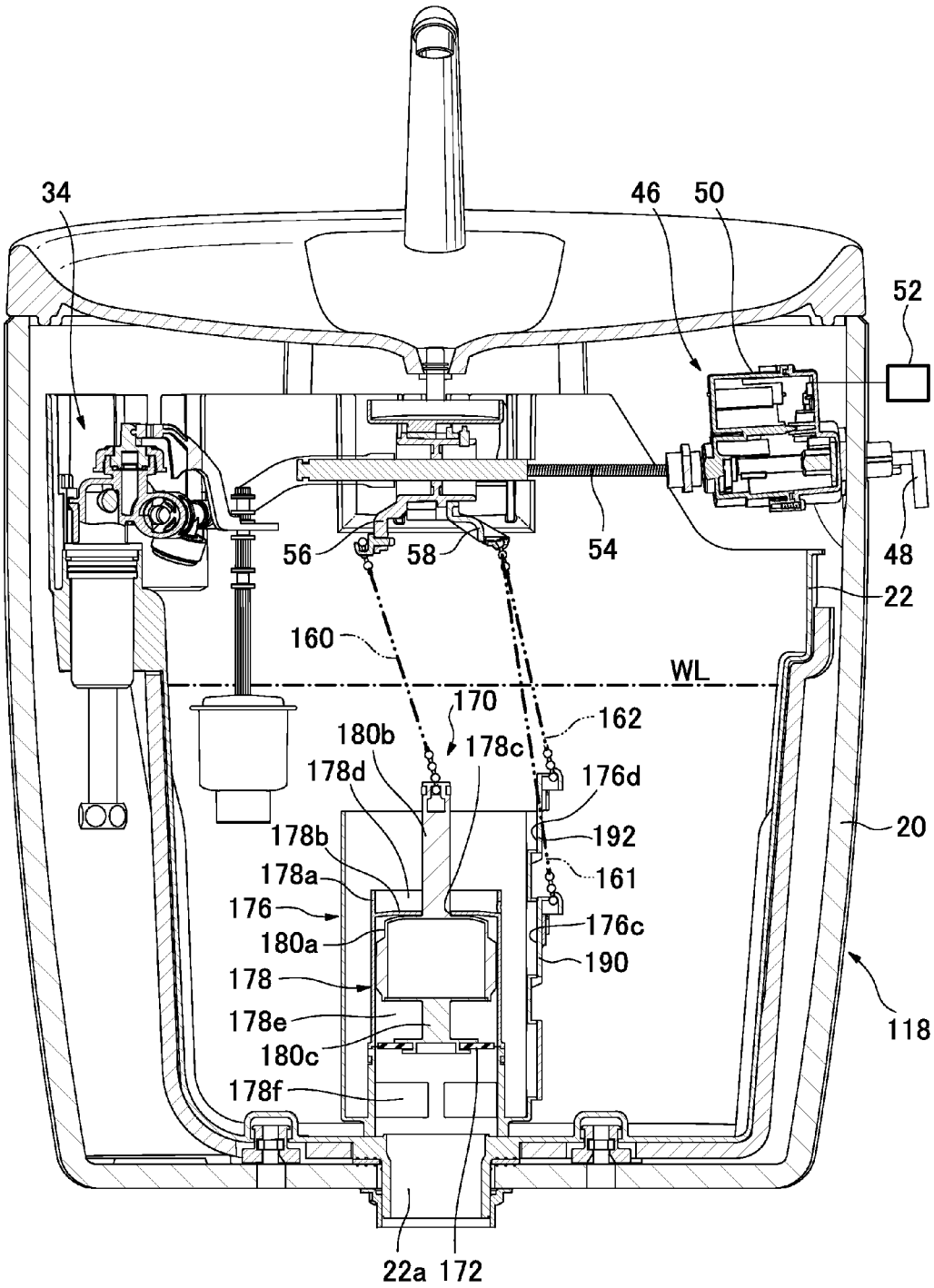
FIG. 30 is an overview sectional view showing the state of a flush water tank apparatus according to a second embodiment of the present invention in the eco-small flush mode at the start of water discharge.
Figure 31:
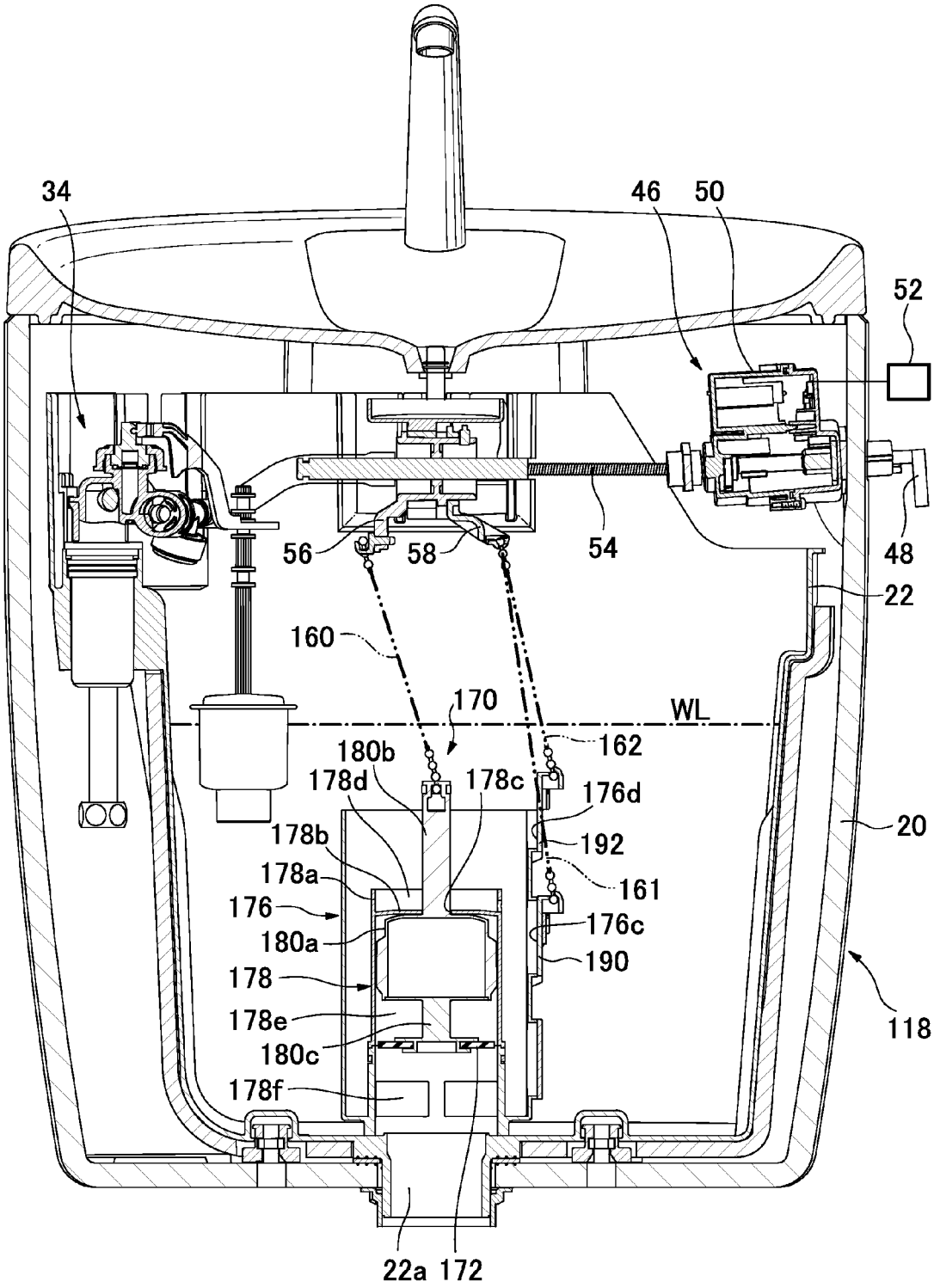
FIG. 31 is an overview sectional view showing the state of a flush water tank apparatus according to a second embodiment of the present invention in the eco-small flush mode midway through water discharge.
Figure 32:
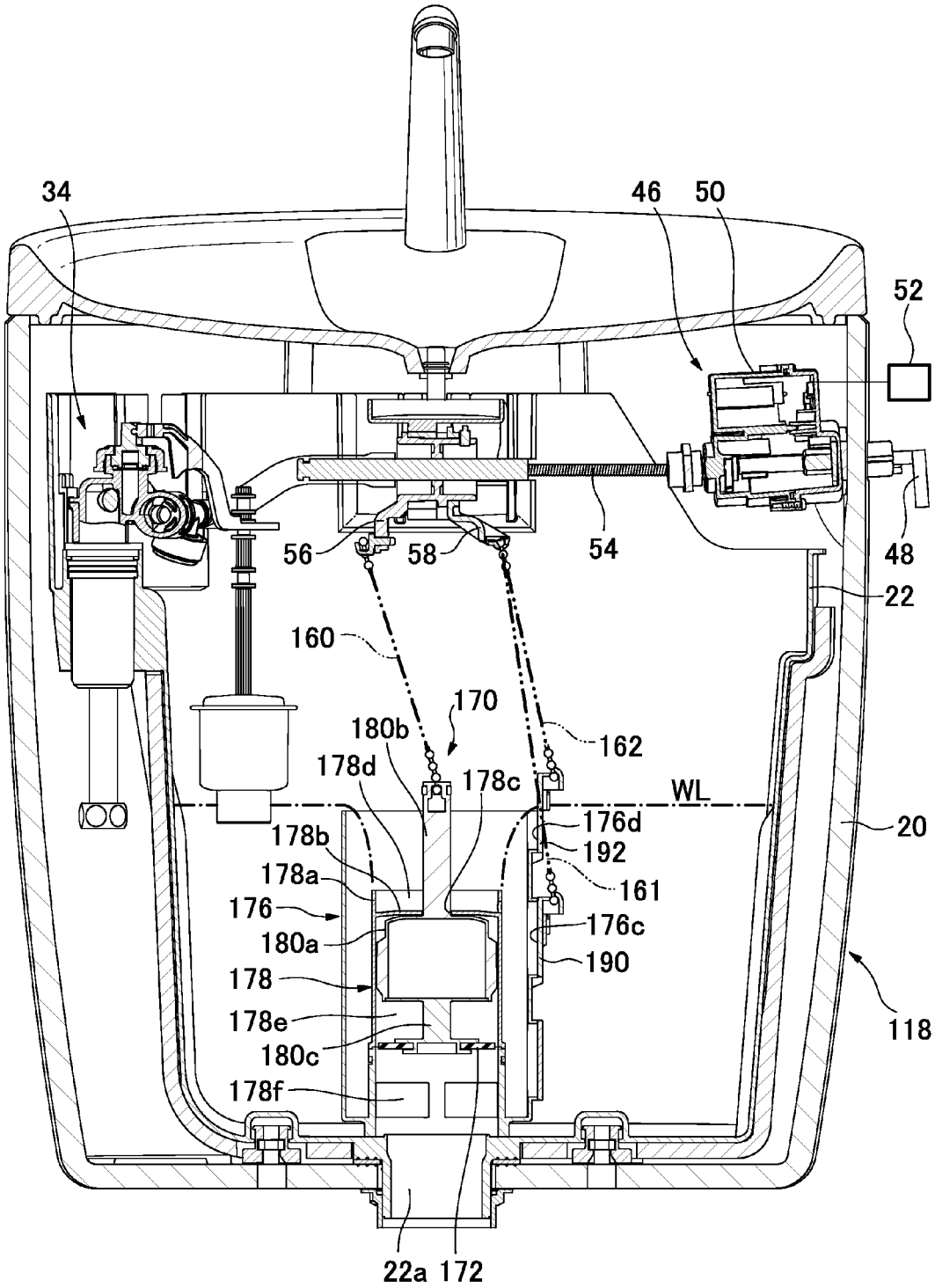
FIG. 32 is an overview sectional view showing the state of a flush water tank apparatus according to a second embodiment of the present invention in the eco-small flush mode midway through water discharge.
Figure 33:
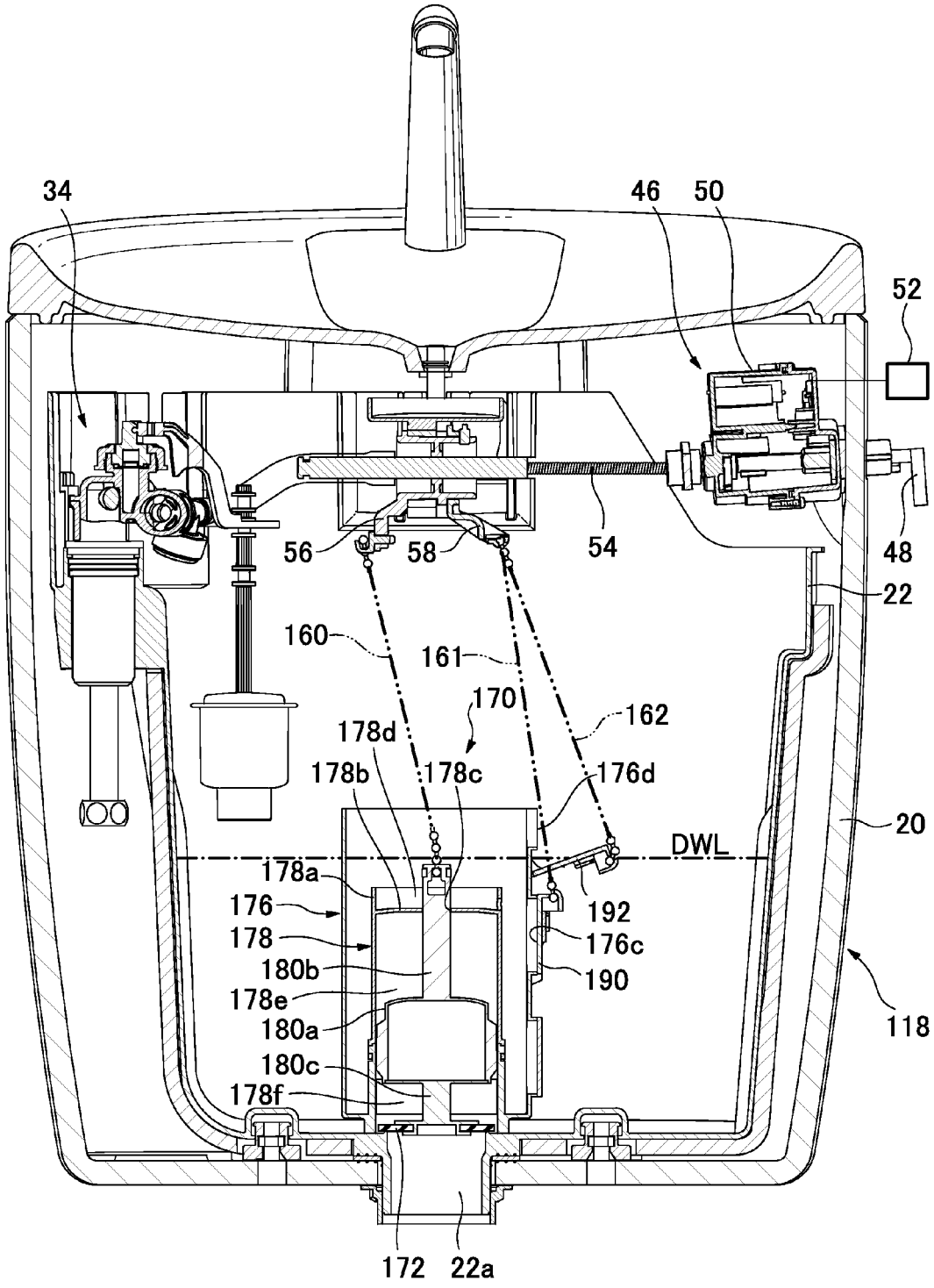
FIG. 33 is an overview sectional view showing the state of a flush water tank apparatus according to a second embodiment of the present invention in the eco-small flush mode after the end of water discharge.

FIG. 30 is a summary sectional view showing the state upon the start of water discharge in the eco-small flush mode in a flush water tank apparatus according to a second embodiment of the present invention; FIG. 31 is a summary sectional view showing the state midway through water discharge in the eco-small flush mode in a flush water tank apparatus according to a second embodiment of the present invention; FIG. 32 is a summary sectional view showing the state during water discharge in the eco-small flush mode in a flush water tank apparatus according to a second embodiment of the present invention; and FIG. 33 is a summary sectional view showing the state after completion of water discharge in the eco-small flush mode in a flush water tank apparatus according to a second embodiment of the present invention.

First, as shown in FIG. 30, at the start of the eco-small flush mode when a user pushes the small flush button and the motor 50 is activated, both the first lifting member 56 and the second lifting member 58 oscillate.

Float 180 is lifted via the first ball chain 160 by the oscillation of the first lifting member 56; this results in opening of the discharge port 22*a*, such that water discharge is started. The first switching valve 190 is lifted via the second ball chain 161 and the second switching valve 192 is lifted via the third ball chain 162 as the result of oscillation of the second lifting member 58. At this point the float 180 tightly contacts a lateral wall portion 178*b* formed in an arcuate shape such as that shown in FIG. 23; it is pulled up to the position at which it blocks the hole portion 178*c*, and the reservoir portion 178*d* and flush water holding portion 178*e* are respectively filled with flush water.

In the eco-small flush mode, after completion of this lifting, the motor 50 is activated so that the first lifting member 56 and the second lifting member 58 are held at that position. I.e., the float 180, first switching valve 190, and second switching valve 192 are all held at the position shown in FIG. 32.

Next, as shown in FIG. 31, the overall water level (WL) of flush water in the reservoir tank 22 drops with time and thereafter, as shown in FIG. 14 and as in the above-described large flush mode, when the water level drops to the vicinity of the cylindrical body 176 top edge portion, flush water in the cylindrical body 176 is rapidly discharged from the discharge port 22*a*.

At this point, in the present embodiment the float 180 is kept in the held state. Therefore the float 180 and valve body 172 do not drop and close the valve even if air enters the flush water holding portion 178*e* from the bottom portion of the flush water holding portion 178*e*. Thereafter the motor 50 releases the hold on the float 180 and on each switching valve 190, 192 at the timing at which all the water in the cylindrical body 176 is discharged from the discharge port 22*a*.

The water level (DWL) shown in FIG. 33 is the dead water level after such a valve closing.

Using the flush water tank apparatus 118 according to the above-described second embodiment of the present invention, switching valves 190, 192 for opening and closing so as to adjust the opening surface area of the cylindrical body 176 opening portions 176*c*, 176*d* are provided so that the volume of flush water supplied from the reservoir tank 22 discharge port 22*a* to the flush toilet 1 can be obtained in multiple stages including a large flush mode, a small flush mode, and a eco-small flush mode; therefore multiple stages of flush water volumes can be effectively obtained. As a result, the requirement in recent years for water conservation can be met.

What is claimed is:

1. A flush water tank apparatus for storing flush water to flush a flush toilet, comprising:

a reservoir tank for storing flush water, the reservoir tank having a discharge port formed on the bottom surface thereof;

a discharge valve for opening and closing the discharge port and supplying flush water to a flush toilet;

a cylindrical body having a side surface extending in the upward direction from the bottom surface of the reservoir tank so as to surround the discharge port, the cylindrical body being opened at the top and forming an opening portion on the side surface;

a switching valve for opening and closing the opening portion on the cylindrical body to enable adjustment of the opening surface area of the opening portion on the cylindrical body; and an operating device for selecting one stage of flush volume among multiple-stage flush volumes including at least three-stage flush volumes of large flush, medium flush, and small flush which is supplied to the flush toilet, in every flush, when the flush toilet is flushed;

the switching valve being configured to adjust the opening surface area of the opening portion on the cylindrical body so as to supply the flush volume of the selected stage to the flush toilet, after the operating device selects the one stage of flush volume;

wherein only one of the opening portion of the cylindrical body is formed, and the switching valve has a first switching valve configured so as to be able to reduce the opening surface area of the opening portion of the cylindrical body, and a second switching valve disposed on the outer side of the first switching valve and configured so as to be able to further reduce the opening surface area of the opening portion of the cylindrical body together with the first switching valve.

2. The flush water tank apparatus of claim 1, wherein the first switching valve includes a communicating port for communicating the outside and inside of the cylindrical body when the opening portion of the cylindrical body is closed, the communication port of the first switching valve has an opening surface area smaller than the opening surface area of the opening portion of the cylindrical body; and the second switching valve is configured so as to reduce the opening surface area of the communicating port of the first switching valve when being brought into proximity with the first switching valve;

wherein the first switching valve and second switching valve adjust flush water flow in at least the three stages:

a large flush, whereby both the first and second switching valves are separated from the opening portion of the cylindrical body to fully open the opening portion of the cylindrical body so that the volume of water flowing into inside of the cylindrical body is large; a medium flush, wherein by closing the opening portion of the cylindrical body using the first switching valve, and separating the second switching valve from the first switching valve, the opening surface area of the opening portion of the cylindrical body is reduced to an opening surface area at least approximately the same as the opening surface area of the communication port of the first switching valve, so that the volume of water flowing from outside into inside the cylindrical body is medium; and a small flush, wherein by closing the opening portion of the cylindrical body using the first switching valve and bringing the second switching valve into proximity with the first switching valve, the opening surface area of the opening portion of the cylindrical body is made smaller than the opening surface area of the communication port of the first switching valve, so that the volume of water flowing from outside into inside the cylindrical body is small.

3. The flush water tank apparatus of claim 2, wherein when the first discharging valve discharges water, the first switching valve, when being set to close the opening portion of the cylindrical body, is held in a state in which the opening portion of the cylindrical body is closed by the pressure differential caused by the flush water flow speed differential between the outside and inside of the cylindrical body.

4. The flush water tank apparatus of claim 2, further comprising an electrical drive apparatus for holding the second switching valve at a position proximate to the first switching valve from the start of water discharge to the end of water discharge.

5. The flush water tank apparatus of claim 4, wherein the second switching valve has a protruding portion extending to the first switching valve side and capable of being inserted into the first switching communicating port valve in the state brought into proximity of the first switching valve.

6. The flush water tank apparatus of claim 1, the discharge valve has a valve body for opening and closing the discharge port, a control cylinder furnished with a reservoir portion having a small hole formed to store flush water and to discharge a predetermined small flow quantity of the stored flush water, and a float disposed within the reservoir portion so as to fall as the water level within the reservoir portion drops; wherein the discharge valve is configured so that the valve body drops in tandem with the falling of the float, closing the discharge port.

7. A flush water tank apparatus for storing flush water to flush a toilet, comprising:

a reservoir tank for storing flush water, the reservoir tank having a discharge port on the bottom surface thereof;

a cylindrical body having a side surface extending in the upward direction from the bottom surface of the reservoir tank so as to surround the discharge port, the cylindrical body being opened at the top surface thereof and forming an opening portion on the side surface;

a switching valve formed on the cylindrical body for opening and closing the opening portion;

a control cylinder disposed inside the cylindrical body, furnished with a reservoir portion for storing flush water;

a float disposed inside the reservoir portion so as to be capable of moving up and down in accordance with the level of flush water inside the reservoir portion;

a discharge valve, configured to drop in tandem with the dropping of the float accompanying the drop in water level within the reservoir cylinder due to the outflow of flush water in the reservoir portion of the control cylinder, closing the discharge port; and an adjusting member formed on the reservoir portion of the control cylinder, for adjusting the opening surface area of the outflow port which causes flush water in the reservoir portion to flow out;

wherein at least two outflow ports are formed in the reservoir portion, and the adjusting member is a switching member for switching so that one of the at least two opening portions is always open, and the remaining outflow port is opened or closed in stages according to the desired flush water volume.

8. The flush water tank apparatus of claim 7, wherein the reservoir portion outflow port is formed on the opposite side surface of the reservoir portion relative to the opening portion of the cylindrical body.

9. The flush water tank apparatus of claim 7, wherein the adjusting member slides relative to an outflow port to adjust the opening surface area of the outflow port.

10. The flush water tank apparatus of claim 7, wherein two outflow ports are formed in the reservoir portion of the control cylinder, and the adjusting member is the switching member installed so that only one outflow port of the two outflow ports is opened and closed.

* * * * *